United States Patent [19]

Adamson

[11] Patent Number: 5,070,754

[45] Date of Patent: Dec. 10, 1991

[54] DIGITAL AUDIO SIGNAL PROCESSOR

[76] Inventor: Tod M. Adamson, 412 Jefferson St., Alexandria, Va. 22314

[21] Appl. No.: 246,811

[22] Filed: Sep. 20, 1988

[51] Int. Cl.[5] ..... G04F 5/02

[52] U.S. Cl. ..... 84/454; 324/79 D; 364/484

[58] Field of Search ..... 84/454, DIG. 18, 477 R; 324/79 D, 79 R, 78 D; 307/525, 526; 364/484, 571.07

[56] References Cited

U.S. PATENT DOCUMENTS

| | | | |
|---|---|---|---|
| 3,144,802 | 8/1964 | Faber, Jr. et al. | 84/454 |
| 4,429,609 | 2/1984 | Warrender | 84/454 |
| 4,434,697 | 3/1984 | Roses | 84/454 |
| 4,457,203 | 7/1984 | Schoenberg et al. | 84/454 |
| 4,523,506 | 6/1985 | Hollimon | 84/454 |

FOREIGN PATENT DOCUMENTS

| | | | |
|---|---|---|---|
| 59-5926 | 1/1984 | Japan | 84/454 |

*Primary Examiner*—L. T. Hix
*Assistant Examiner*—David M. Gray
*Attorney, Agent, or Firm*—Stevens, Davis, Miller & Mosher

[57] ABSTRACT

A digital signal processing apparatus is provided for identifying the octave, note and cent of a musical sound. The apparatus includes a transducer for converting the musical sound into an electrical signal, a digital detection unit, receiving the electrical signal from the transducer, for determining the octave, note and cent of the material sound by detecting a fundamental frequency of the electrical signal; and a display unit, responsive to the detection unit, for displaying the note as an alphanumeric character and the cent as a positive or negative decimal integral number from −49 to +50 with zero cents representing perfect concert pitch.

14 Claims, 14 Drawing Sheets

PAD SCHEDULE

| PAD NO | ASSIGN | PAD NO | ASSIGN |
|---|---|---|---|
| 1 | B PLANE | 26 | B PLANE |
| 2 | J3 | 27 | B1 |
| 3 | H3 | 28 | A1 |
| 4 | G3 | 29 | F1 |
| 5 | F3 | 30 | B2 |
| 6 | L3 | 31 | A2 |
| 7 | E3 | 32 | F2 |
| 8 | PLUS(+) | 33 | G2 |
| 9 | b | 34 | LO BATT |
| 10 | READY | 35 | MWUS(-) |
| 11 | ——— | 36 | ——— |
| 12 | ——— | 37 | ——— |
| 13 | ——— | 38 | ——— |
| 14 | ——— | 39 | ——— |
| 15 | ——— | 40 | ——— |
| 16 | ——— | 41 | ——— |
| 17 | ——— | 42 | ——— |
| 18 | E2 | 43 | ——— |
| 19 | D2 | 44 | ☼ |
| 20 | C2 | 45 | C3 |
| 21 | G1 | 46 | B3 |
| 22 | E1 | 47 | D3 |
| 23 | D1 | 48 | A3 |
| 24 | C1 | 49 | H3 |
| 25 | B PLANE | 50 | B PLANE |

FIG.3D

DIGITAL AUDIO SIGNAL PROCESSOR

BACKGROUND OF THE INVENTION

1. Field of the Invention

The present invention relates to an apparatus for determining the pitch of notes and indicating a standard pitch reference in the manufacture and tuning of musical instruments and a display for indicating the accuracy relative to perfect pitch of notes generated by musical instruments.

2. Background Art

Microprocessor-based pitch analyzers and tuning aids have attempted to make the art of instrument tuning a simple endeavor, but unfortunately for various reasons have not demonstrated their usefulness to musicians as measured by the overwhelming market share currently held by analog and strobe tuners.

Generally, analog tuners contain a phase locked loop set to concert pitch of the desired note to be tuned. Upon the application of a tone or signal, an error voltage is produced by the voltage-controlled-oscillator in the phase locked loop which drives a meter movement indicating the pitch error. Strobe tuners contain a stepper motor that spins an attached marked disc at a predetermined speed, so that when a tone or signal is applied, neon lights are cycled on and off at the frequency of the applied signal. The lights visually appear to cause the markings on the spinning disc to rotate left if the applied signal is flat and to rotate right if the applied signal is sharp, or to be stationary if concert pitch is applied.

These devices have shortcomings in that the user/operator is required to have prior knowledge of the note to be tuned, with the user/operator presetting a selector switch to the desired note to be tuned. Another shortcoming of these devices is the visual presentation of the pitch error. A strobe tuner will only indicate that an applied tone or signal is either flat, sharp, or exactly concert pitch. This makes relative measurements between instruments difficult if not impossible. The analog tuner meter movement is only limited to accuracy around the midpoint of the meter movement and determining pitch error accuracy to less than four one hundredths of a semitone is impossible, thus making relative measurements between instruments very difficult. Additionally, the lack of input tone or signal filtering can render both of these devices useless when the applied tone or signal contains high amplitude odd harmonics such as those issued by a trombone which contains high third and fifth order harmonics that are higher in amplitude than that of the fundamental. The fundamental and the associated harmonics have an additive effect when developed into an electronic signal. When the odd harmonics of the applied tone or signal possess amplitudes higher than the fundamental, any tuning device without proper filtering will be deceived into perceiving that the applied tone or signal is either a third or a fifth of the applied pitch above the fundamental.

Microprocessor-based tuners have addressed some of the aforementioned issues quite successfully. U.S. Pat. No. 4,429,609 to Warrender, U.S. Pat. No. 4,523,506 to Holliman, and U.S. Pat. No. 4,434,697 to Roses describe methods for determining the octave and the note of an unknown applied tone or signal without user/operator intervention. Additionally, all three devices support some sort of input filtering, but all three of these types of microprocessor-based tuning aids suffer from a combination of flaws that can individually or collectively cause a very serious problem relating to the readability of the pitch error indication that has kept these tuners from becoming "the state-of-the-art" for instrument tuning.

A. INPUT SIGNAL DIGITALIZATION

Most digitalization techniques of the applied tone or signal use the zero-crossing method which compares an amplified substantially sine wave input signal that varies above and below a zero reference point. A voltage comparator circuit has one of its inputs connected to the varying input signal while its other input is connected directly to the zero reference point. Whenever the applied tone or signal is above the zero reference point, the voltage comparator output will be "high" or a logical "1." Whenever the applied tone or signal is below the zero reference point, the voltage comparator will be "low" or a logical "0." When a continuous substantially sine wave input is applied to the voltage comparator, a square wave output will result which is basically a digital stream of a logical "1" followed by a logical "0" continuously through time. Microprocessor tuners use these bit streams as the basis for determining the octave, the note, and the pitch error by using these pulses to control very fast digital circuits connected to a crystal time base. Extreme care in the design of this circuitry is of the utmost importance since any inaccuracies will have adverse implications in the reliability and the readability of the displayed output.

U.S. Pat. No. 4,429,609 to Warrender describes a digitalization method using the zero-crossing technique which relies on the voltage comparator to be presented a signal from an operational amplifier with extremely high gain referenced to 1.2 volts as the zero reference point at the voltage comparator. The voltage comparator circuitry contains a hysteresis feedback path from the output to the input to modify the switching points of the output of the voltage comparator with respect to the zero reference point. There are many problems associated with the method of input signal digitalization which need to be realized for proper design of circuitry interfacing to high speed digital logic capable of indicating pitch error on a digital numeric display.

Input signals applied to a tuning apparatus are relatively slow moving and of very low amplitude. Signal amplification is required before the signal can be properly presented to a voltage comparator. The amplified signal also requires a certain relationship to the zero reference point connected to the voltage comparator. U.S. Pat. No. 4,429,609 uses 1.2 volts as a zero reference point so that the input signal is centered around this voltage. The first problem occurs when the input signal to the operational amplifier is amplified with a very high gain. Operational amplifiers possess a characteristic called "input offset voltage" which appears at the output of the amplifier as a D.C. offset which is multiplied by the amplifier gain. Normal offsets are usually on the order of two to ten millivolts and vary from amplifier to amplifier. By taking the worst case scenario into account, the offset produced by the operational amplifier with a gain of 100 would yield a D.C. offset of about 1 volt at the amplifier output. To further complicate matters the input signal is centered around 1.2 volts D.C. and the offset from the amplifier equals 1 volt D.C.. Adding these D.C. voltages together yields a value of 2.2 volts D.C. at the operational amplifier output around which the varying input signal will now be centered. Although voltage comparator switching might still occur due to the large gain of the signal and the hysteresis circuitry, the voltage comparator switching point will not be optimized.

Even when the input signal is amplified, the signal still travels at a fairly slow rate. Voltage comparator circuits are very fast and require the input signal to travel quickly through the threshold region of the zero reference point where switching of the logic states takes place or the voltage comparator output will be indeterminate causing glitching of the voltage comparator output to occur. This is why a hysteresis circuit is used which modifies the zero reference point by creating a switching window for the voltage comparator output.

The correct method of implementing input signal digitalization in this device would be to implement an offset nulling circuit on the high gain operational amplifier to obtain a zero D.C. offset with resect to the 1.2 volt zero reference point and eliminate the hysteresis circuitry so that the voltage comparator can switch at the zero degree and 180 degree points where the varying amplified input signal is traveling at the fastest rate. Even with this modification, the amplified input presented to the voltage comparator would be too slow for the voltage comparator to exhibit fast enough rise and fall times of the pulses produced to control reliably digital logic circuits. This is due to the input signal step over drive above the zero reference point required by the voltage comparator for fast switching between states to occur. The longer the input signal is within the voltage comparator threshold region, the slower the rise and fall times will be at the voltage comparator output.

U.S. Pat. No. 4,523,506 also describes a method of producing a digitalized signal output from a voltage comparator to interface to high speed digital logic, but without a hysteresis circuit. The described method is without regard to the operational amplifier output D.C. offset voltage that presents the varying input signal to the voltage comparator. This method will also cause the voltage comparator to switch states at the non-ideal points away from the preferred zero degree and 180 degree points of the substantially sine wave signal as previously discussed.

One item of importance relating to voltage comparator performance is the inclusion of an input amplifier under control of an automatic gain control circuit that will stabilize the output signal amplitude. This will tend to increase the voltage comparator performance relating to the input step over drive required for more stable and faster switching to occur at the voltage comparator output minimizing errors when the digitalized pulse is presented to high speed digital circuitry. In a tuning system which requires the tuning of string instruments, the tone or signal tends to decay fairly rapidly so that if some type of automatic gain control is not employed, the input signal step over drive required by voltage comparators when referenced to the threshold region will further decrease the voltage comparator output rise and fall times resulting in poor performance.

B. INPUT SIGNAL FILTERING

A system that is intended to display pitch and pitch error with accuracy requires a method of suppressing any harmonics associated with the fundamental. The tone associated with each instrument contains harmonics of the fundamental which produce the characteristic sound of each different instrument. These harmonics, especially odd order harmonics, can produce serious errors in the displayed pitch indication unless they are eliminated.

U.S. Pat. No. 4,429,609 describes a method of filtering by which the fundamental frequency of a harmonically rich tone can be deduced from a method of correlation between fourteen successive half cycles of the digitalized input tone or signal. This method suffers from the fact that the tone or signals emitted by an instrument are continually changing in their harmonic structure. The irregular harmonics of a tone occur in string instruments very actively after the initial plucking or hammering of a string. This action is due to inaccuracies in the manufacture of the string allowing the oscillation of the string to vary in intensity at different points along the string, dynamically changing the harmonic content of the sounded tone. The period of each complete cycle of the digitalized input signal will remain somewhat constant, but the two half cycles that make up the period of the tone will vary in relation to each other, proportional to the changing harmonic structure of the tone on a cycle-to-cycle basis.

The digital correlations depend upon all of the fourteen consecutive half cycles having a time relationship between each of the half cycles. The described circuit presents a remedy via the microprocessor which chooses the filter that achieves the best results. Since this filtering arrangement is fixed, it would be impossible to eliminate totally all of the harmonics of every note within each octave. Errors would be introduced into the device and correlations between fourteen half cycles would be rare.

U.S. Pat. No. 4,434,697 and U.S. Pat. No. 4,523,506 use straightforward methods of input signal filtering that attempt to eliminate any harmonics before the input signal is applied to the voltage comparator for digitalization.

U.S. Pat. No. 4,434,697 describes a method of filtering input signals employing fixed low pass filters placed one octave apart from each other. Although this device is intended for use in determining chord triads, it is not without shortcomings. Even though the low pass filters are an octave apart, lower amplitude odd order harmonics still affect the input signal by slowing down the zero-crossing time. Fixed cascaded low pass filters can also create another error source which is related to power line interference induced into high impedance transducers such as a guitar pickup having an additive effect on a low level input signal possibly causing irregularities in the calculated period.

U S. Pat. No. 4,523,506 describes a method of filtering a gain-controlled constant amplitude input signal by presenting the signal to the input of sixteen fixed-frequency low pass filters located one half an octave apart consecutively adjacent to each other. Each filter output is connected to a threshold detector to allow selection logic to determine the relative output amplitude of each filter and close a normally open analog switch for connecting one of the filter outputs to a master bus. The master bus presents the filtered signal to a voltage comparator for digitalization.

This filtering process can be quite effective in the determination of the fundamental frequency from a harmonically rich input tone or signal, but unfortunately there are problems associated with this method of deducing the fundamental frequency. First, by the use of fixed frequency low pass filters, power line interference emitted by light dimmers or fluorescent lights can be induced into high impedance transducers producing an unwanted additive effect on low level applied tones or signals causing errors in the calculation of the period and consequently false indications on the display. Power line noise induced into a high impedance transducer can also cause false triggering of the apparatus and garbage to be displayed. Second, to support deduction of the fundamental for eight full octaves, it would be necessary to use numerous components to construct sixteen low pass filters, sixteen threshold detectors, sixteen sections of the selection logic, and sixteen analog switches rendering the device both prohibitively large and expensive.

C. SYNCHRONIZATION OF THE APPLIED INPUT SIGNAL TO DIGITAL LOGIC

The device of U.S. Pat. No. 4,523,506 also suffers from the method by which the applied tone or signal is synchronized to the crystal time base to develop a digitized value used to calculate pitch and pitch error. The digitalized voltage comparator output requires very fast rise and fall times as previously discussed for interface to high speed logic circuits. Even the fastest voltage comparator output signal will not have a timing relationship to the crystal time base unless a method of synchronization is used. This apparatus requires a flipflop so that each rising edge of the voltage comparator output causes the flipflop to output a "high" or logical "1" state to a dual input AND gate to control the output of the crystal time base presented to the digital counter.

Two problems arise from this method of input signal synchronization to the crystal time base. First, as previously mentioned, voltage comparator outputs normally have rise and fall times that can vary between eighty nanoseconds to well over one microsecond. Upon presenting the voltage comparator output to the flipflop clock input, timing errors occur at the flipflop output due to the clock input threshold specification for the flipflop to change states. The threshold limits for the flipflop to perceive a rising edge of the digitalized input lie between 0.9 volts and 1.9 volts for transistor, transistor logic (TTL) families. During the period that the flipflop clock signal is within the threshold region, the flipflop output state is indeterminate. If the rise time for the voltage comparator to switch between 0.4 (logical "0") volts to 5.0 (logical "1") volts takes 500 nanoseconds at the clock input to the flipflop, a possible error of 220 nanoseconds could result from the two flipflop clock edges required for each full cycle of the applied input signal to control or gate the crystal time-base presented to the digital counting circuitry. Second, the high or "1" state of the flipflop output denoting one complete input cycle enables the crystal time-base to be presented to the digital counter. A problem arises between the time relationship of the flipflop output and the crystal time-base. The crystal time-base output to the digital counter will always be behind in time with the relationship to the flipflop output used to enable or disable the clock from the crystal time-base to the digital counter. The possible error could be just less than two cycles of the crystal time base. Since the crystal time-base frequency is 7.4201987 megahertz, two crystal time-base clock cycles amount to 270 nanoseconds which is the possible error condition.

Both of the aforementioned errors would be accumulative over time and can vary on an input-cycle-to-input-cycle basis causing the displayed pitch error indication to vary by the accumulated error. Additionally, a crystal time-base with accuracy of exactly 7.4201987 megahertz would be prohibitively expensive or would require a great amount of time for adjustment, with costly equipment being required for this adjustment.

D. DISPLAYED NOTE AND PITCH ERROR INDICATION

Microprocessor-based tuning aids have long suffered from the method used to display pitch indication to the user/operator. The device of U.S. Pat. No. 4,434,697 can display a single note or a combination of notes in a chord triad by the use of an alphanumeric indication easily interpreted by the user/operator. The apparatus, however, is not intended for use as a pitch analyzer. Only two indications of pitch error are displayed; one being the minus sign (−) to indicate a note is flat with respect to concert pitch and the other being the plus sign (+) to indicate a note is sharp with respect to concert pitch. Relative measurements between different instruments not tuned to concert pitch would be impossible.

U.S. Pat. No. 4,429,609 and U.S. Pat. No. 4,523,506 both describe light emitting diodes (LEDs) placed relative to the note position on the musical grand staff for indication of the sounded note with the octave of the note displayed either above or below the musical grand staff. This method of notation takes into account that the user/operator of the apparatus is very experienced with the standard of written music as it is denoted on the musical grand staff. Many musicians and musical instrument repair technicians are only somewhat familiar with the method by which notes are indicated on the musical grand staff, so that they would need a great amount of time to determine the sounded note and would find this method of display difficult to use.

U.S. Pat. No. 4,429,609 describes eight LEDs used to indicate pitch error. Each LED has adjacent labeling of the value of the pitch error deviation from theoretically perfect concert pitch, but is only capable of displaying pitch error with a ten cent resolution between adjacent LEDs allowing the user/operator to tune or analyze the pitch with very limited accuracy.

U.S. Pat. No. 4,523,506 describes the use of one hundred LEDs adjacent to each other in a straight line to indicate the pitch error. Only the centered LED in the middle is labeled and indicates exact concert pitch when active. The user/operator of this device cannot easily determine the degree of the pitch error for relative measurements between instruments. This method of pitch error indication would require a front panel twenty inches high to mount all the LEDs in a straight line if standard two tenths of an inch spacing is used between adjacent LEDs making the apparatus prohibitively large.

E. THE AVERAGING TECHNIQUE

Notes sounded from musical instruments change dynamically in harmonic content as well as in pitch. When these tones or signals are developed into an electrical signal, the dynamic quality of the signal can cause the displayed indication of pitch error to fluctuate unless certain precautions are addressed. This phenomenon tends to be averaged by the human ear and becomes perceived as the intended pitch. The electronic signal developed from an input tone or signal originating from an instrument used to calculate the pitch error must attempt to emulate the human ear for the stable indication of pitch error.

The device of U.S. Pat. No. 4,429,609 accumulates all the input signal data during the entire time that the input tone or signal is active. Then the apparatus calculates and averages the correct correlations between a number of fourteen successive half cycles of the applied tone or signal and outputs the pitch and pitch error to the display. Only one output is made to the display for each input tone or signal applied to the apparatus, making the indication of the direction of the tone or signal difficult to track while the tuning mechanism of an instrument is being adjusted. In order to indicate the direction of the pitch error and to emulate the human ear, a random sampling of input cycles must be collected to maintain the past and present history of the applied tone or signal and update the display in a manner so that the user/operator is presented an indication of the applied pitch in real time.

The device of U.S. Pat. No. 4,523,506, upon detection of the applied input tone or signal, will present the digital counter with the exact number of crystal time-base clocks to accumulate the desired resolution needed to calculate accurately the period of the fundamental. At low frequencies the resolution is based on just one cycle of the applied tone or signal, while at higher frequencies more than one cycle of the applied input tone or signal is needed to acquire the resolution to calculate accurately the period of the fundamental. Once it has been determined that the resolution requirement has been met, counters that tally the pitch error are decoded and the octave and note are applied directly to the display.

The outcome of data displayed in this manner will effect the pitch error indication so that a group of some of the adjacent LEDs will be illuminated simultaneously. The reason for this is due to the varying pitch on cycle-to-cycle because any instrument is basically an unstable oscillator. Tones or signals emitted by an instrument when developed into an electronic signal are irregular with respect to the crystal time-base, thus many input cycles should be averaged to define accurately the applied pitch.

It would be desirable to be able to collect a number of cycles of the applied pitch, average the cycles over a period of time, reject the largest and smallest values, record the present and past history of the averaged cycles, and indicate pitch error as a positive or negative decimal numeric value in real time to display the direction of the pitch while the tuning mechanism of an instrument is being adjusted. An alternative method to the averaging of cycles and rejecting the largest and smallest values is to provide a way of determining the mean of a number of input cycles by the use of buffers which store the calculated periods that have a certain numeric relationship. A count of the number of cycles in each buffer could then be tallied, and the buffer with the most closely related periods would contain the mean of the applied input cycles which then could be averaged and displayed in real time. Each of the U.S. patents referred to above are incorporated herein by reference.

SUMMARY OF THE INVENTION

The present invention intends to eliminate all the problems associated with prior tuning aids or pitch analyzers in general and microprocessor tuning aids or pitch analyzers in particular as discussed above. The object of the present invention is, inter alia, to provide the user/operator with an apparatus to be used as a reference standard based on theoretically perfect concert pitch, to indicate the deviation from theoretically perfect concert pitch as a positive or negative decimal number, to indicate the direction of the applied tone or signal during the tuning of an instrument relative to theoretically perfect concert pitch, and to indicate the relative difference in pitch between instruments relative to theoretically perfect concert pitch.

Accordingly, the present invention provides an apparatus for identifying the octave, note and degree of sharpness or flatness of a musical sound. The apparatus includes a transducer means for converting the sound into an electrical signal and a filter means, responsive to the electrical signal provided by the transducer means, for sweeping a plurality of frequencies to pass a filter output signal having a frequency corresponding to a frequency of the electrical signal. The apparatus also includes a microprocessor means and a fundamental detection means, cooperating with the microprocessor means, for analzying the filter output signal to identify when the frequency of the filter output signal corresponds to the fundamental frequency of the electrical signal and for providing a fundamental detection signal indicating such correspondence. The filter means, responsive to the fundamental detection signal, is maintained at a particular scanning frequency at which the frequency of the filter output signal corresponds to the fundamental frequency. A square wave generator means, responsive to the frequency of the filter output signal corresponding to the fundamental frequency, provides a square wave output signal having a same period as the filter output signal. A logic circuit means, responsive to the square wave output signal, provides an output indicating a period of the square wave output signal. The microprocessor means comprises means for comparing the output from the logic means with a look-up table including a plurality of previously calculated periods to provide an output indicating the octave, note and degree of sharpness or flatness of the musical sound. A display means, responsive to the output of the microprocessor means, displays the octave, note and degree of sharpness or flatness of the musical sound, with the note being displayed as an alphanumeric character and the degree of sharpness or flatness being displayed as a positive or negative number on a scale including a zero value representing perfect concert pitch and a plurality of positive and negative values on each side of zero.

Also according to the invention, there is provided a digital signal processing aparatus for identifying the octave, note and cent of a musical sound, comprising a transducer means for converting the musical sound into an electrical signal, a digital detection means, receiving the electrical signal from the transducer means, for determining the octave, note and cent of the musical sound by detecting a fundamental frequency of the electrical signal, and a display means, responsive to the detection means, for displaying the note as an alphanumeric character and the cent as a positive or a negative decimal integral number from minus 49 to plus 50 with zero cents representing perfect concert pitch.

According to another aspect of the invention there is provides an apparatus for indicating the instantaneous pitch of an unknown applied acoustical tone or electronic signal relative to theoretically correct perfect concert pitch. An input means inputs acoustical sound waves via a microphone and an associated preamplifier or an electrical signal through a phone jack and an associated preamplifier. A system zero reference point is established through a constant current source connected to a precision Zener diode to provide a zero reference voltage under the conditions of a varying power source. A potentiometer is provided for the user-/operator to manually adjust the preamplifier output amplitude of the applied tone or signal to the apparatus. An amplifier amplifies both outputs of either of the input preamplifiers and the amplification is controlled by a microprocessor. Either of the output signals of the amplifiers is directed under microprocessor control to a switched capacitor bandpass filter by means of a single pole, double throw switch. A means is provided for enabling the microprocessor to read the binary logic level of a single pole switch to determine which of the two amplifiers under microprocessor control is to expect the applied tone or signal so that only one of the amplifiers will be under control of the microprocessor. The output amplitude of the amplifier under microprocessor control is converted to a binary digital value proportional to the amplitude by rectifying the output of the amplifier under microprocessor control and filtering the rectified voltage for presentation to an analog to digital conversion device. A gain adjustment means is provided for adjusting the gain of the amplifier under microprocessor control by the microprocessor writing control signals through a latch to a digitally adjustable resistor in the gain determining circuitry of the amplifier. The presence of an applied tone or signal is detected by the microprocessor reading through a buffer a predetermined digital binary value from the analog-to-digital conversion device. The amplifier under microprocessor control is adjusted to a predetermined optimal amplitude by the microprocessor reading through a buffer the present digital binary value of the analog-to-digital conversion device and adjusting the gain of the amplifier until the predetermined digital binary value as read through a buffer by the microprocessor of the output of the analog-to-digital device corresponds to the predetermined optimal value. The microprocessor reads a predetermined digital binary value through a buffer of the analog to digital conversion device to exit the operation of the apparatus when the applied tone or signal is below the required amplitude for the proper operation of the apparatus to continue. A switched capacitor bandpass filter is presented with an optimal signal amplitude to attenuate all the frequencies outside the bandpass of the filter and to provide gain to only one percent of the frequency domain located inside the bandpass of the filter on either side of the center frequency of the filter. A variable frequency oscillator output, under control of the microprocessor, is presented to the switched capacitor bandpass filter for adjustment of the filter bandpass center frequency proportional to the oscillator frequency. A table of predetermined values is provided for presentation to the variable frequency oscillator by the microprocessor through latches. The values are calculated so that each adjacent value will cause the oscillator to change frequency corresponding directly to a two-percent difference in the frequency domain in terms of the center frequency of the filter bandpass starting with the lowest center frequency of the bandpass and sweeping upward to consecutive adjacent center frequencies of the bandpass. A buffer area in RAM memory is incremented for every table value loaded into the variable frequency oscillator so that the microprocessor can cause restart of the apparatus if a fundamental has not been detected when the count in the buffer denotes that the top of the table has been reached. A means is provided for buffering the output of the switched bandpass filter. A means is provided for isolating the buffered output of the switched capacitor bandpass filter by a capacitor or other means to provide direct current isolation and alternating current coupling to the circuitry for interfacing to digital logic. An amplifier is provided for amplifying the isolated buffered output of the switched capacitor bandpass filter to make up for the atenuation in the coupling circuitry. The output amplitude of the amplifier is rectified and filtered to buffer the coupled output of the switched capacitor bandpass filter to create a direct current voltage proportional to the amplitude for presentation to an analog to digital conversion device to be read by the microprocessor through a buffer to detect the predetermined value of fundamental acquisition. An integrator integrates the isolated and coupled output signal of the switched capacitor bandpass filter to remove distortion in the form of a staircase, sinusoidal output to provide a normal sine wave output. An amplifier is provided to yield greater amplitude through signal gain to the buffered, isolated, coupled and integrated signal. The signal gain amplifier includes an output offset nulling circuit so that the output signal of the amplifier has zero output offset with respect to the system zero reference voltage to present two amplifiers, one inverting and one noninverting, a signal with zero output offset with respect to the system zero reference voltage. A circuit is provided to accomplish output offset nulling of the inverting and noninverting amplifiers to create two reference signals exactly opposite with respect to the system zero reference voltage and exactly 180 degrees out of phase for presentation to a voltage comparator. A digital square wave output generating means provides a digital square wave output from the voltage comparator, which changes state exactly at the zero and the 180 degree points of the reference signals when the signals logically intersect each other producing a digitalized representation of the period of the output of the switched capacitor bandpass filter. The square wave is presented to a Schmitt trigger logic device for the interfacing of the square wave to the 74 HC logic family. A 20 megahertz crystal oscillator with an accuracy of 100 parts per one million is provided to give timing cycles for synchronization of the square wave by clocking an eight bit serial shift register with the time base to provide control for the counting and latching digital logic. Metastability is avoided in the shift register during the synchronization process to the square wave by requiring that the first two stages of the shift register be unused. Separate counting and logic devices are divided and synchronized between each state of the digitalized pulse cycle so that counts of 100 nanosecond cycles are accumulated and latched for each half cycle. An interrupt to the microprocessor is created on the rising edge of each pulse cycle output by the Schmitt trigger logic device so that the microprocessor will read the accumulated counts stored in the latches and store the accumulated counts of the whole period in a RAM buffer area. A means is provided for enabling or disabling two modes of requesting interrupt processing by the microprocessor, one mode for reading the latches which contain the accumulated counts from the digital counting circuitry and another mode for updating the data indicated on the display. A means is provided for giving priority to the interrupt request for reading the latches containing the accumulated counts over an interrupt request to update the data on the display. A means is provided for determining that 16 valid pulse cycle periods have been collected by the microprocessor and stored in RAM memory by comparing a count that is incremented inside the interrupt subroutine to the predetermined count of 18 periods at which time the pulse cycle interrupt routine is disabled and the last 16 pulse cycle periods are added together with the synchronization average delay for 16 pulse cycles and stored in a RAM memory buffer area for presentation to the pitch table and interrupts are enabled so that more pulse cycle periods can be collected while the octave, note and cent values are determined or a display update is underway. A table is provided containing 1200 calculated periods exactly relating to the midpoint of every cent in an octave. A means is provided for calculating all the periods in a table by finding the inverse of 440.000 hertz which is 0.0022727 seconds and adjusting the period to the exact number of 100 nanosecond hexacdecimal counts that are accumulated by sixteen periods which is equal to "A8" or 22727 decimal. The number of 100 nanosecond hexadecimal counts that equals 22727 decimal counts is multiplied by the ratio of 1:1.0005778 or the ratio of one to the twelve hundredth root of two to find the periods one cent adjacent to each other until the bottom of the table is reached which is the period equal to the pitch "C8−50." Then the sixteen periods of 100 nanosecond hexadecimal counts which is equal to 22727 decimal counts is divided by the same ratio to find the periods one cent adjacent to each other until the top of the table is reached which is the period equal to "B8+50." A means is provided for calculating the final values for the lookup table by averaging each two adjacent cents in the table of the cent period boundaries to yield a table consisting of each midpoint period between each cent. An adder is provided for always adding groups of sixteen pulse cycle periods together so that when the added sum of the periods is presented to the table, sufficient resolution is obtained so that the table values will be directly equal to the highest octave supported by the apparatus which is the octave ranging between "C8−50" to "B8+50" and all pitches in lower octaves will have more than sufficient resolution. The added sum of sixteen pulse cycles periods and the associated synchronization delays is presented to determine if the added value falls inside the table limits. The added sum is divided by two and a buffer area in RAM memory relating to the octave count is decremented until the added value falls inside the table limits. A buffer area in RAM memory is incremented for each remainder from the divide-by-two process and the remainders are added to the value found to fall inside the table limits. The note value is determined from the table of 1200 consecutive values by comparing the table values starting 100 table entries apart from the bottom of the table to the input value and incrementing a buffer in RAM memory each time the table value is found to be greater than the input value until a table value is found to be less than or equal to the input value at which time the buffer area in RAM memory will contain the note value of the input value equalling a count between one and twelve. The cent value is determined by comparing table values to the input values 100 table entries below the point in the table where the note table value was found to be less than or equal to the input value and incrementing a buffer area in Ram memory each time an upper consecutive table value entry is found to be greater than the input value until a table value is found to be less than or equal to the input value at which time the buffer area in RAM memory will contain the cent value of the input value where a count of 51 will equal perfect concert pitch and all counts below 51 will be flat while all counts above 51 will be sharp with respect to perfect concert pitch. The octave, note and cent values are stored in a RAM buffer area for each acquisition until a predetermined number of acquisitions have been collected at which time the acquisitions will be correlated for accuracy so that if acquisitions without a predetermined correlation exists, an exit path is provided to abort normal processing causing a total system restart, and a flag is set in the display update routine to denote that a restart operation was caused by correlations which were outside the predefined tolerance, but if the correlations are within the predetermined tolerance, the cent values will be averaged and stored along with the octave and note values in the display buffer in RAM memory. A display buffer in RAM memory is provided so that up to six averaged cent values can be stored between display updates. A 250 millisecond timer is provided to interrupt the microprocessor for a display of update requests. Flag buffers are provided in RAM memory which denote the present condition of the apparatus. One flag is used to denote that there is presently no data in the display buffer, and another flag is used to indicate that there is not an applied tone or signal to be processed. An additional flag denotes that the correlation of at least separate acquisitions were out of tolerance and that normal processing was aborted and the apparatus restarted. A buffer area in RAM memory is provided to hold the present cent values for correlation with the latest value upon receipt of a display update request. A display update routine is initiated by the timer interrupt which first checks the operation flag conditions of the present status of the operation of the apparatus for display of any abnormal status which will override any data in the display buffer. If normal status is indicated in the flag buffers in RAM memory, the cent values are averaged and correlated with the correlation buffer holding the present cent value being displayed to determine if the latest value exceeds the present displayed value by more than plus or minus two cents, and if the latest value is over the correlation tolerance, the latest cent value is loaded into the correlation buffer and averaged with the current display update data for display. If the correlation between the latest cent value and the present cent value are within the tolerance, the cent value is stored, converted into a positive or negative decimal number, presented to a table that corresponds to the segments of the two numerical seven segment indicators, the two segments that relate to the plus or minus indication on the display and the note value is presented to a table which corresponds to the segments which relate to the alphanumeric and sharp or flat indications on the display. The display segment data is then loaded serially into the RAM in the display driver which will then activate the corresponding segments on the display and the display update routine is terminated and normal processing resumes. The buffer RAM memory stores the note value last indicated on the display. The alphanumeric portion of the display can indicate the notes "C", "Db", "D", "Eb", "E", "F", "F#", "G", "Ab", "A", "Bb", and "B" and "−" to indicate that the correlations between at least two acquisitions were out of tolerance and "::" is indicated when the microprocessor has determined that the tone or signal applied to the apparatus possesses an amplitude greater than can be properly processed and the apparatus has been restarted. The two seven segment numerical displays and a plus or minus display can indicate a positive or negative decimal number ranging from minus 49 to plus 50 with zero (without either the plus or minus indication) denoting perfect concert pitch. The display will indicate the word "READY" when the microprocessor sets the corresponding flag which is read in the display update routine when there is not a tone or signal applied to the apparatus. The octave of the applied pitch is indicated via eight light emitting diodes located in a straight line adjacent the display and labelled consecutively 1-8 from top to bottom. An active or lit LED indicates the octave of the presently displayed note and cent value unless none of the LEDs are lit indicating octave zero.

The apparatus can also include a switch which is thrown to change the mode of the fundamental acquisition from the automatic mode as described above to the manual mode for the fundamental processing of a known pitch. A momentary switch, when depressed, will cause the alphanumeric indication of the display to scroll through all twelve of the note indications and an indication for setting the octave of the selected note until the momentary switch is released causing the display to indicate the note indication present when the momentary switch was released and a buffer in RAM memory stores the note value presently displayed. In the event that the octave indication was selected, the momentary switch when depressed will cause the octave LED's to indicate in a scrolling manner the desired octave. Upon releasing the momentary switch the octave value is stored in a RAM buffer and the display will indicate both the selected note and octave. The last stored note and octave value in automatic mode processing is indicated on the display in the manual mode. A table of calculated values is provided for presentation to the variable frequency oscillator to change the center frequency of the switched capacitor bandpass filter so that this filter will only scan six percent of the frequency domain centered around the octave of the note indicated on the display starting at the lowest frequency of the octave scanning consecutively upward to higher frequencies until the fundamental is determined by the microprocessor in the above-described manner of reading through a buffer the predetermined digital binary value of the digital-to-analog conversion device which indicates the detection of the fundamental. Once the fundamental is detected, the apparatus causes normal processing to begin in the same manner as described above.

The apparatus can also include a means for determining the mean of the digital pulse cycles produced from the fundamental by creating three buffer areas in RAM memory so that after the collection of eighteen consecutive pulse cycle periods, the last sixteen pulse cycle periods are examined and placed into one of the three buffers depending on their relation to the boundaries separating the buffers which is equal to, e.g., two microseconds. The first boundary is calculated by averaging the last sixteen pulse cycle periods and the other two boundaries are placed on both sides of the first boundary. If a pulse cycle period is found not to correlate to any of the three buffers, it will be discarded. Three separate buffer areas in RAM memory corresponding to the three pulse cycle period buffers are incremented when a pulse cycle period is placed in one of each of the three buffers as well as a buffer area which is incremented for each input pulse cycle period used a threshold excess buffer. The first buffer to contain sixteen pulse cycle periods contains the mean of the input pulse cycle period which are added together with the synchronization delay and presented to the table for octave, note and cent calculation. The threshold limit is predetermined and checked each time a group of sixteen pulse periods have been collected. If the predetermined threshold limit is exceeded, the microprocessor will abort normal processing and restart the apparatus. Once the octave, note and cent values have been determined in the manner previously described, they are placed directly into the display buffer avoiding the correlation time of processing a predetermined number of separate acquisitions.

The apparatus can also include means for quickly determining the fundamental of an unknown pitch by means by the use of the above circuitry and the further inclusion of a two-to-one analog multiplexer to present to the circuitry that produce the digitalized pulse cycle to the digital logic either the output of the switched capacitor bandpass filter or the output of the input amplifier so that unfiltered pulse cycle periods can be collected and analyzed. A harmonically rich input tone or signal, when developed into a digital square wave, will produce a pulse cycle period in relation to musical pitch that is a third of the fundamental an octave and one-half above the fundamental or a fifth of the fundamental two and one quarter octaves above the fundamental. At the beginning of the fundamental acquisition process, the microprocessor will direct the output of the input amplifier through the analog multiplexer to the circuitry that produces the pulse cycle for the digital logic and sixteen pulse cycle periods will be collected and stored in the RAM memory. The sixteen pulse cycles are then averaged and the average value of the pulse cycles is used to calculate the position in the table of center frequencies that fundamental acquisition will start. The microprocessor will then direct the output of the switched capacitor bandpass filter through the analog multiplexer to the circuitry that produces the pulse cycles for the digital logic and the filter output rectifier. Since the averaged value of the unfiltered input tone or signal is known, a point in the center frequency cable can be selected as a starting point for the fundamental acquisition which will be two and one-half octaves in relation to musical pitch below the point in the center frequency table to which the averaged unfiltered input value corresponds. The switched capacitor bandpass filter will now only have to sweep upward through the consecutive center frequencies from the point two and one-half octaves below where the unfiltered tone or signal input value is calculated in the center frequency cable, thus greatly increasing the fundamental acquisition processing speed.

The invention also provides an apparatus for indicating the instantaneous pitch of an unknown applied sonance relative to theoretically perfect concert pitch. This apparatus determines the frequency of a mechanical resonance via the above-described apparatus and by a memory storing all pitches within the limits of the apparatus and the direct frequency that corresponds to each pitch. The frequency relationship to the pitch indications of the apparatus are computed by the mathmetical ratio of 1:1.0005778 starting at "A4" which is equal to 440.000 hertz. Each frequency relationship to pitch can be computed by dividing 440.000 by the ratio 1:1.0005778 until the bottom limit of the apparatus is reached at 25 hertz or multiplying 440.000 hertz by the ratio 1:1.0005778 until the top frequency of the apparatus is reached at 8000 hertz. The apparatus, when presented a sonance from the motion of a material object, will deduce the fundamental and display the pitch of the sonance. If the fundamental frequency of the sonance is required, then the list of frequencies in relation to musical pitch provides a quick method of determining the frequency from the indicated pitch value displayed on the apparatus.

BRIEF DESCRIPTION OF THE DRAWINGS

The above and other objects, advantages and features of the present invention will be more fully understood when considered in conjunction with the attached figures, of which:

FIGS. 3A-3D are a detailed representation of the preferred embodiment of the display used to indicate the pitch or note as an alphanumeric character and pitch error or cents from theoretical perfect concert pitch as a positive or negative decimal number;

DETAILED DESCRIPTION OF THE INVENTION

A. Overview

Regarding tuning systems and notations, the modern musical scale includes notes or pitches that maintain a mathematical relationship in frequency to the note "A," located in the octave of what is called middle "C," equal to exactly 440.000 hertz. By doubling this frequency to 880.000 hertz an octave would be formed relative to each other. By halving the frequency "A" 440.000 hertz to 220.000 hertz another octave would be formed. When converting these frequencies to sound simultaneously the notes would be heard to be the same but the tone of the notes would be higher or lower in pitch relative to "A" 440.000 hertz. These same sounding notes are called octaves, and exactly twelve notes or semitones are inside each octave. There are ten complete octaves in the audio spectrum of which the middle eight octaves contain most of the more frequently sounded notes. Notation of the notes inside certain octaves will be used to numerically define the octave within which the notes reside. Octaves will be given a corresponding numerical value ranging from zero to nine so that "middle C" for example will be noted as "C4" which has an exact relationship in frequency to 261.625 hertz.

As previously stated, between octaves are twelve notes called semitones. Each note in the entire musical spectrum can be mathematically calculated to provide a frequency relative to theoretically perfect pitch. Adjacent notes or semitones are separated from each other in frequency by the twelfth root of two which is equal numerically to 1.0594631. Multiplying or dividing the frequency of any note by 1.0594631 will yield the higher or lower adjacent note in frequency.

Between adjacent notes or semitones are one hundred units of pitch called cents. A mathematical relationship in frequency also exists for determining the pitch between the notes or semitones equal to the twelve hundredth root of two which is equal numerically to 1.0005778. Starting at the frequency that is directly related to any note or semitone, adjacent cents can be determined higher or lower in frequency by multiplying or dividing the frequency by 1.0005778. For example, to find the frequency of the pitch which is one cent sharp of "A4" multiplying 440.000 by 1.005778 yields the frequency of pitch which is notated "A4+1". Likewise, dividing "A4" 440.000 by 1.0005778 yields the pitch in frequency of "A4−1". Multiplying or dividing each adjacent cent in frequency equals the next adjacent cent in frequency. If these calculations are performed 1200 times a value with a direct relationship to frequency can be found for every cent inside an entire octave.

Figure 1A:
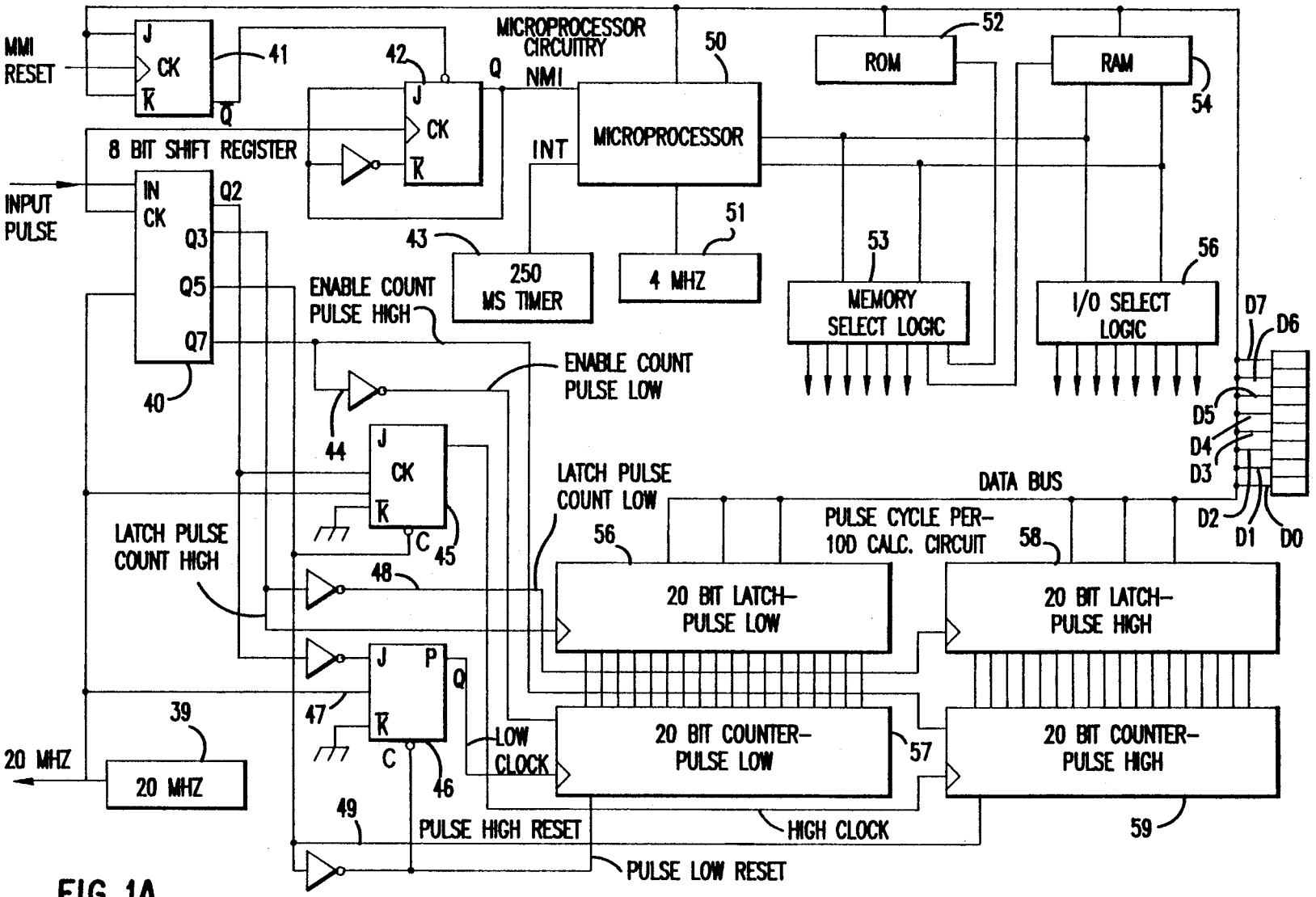
FIGS. 1A-1C represent a simplified block diagram of the preferred embodiment of the hardware required in accordance with the present invention.
Figure 1B:
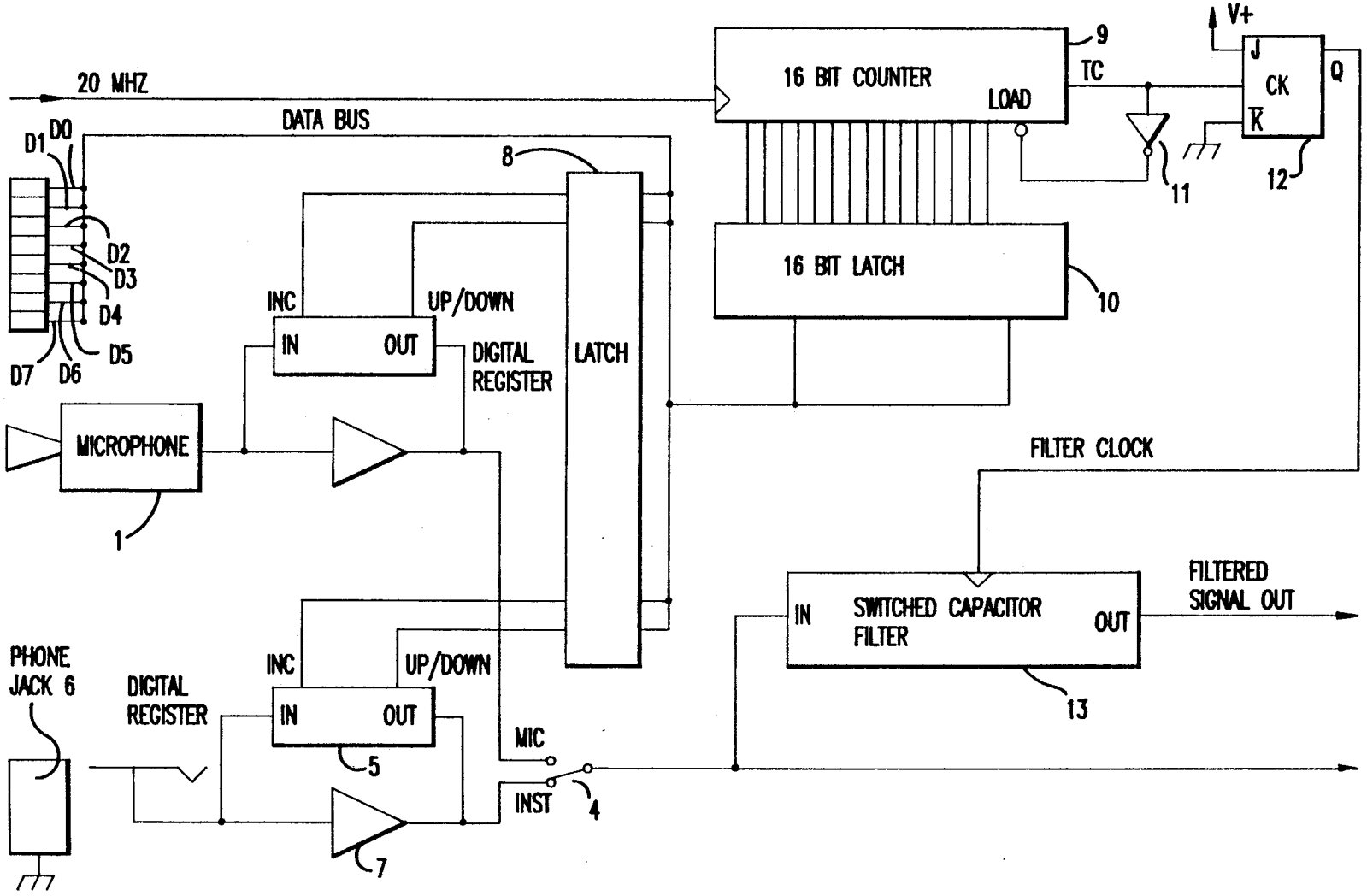
Figure 1C:
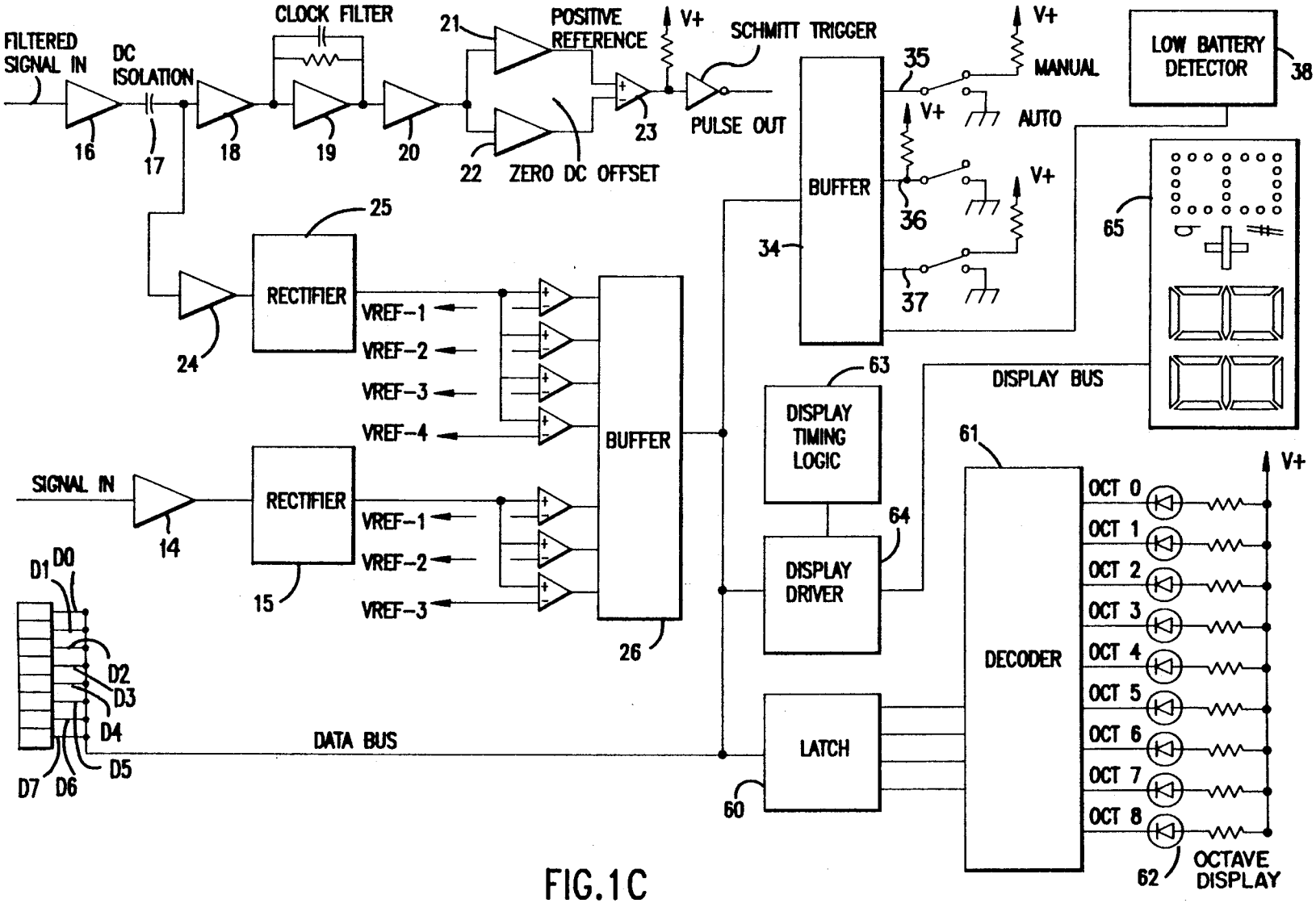
Figure 2A:
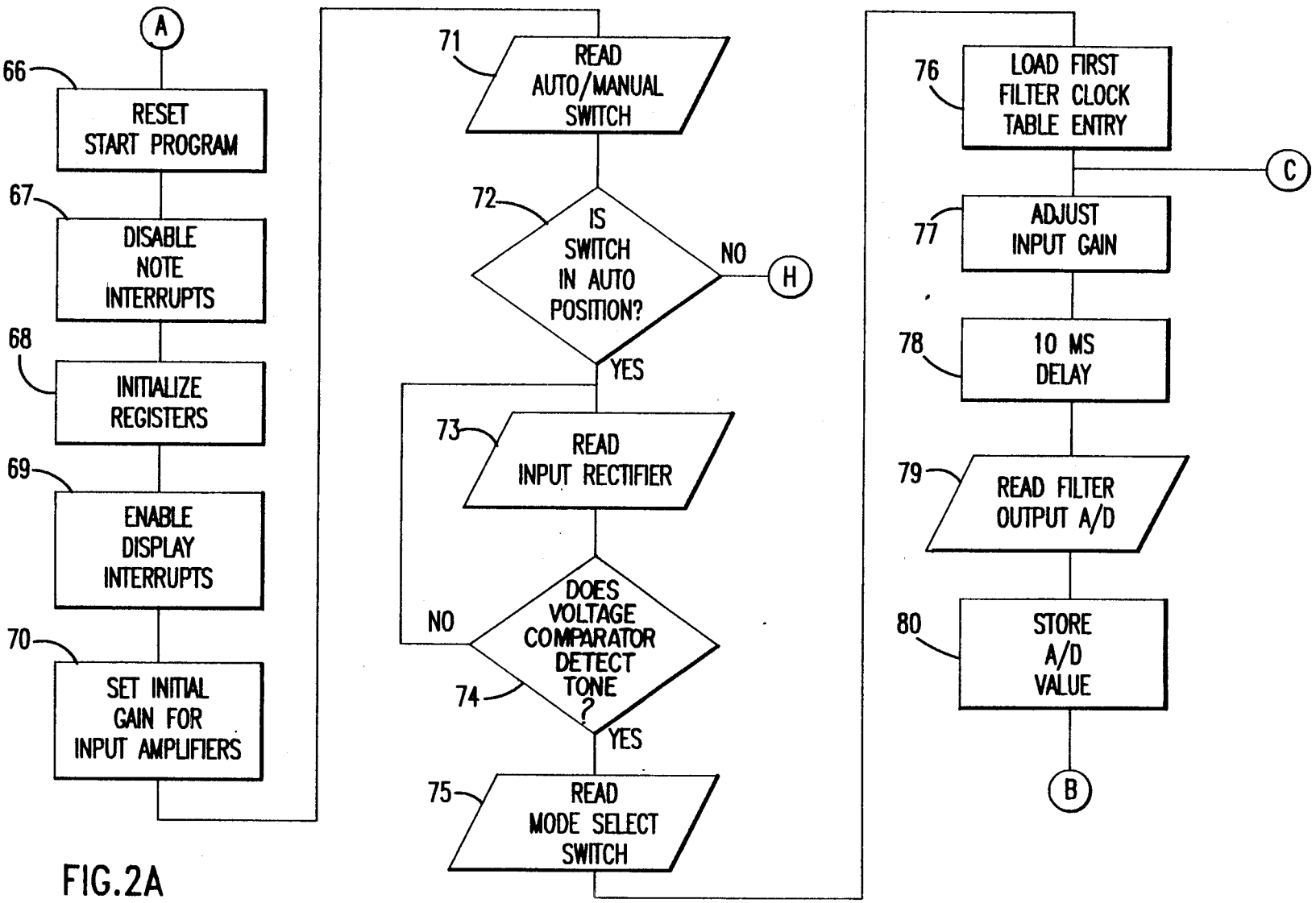
FIGS. 2A-2G represent a simplified flowchart of the preferred embodiment of the software operation of the present invention.
Figure 2B:
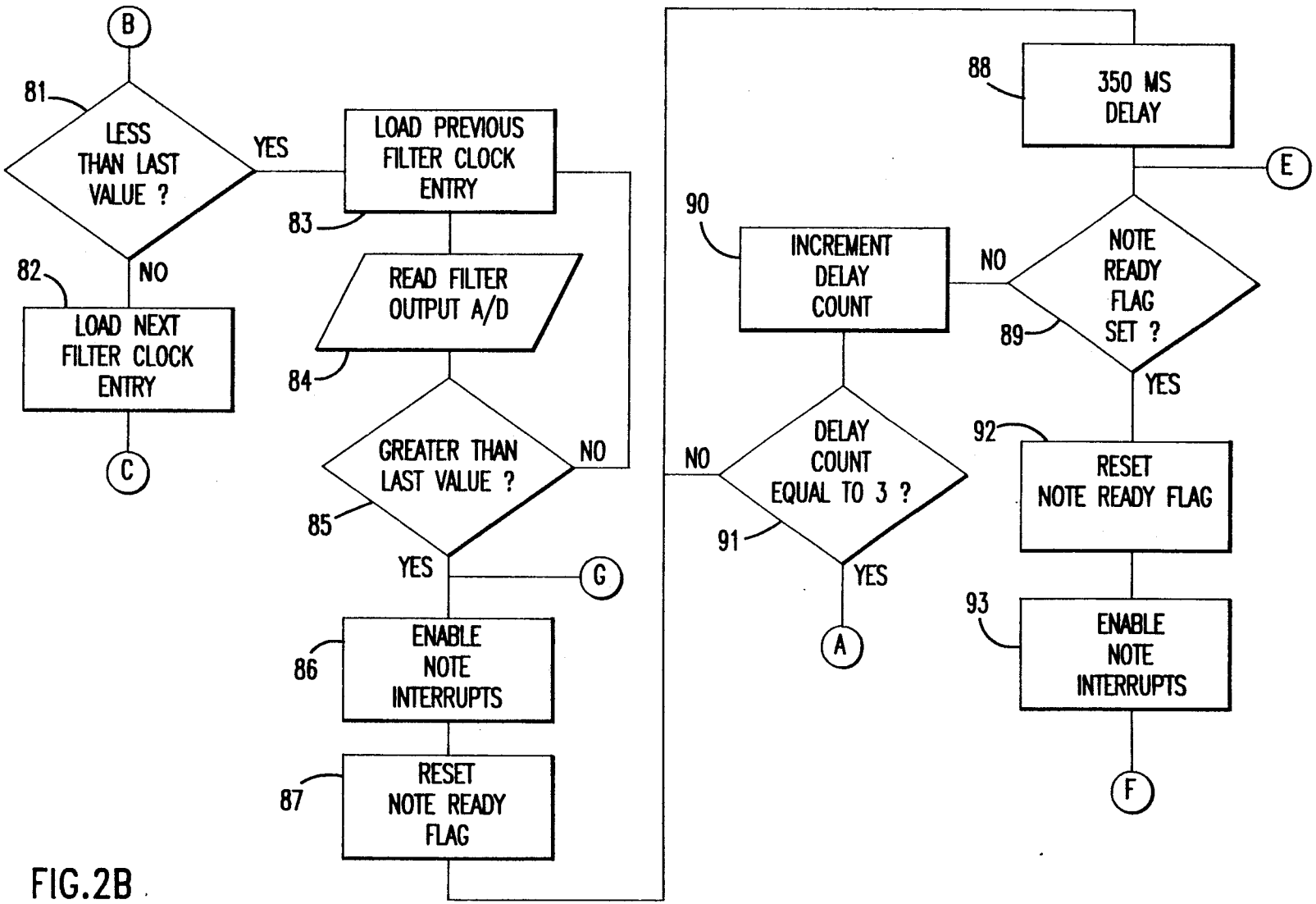
Figure 2C:
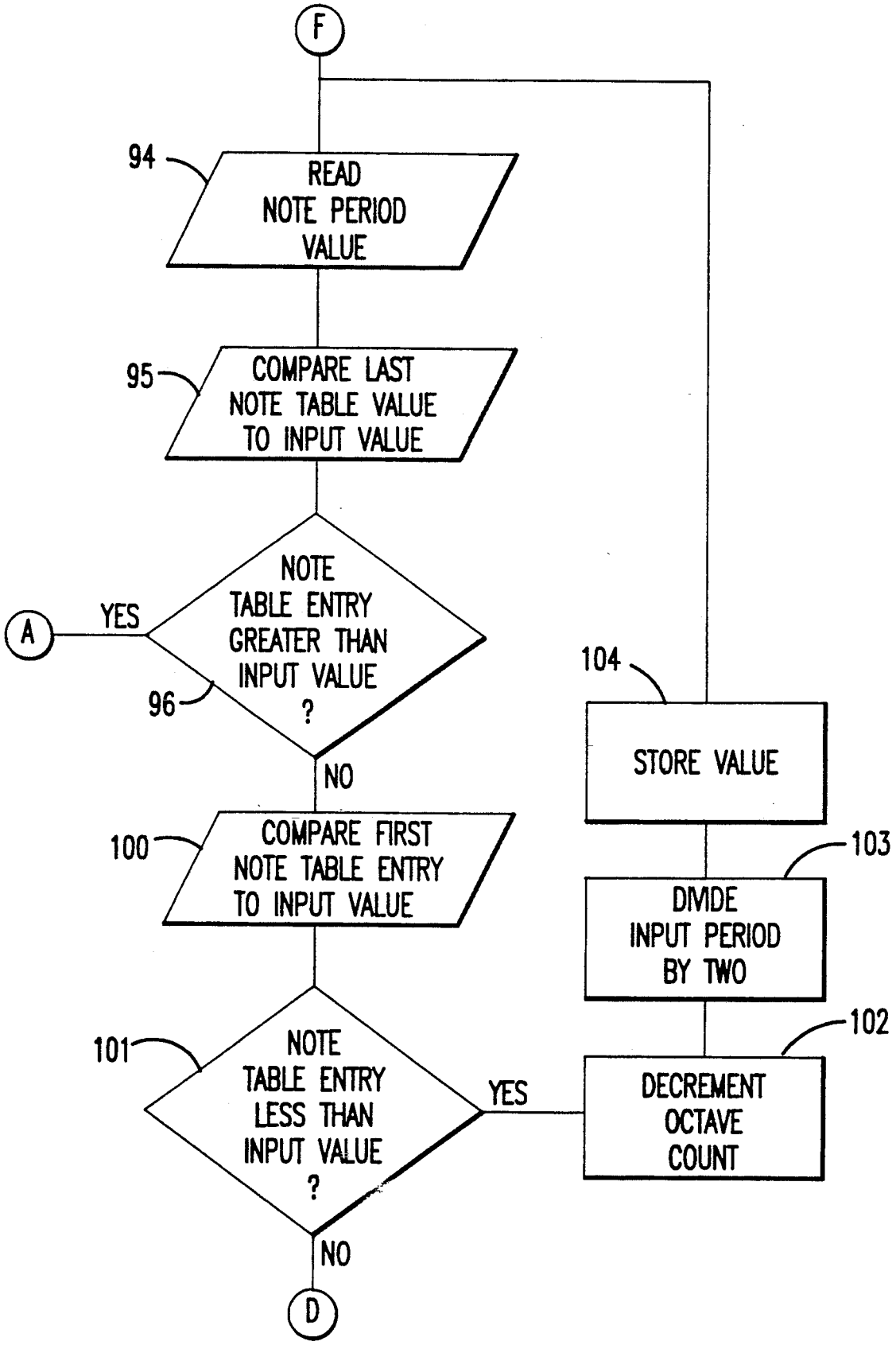
Figure 2D:
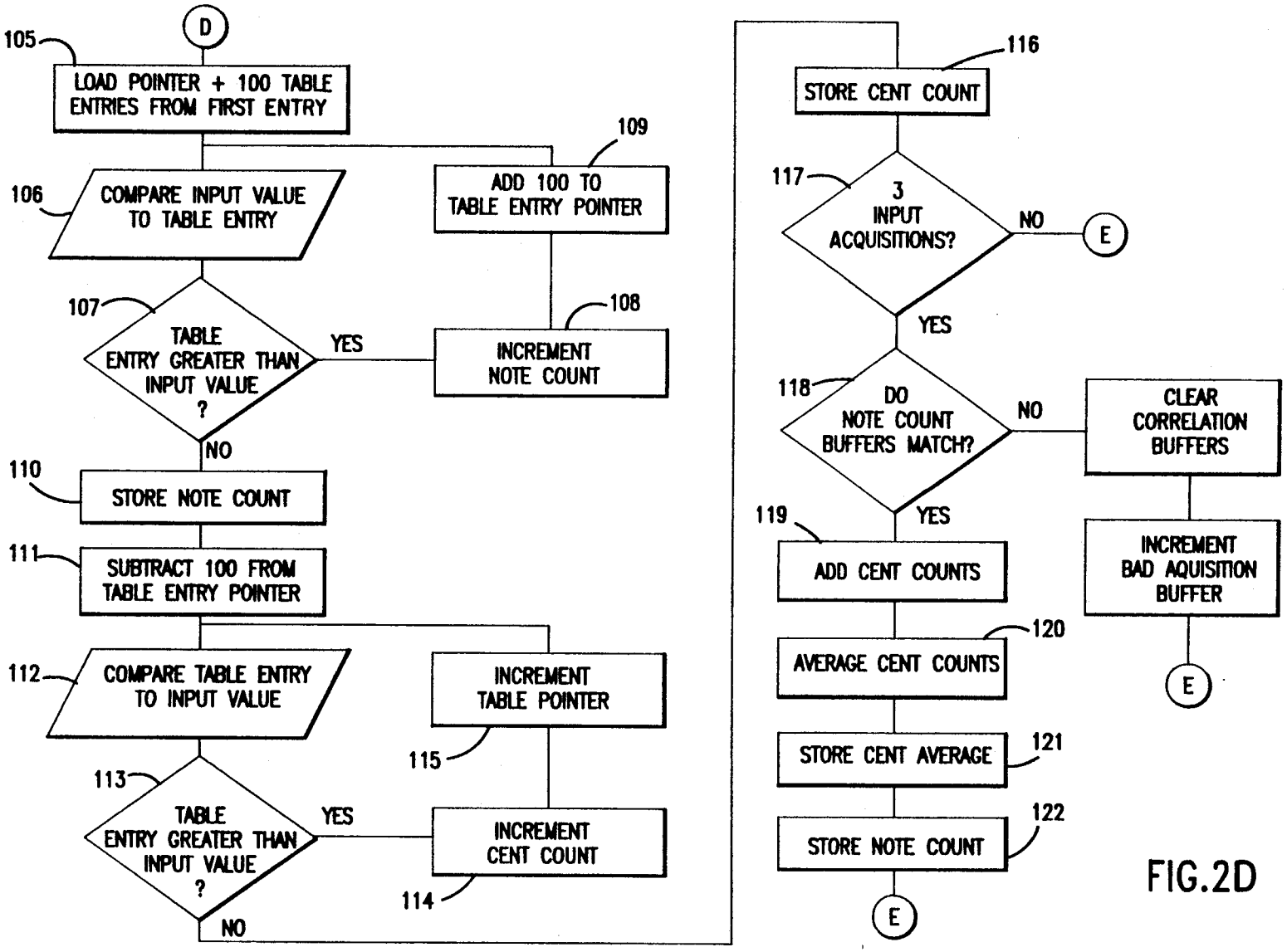
Figure 2E:
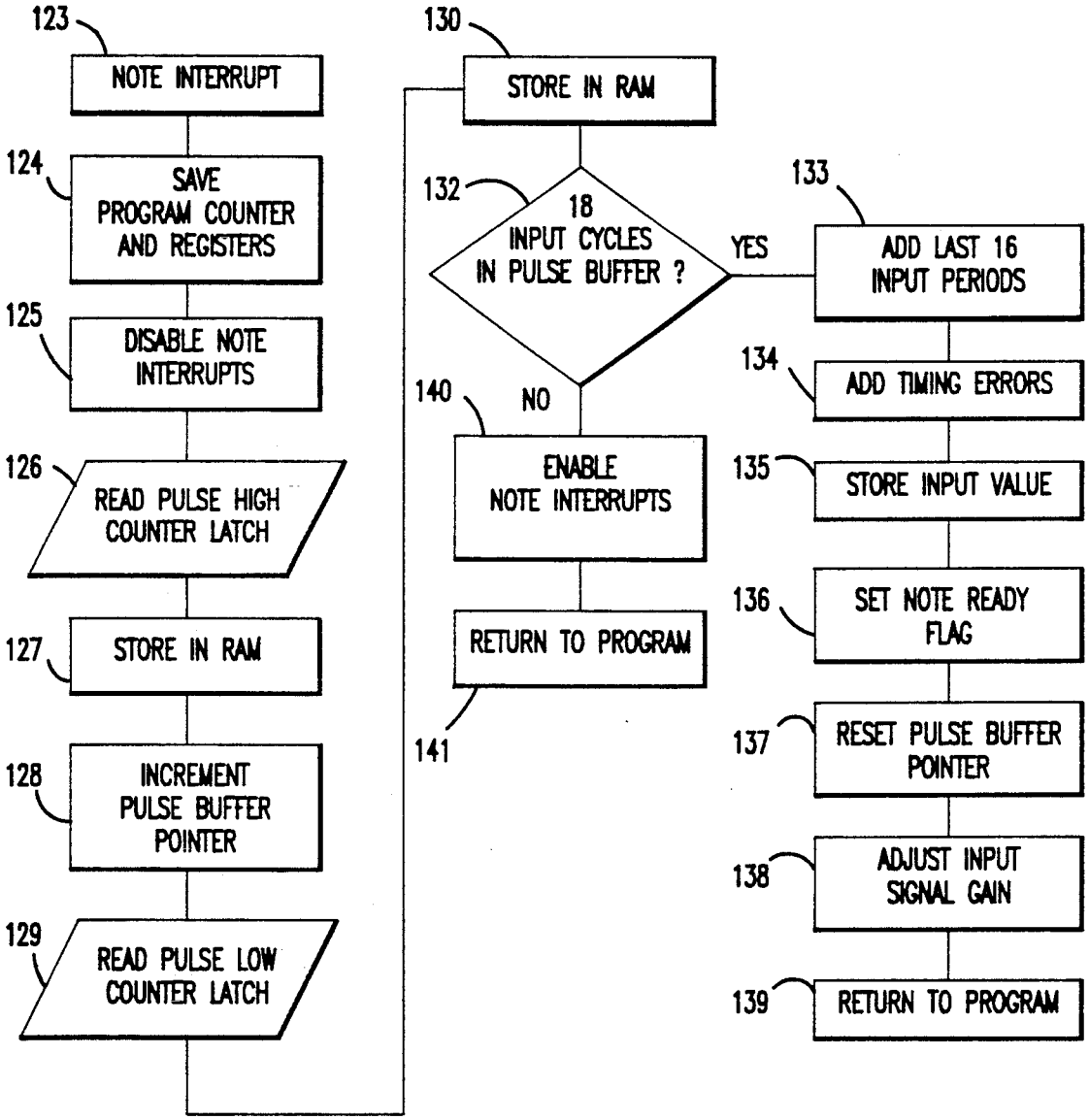
Figure 2F:
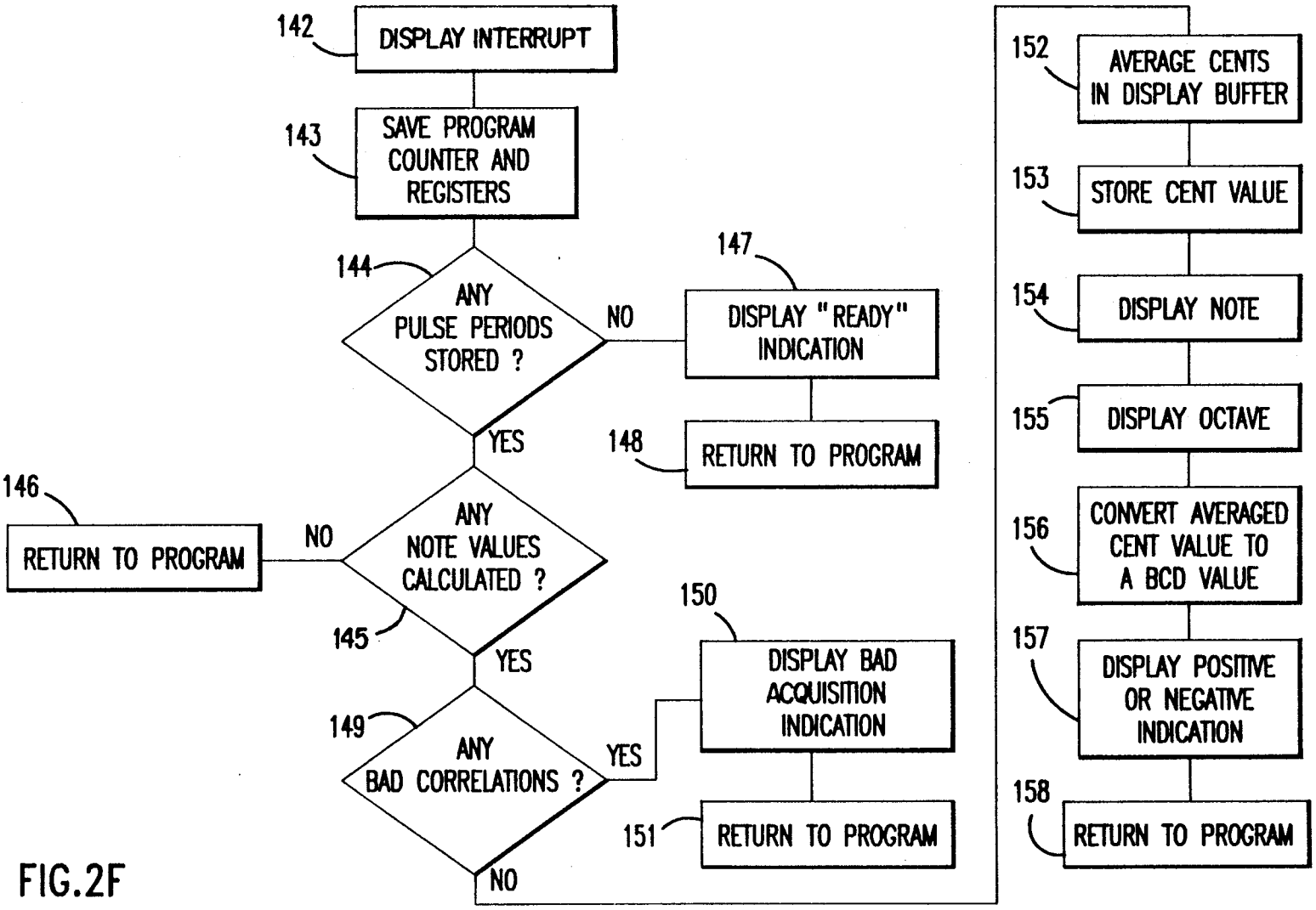
Figure 2G:
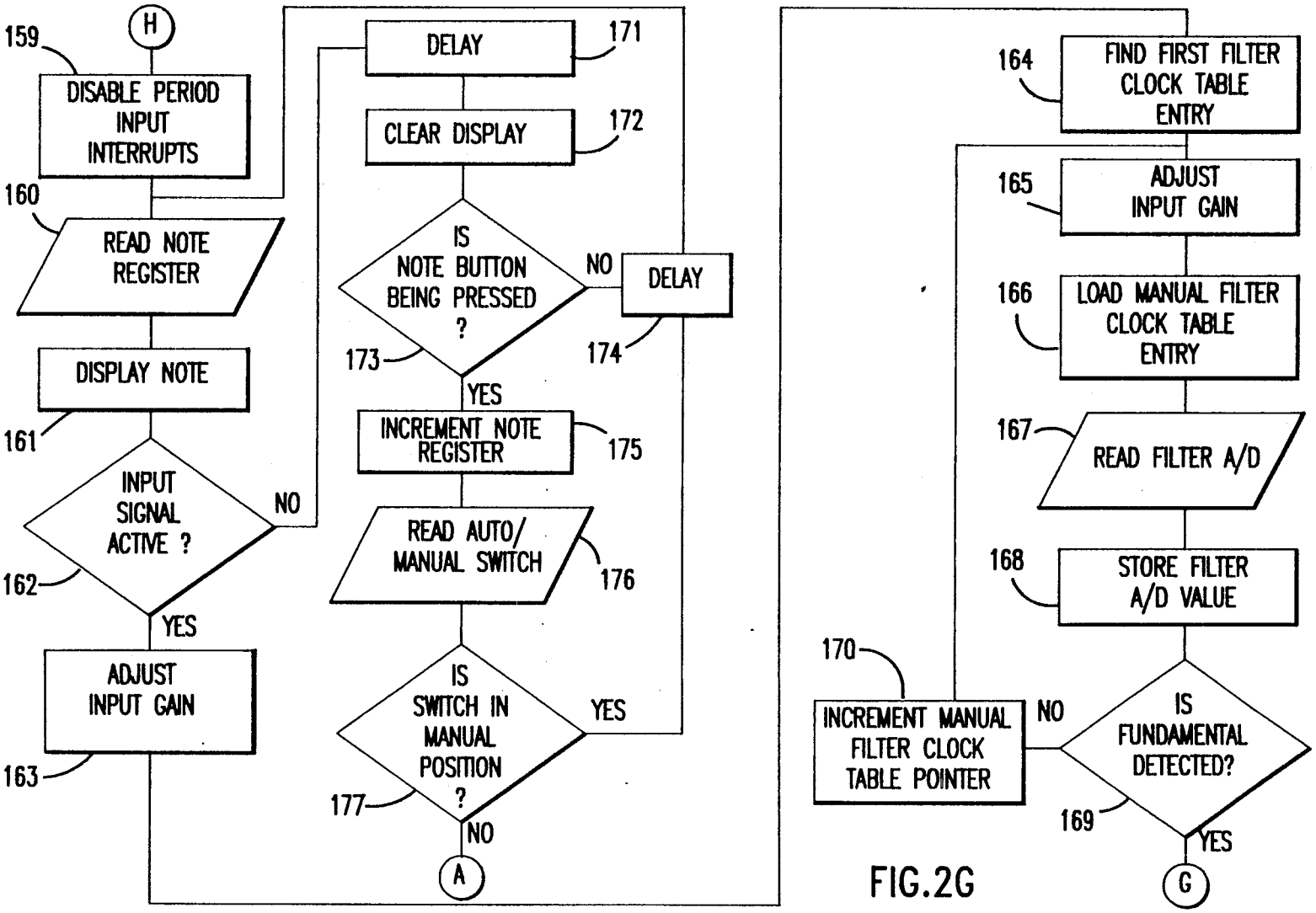
Figure 3A:
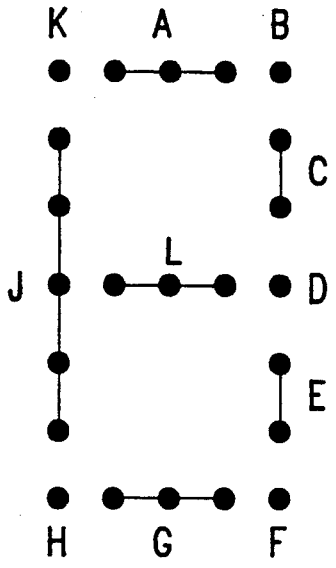
Figure 3B:
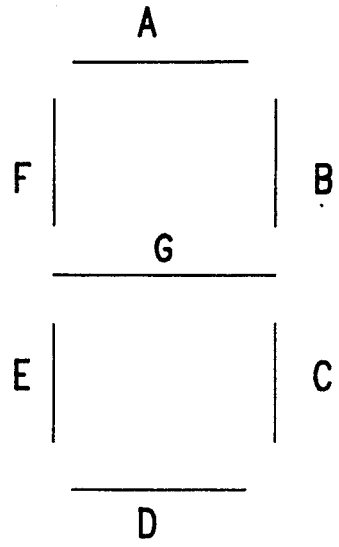
Figure 3C:
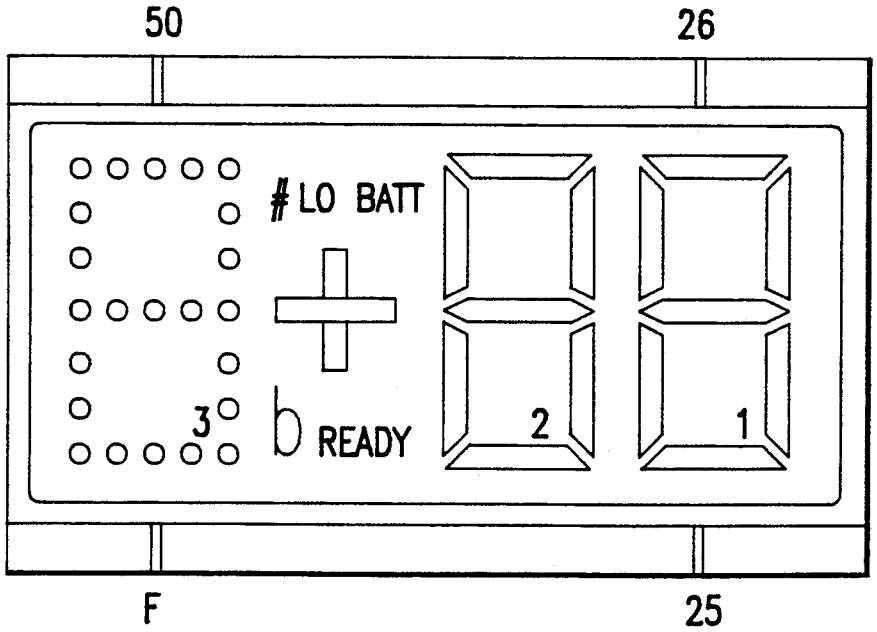
Figure 4:
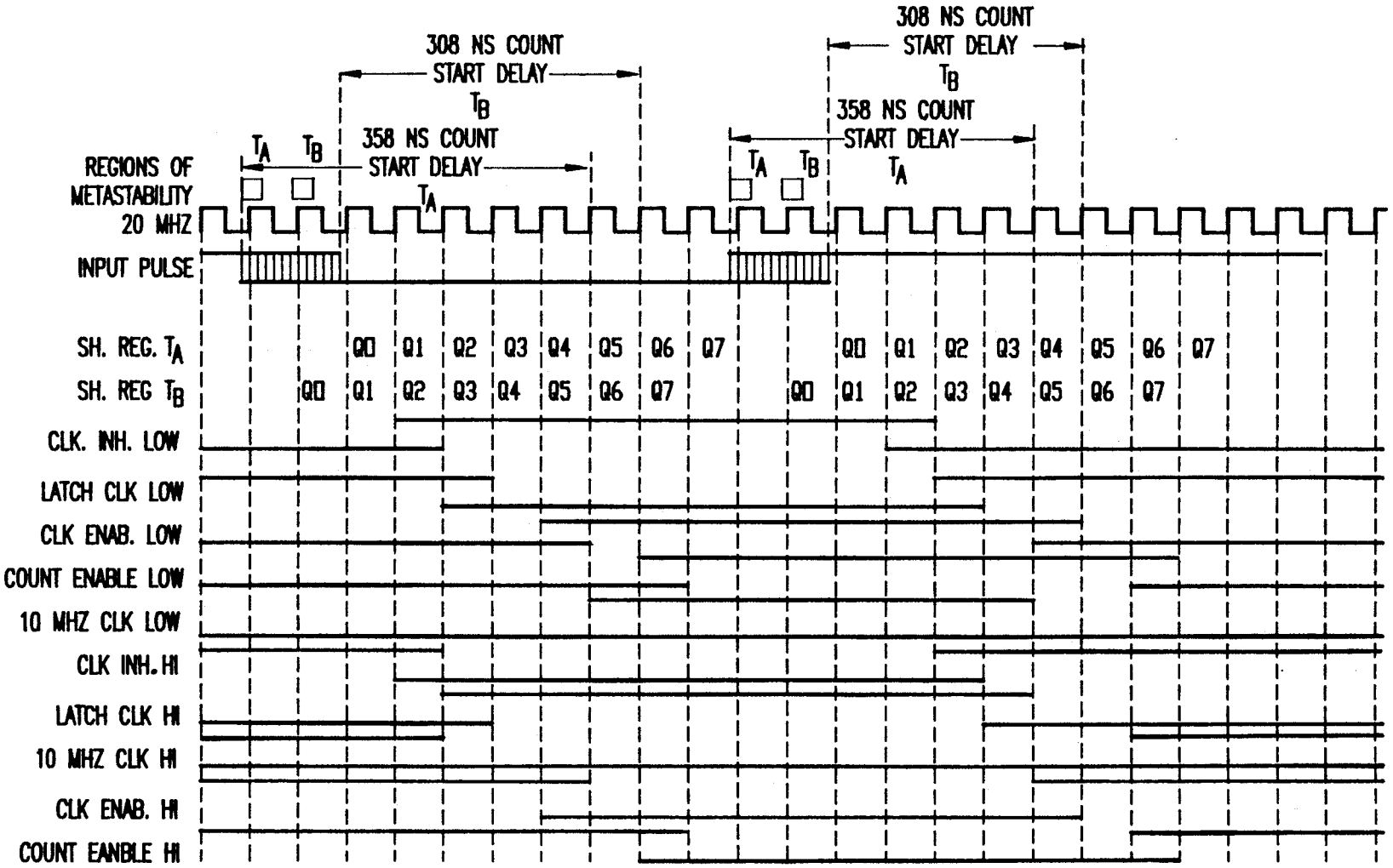
FIG. 4 is a timing diagram of the synchronization errors involved in synchronizing the input pulse cycle to the digital logic.

FIGS. 1A-1C represent a simplified block diagram of the preferred embodiment of the present pitch analyzer/tuning aid apparatus. Upon depressing the power on/off switch, microprocessor 50 will set the gain of the "microphone input" operational amplifier 2 and "phone jack input" operational amplifier 7 through control by the "microprocessor controlled" digital resistors 3,5 (EEPOTS by Xicor, Inc.) from "microprocessor write" latch output 8 to the minimum gain. The outputs from the "microphone input" operational amplifiers 2 and the "phone jack" operational amplifier 7 are directed to the switched capacitor bandpass filter 13 and the "input rectifier" buffer 14 by a switch mechanism 4 internal to the phone jack 6. Also included internal to the phone jack 6 is another switch mechanism 37 that applies a logic level to "microprocessor controlled" digital resistors 3,5. Logic selection control 37 is initiated by inserting or by the absence of a ¼" phone plug in phone jack 6. If the ¼" phone plug is installed in phone jack 6, the "phone jack" operational amplifier 7 output is directed to the switched capacitor bandpass filter 13 and "input rectifier" operational amplifier 14. If the ¼" phone plug is not installed into phone jack 6, the "microphone input" operational amplifier 2 output is directed to the switched capacitor bandpass filter 13 and the "input rectifier" operational amplifier 14.

Upon the application of a tone or signal to the apparatus, the signal is directed through the "input rectifier" operational amplifier 14 to the "input" rectifier 15 where the signal is converted to a D.C. voltage level proportional to the amplitude of the input signal and detected by voltage comparator 27. Any input level higher in amplitude than loud room noise will cause voltage comparator 27 to change to the active state. Microprocessor 50 will read this condition through "microprocessor read" buffer 26 and processing of the input will begin.

The present apparatus supports two different modes of input processing, the automatic mode and the manual mode. The mode of input processing is initiated by the microprocessor reading the logic state of switch 35 through "microprocessor read" buffer 34. Both modes of input processing are intended to be used either together or separately to hasten the process of tuning complex instruments, while the ability to use each mode separately to optimize different pitch analyzing/tuning applications is maintained.

Automatic processing begins upon detection of an applied tone or signal to the apparatus by the microprocessor reading the active state of voltage comparator 27 through "microprocessor read" buffer 26 and the correct logic level of switch 35 through "microprocessor read" buffer 34. The detection of an applied tone or signal causes microprocessor 50 to start issuing control signals through "microprocessor write" latch 8 to digital resistor 3 or 5 of the previously chosen "input" operational amplifier 2 or 7 output to control the input signal gain to switched capacitor bandpass filter 13 until the optimum signal amplitude is obtained. The optimum signal amplitude has been predetermined. "Input signal" rectifier 15 outputs a D.C. voltage that is sensed by voltage comparators 28,29 which is read by microprocessor 50 through "microprocessor read" buffer 26. If the outputs of voltage comparators 28,29 were both active, microprocessor 50 would reduce the gain of "input" operational amplifier 2 or 7 through "microprocessor write" latch 8 to control digital resistor 3 or 5 to reduce the resistance in the feedback loop of "input" operational amplifier 2 or 7 decreasing the signal amplitude presented to switched capacitor filter 13. Ideally, microprocessor 50 should read voltage comparator 28 in the active state and voltage comparator 29 in the inactive state indicating the proper amplitude is currently being presented to switched capacitor filter 13. The output of "input" operational amplifier 2 or 7 needs to be continually monitored by microprocessor 50 to keep the amplitude of the signal presented to switched capacitor bandpass filter 13 stable for proper detection of the fundamental. Switched capacitor bandpass filter 13 will then scan all the frequencies in consecutive order from the lowest frequency ("A0") upward until switched capacitor bandpass filter 13 reaches a frequency equal to that of the applied signal so that filter 13 outputs a signal amplitude that when presented to "filter output" rectifier 25, converted to a D.C. voltage and presented to voltage comparators 30,31,32,33 is read by microprocessor 50 as the detection of the fundamental.

There are two main differences between the automatic and the manual modes. In the automatic mode, switched capacitor bandpass filter 13 upon detection of an input tone or signal will sweep through all the consecutive frequencies within the limits of the apparatus. The theory of the detection of the fundamental is when frequency sweeping starts at the lowest possible frequency ("A0") and sweeps upward, the first noticeable signal level detected by voltage comparators 30,31,32,33 will be the fundamental. The present invention ensures fundamental detection because the predetermined gain and width of the switched capacitor filter bandpass is designed for optimal relationships with the reference voltages presented to voltage comparators 30,31,32,33.

The manual mode is initiated by placing auto/manual switch 35 in the manual position. In this mode, switched capacitor bandpass filter 13 can be preset by depressing a momentary switch 36 which will cause the note indication on display 65 to scroll through all twelve notes. When the intended note to be analyzed or tuned is presented on display 65, the operator/user then releases momentary switch 36 and the selected note remains indicated on display 65. When processing begins upon the application of a tone or signal to the apparatus, switched capacitor bandpass filter 13 will only be sensitive to the fundamental of the note selected on display 65.

The manual mode of operation is particularly useful for analyzing pitch or tuning instruments with a limited tuning range such as the brass and woodwind families. When analyzing or tuning complex string instruments and the latest electronic keyboard instruments, the automatic and manual modes can be used in conjunction with each other. First, the automatic mode is used to find the fundamental of an unknown applied input tone or signal and then by placing auto/manual switch 35 in the manual position, the last detected fundamental from the automatic mode will be indicated on display 65. The manual mode provides a method for processing of the fundamental in a more expeditious manner because switched capacitor bandpass filter 13 will only scan the frequencies around the octave of the known applied input tone or signal. The frequencies scanned in the manual mode always start with the lowest frequency of the selected note in the octave and scan upward from the lowest to higher frequencies in a similar manner to that used in the automatic mode. The manual mode is also particularly useful for analyzing or tuning notes that possess very fast attack and decay rates such as the uppermost octaves of most string instruments.

Once the fundamental has been determined the apparatus functions basically the same in both modes of operation. The fundamental is formed into a square wave by presenting the output of the switched capacitor bandpass filter 13 to circuitry designed to provide an interface between the period of the fundamental and the digital logic.

When the amplitude of the applied tone or signal decreases, the D.C. offset of switched capacitor bandpass filter 13 varies in relation to the D.C. offset when switched capacitor bandpass filter 13 input was within the optimum signal amplitude range. To eliminate the varying D.C. offset the switched capacitor bandpass filter must be A.C. coupled to provide D.C. isolation. Switched capacitor bandpass filter 13 output is buffered by operational amplifier 16 to drive a capacitor 17 which provides A.C. coupling and D.C. isolation from the interface circuitry to the digital logic. The A.C. coupled output from capacitor 17 is presented to both the "filter output rectifier" buffer operational amplifier 24 and "integrator buffer" operational amplifier 18. Integrator 19 circuitry removes clock noise from the signal outputted by switched capacitor bandpass filter 13. The clock noise is generated by "microprocessor controlled" oscillator 9, 10, 11, 12. The output frequency of this oscillator is used to control the bandpass center frequency by using the fifty percent duty cycle square wave as the clock input of switched capacitor bandpass filter 13 where the noise is produced internal to switched capacitor bandpass filter 13 and causes the bandpass output to be a staircase sinusoidal waveform. "Filter output" rectifier 25 provides a D.C. output voltage proportional to the amplitude of the output of switched capacitor bandpass filter 13 which is presented to voltage comparators 30, 31, 32, 33. This proportional D.C. voltage is measured against the reference voltages connected to each of voltage comparators 30, 31, 32,33 which provides a means of detecting the fundamental frequency when read by the microprocessor through "microprocessor read" buffer 26.

The output of integrator 19 is applied to operational amplifier 20 which provides gain to the input tone or signal fundamental after integration. This operational amplifier 20 requires an offset nulling circuit to maintain zero D.C. offset with respect to the apparatus zero reference point. The output of operational amplifier 20 is presented to the inputs of two operational amplifiers 21, 22. One of the operational amplifiers is configured as a noninverting amplifier known as the "positive reference" operational amplifier 21, while the other operational amplifier is configured as an inverting amplifier known as the "negative reference" operational amplifier 22. Both amplifiers 21,22 also require an offset nulling circuit to maintain zero D.C. offset with respect to the zero reference point of the apparatus for presentation to the "pulse output" voltage comparator 23. The "negative reference" operational amplifier 22 is connected to the negative input of the "pulse output" voltage comparator 23 and the "positive reference" operational amplifier 21 is connected to the positive input of the "pulse output" voltage comparator 23. Since the output of both "reference" operational amplifiers 21, 22 are exactly opposite and 180 degrees out of phase with each other, "pulse output" voltage comparator 23 will change states whenever the two out of phase signals logically intersect each other. This will happen at the zero degree and 180 degree points when the signals are changing at their fastest rate due to the zero D.C. offset nulled in all of operational amplifiers 20,21,22. This minimizes the time that the signals presented to "pulse output" voltage comparator 23 are inside the threshold region of the comparator. Another advantage of this method is the increase in the response time of "pulse output" voltage comparator 23 when converting an input tone or signal into a very accurate digital pulse cycle representation of periods of the fundamental. The operation of this circuitry is almost transparent to the low signal-to-noise ratio of a decaying, weak input applied to the apparatus allowing enough resolution of the digital pulse to measure the fundamental to an accuracy of one half of one cent.

Synchronization of the pulse to digital counting logic 39,40,44,45,46,47,48,49,56,57,58,59 is accomplished by applying the output of "pulse output" voltage comparator 23 to a Schmitt trigger logic device to obtain compatibility in the pulse rise and fall times between "pulse output" voltage comparator 23 output and the digital synchronization and counting logic. This will basically take "pulse output" voltage comparator 23 output rise and fall times of 200 nanoseconds and convert the signal to a pulse with rise and fall times less than 20 nanoseconds. The crystal time base 39 operates at 20 megahertz with an accuracy of 100 parts per one million. The cycle time of the crystal time base is 50 nanoseconds allowing for enough resolution to guarantee the synchronous timing requirements of the digital counting 57,59 and latching 56,58 logic.

Microprocessor 50 reads the calculated period from "microprocessor read" latches 56,588 when an interrupt service request is issued from flipflop 42 on the rising edge of the next asynchronous input pulse. The results are stored in RAM memory 54 until eighteen consecutive complete cycles have been collected. The last sixteen cycles are then added together and compared against a table of 1200 calculated values. Each value in the table corresponds to the midpoint of all the cents in the octave starting at "C8−50" and ending at "B8+50." The table is constructed so that all the pitches that fall below "B8+50" cause a divide by two to occur until the input value falls inside the table limits. All the remainders of the divide by two process are tabulated and the octave value stored in ram memory 54 before determining the note and cent values from the table. After a predetermined number of acquisitions the note and cent values are compared for accuracy providing the ability to detect pitch values without correlation between them. If pitch values do not have a certain correlation between them, the operation of the apparatus is restarted from the beginning providing an exit path from the main process and avoiding the display of meaningless data. If a relatively close correlation exists between the predetermined number of acquisitions, the cent values are averaged and placed along with the octave value and the note value into a display buffer in ram memory 54. Upon the receipt of a display update request from a 250 millisecond timer 43 to the microprocessor 50 the cent values, if more than one exists, are averaged and converted into a positive or negative decimal value. The note value and the cent value are then presented to the display driver 64 and the octave value latched in the "octave display driver" 60. The pitch is then indicated on both displays 62,65.

An alternative method of determining the pitch of an applied input tone or signal to the apparatus is to find the mean of the period of the fundamental. This is done by placing periods with close correlations into a set of different buffers in RAM memory 54.

The pulse cycle periods are collected consecutively until eighteen pulse cycle periods have been stored in a buffer in RAM memory at which time the last sixteen pulse cycle periods are averaged to establish the first boundary which is two microseconds wide. Two 2-microsecond buffers are then established on either side of the first boundary. The pulse cycle periods are then examined and stored inside the buffer in RAM memory that corresponds to the period of the pulse cycle. If a pulse cycle period does not fall inside any of the established buffer boundaries, then that pulse cycle period is discarded. A count of the number of pulse cycle periods is maintained for each buffer until one of the buffers contains sixteen pulse cycle periods. A total count of all the pulse cycles collected is tallied until a certain number of input periods have been detected. At the end of this predetermined number of input cycles and none of the buffers contains sixteen pulse cycle periods, the threshold count has been exceeded and the apparatus will be restarted to provide an exit path from gathering useless input.

The buffer with sixteen correlations will contain the mean of the input periods. The data in this buffer is added and compared against the table of 1200 calculated values. Once the octave, note and cent values are found, they are place directly in the display buffer and displayed in the manner previously defined.

B. Description of Preferred Embodiments

INITIALIZATION

Referring to FIGS. 1A-1C and FIGS. 2A-2G, the initialization process begins when power is applied to the apparatus by depressing the ON/OFF switch which causes a 100 millisecond active low pulse to be presented to the microprocessor 50 reset input from the power on reset circuitry. Once the reset pulse issued to the microprocessor 50 becomes inactive or returns to the "high" state, microprocessor 50 will begin to execute operation codes by accessing ROM 52 at physical address 0000H as selected by address decoder 53. The instructions are read by the microprocessor 50 in the form of hexadecimal bytes programmed into ROM 52 that reside in the physical addresses between 0000H and 17FFH which cause microprocessor 50 to perform the desired actions for the successful operation of the apparatus.

The initialization of the apparatus begins by disabling the "input interrupts" 67 by microprocessor 50 writing a "1" to the "high priority enable/disable" flipflop 41 which holds the output of the "high priority interrupt" flipflop 42 in the inactive state so that no input interrupts can be serviced. The "low priority interrupt" or the display update interrupt is automatically disabled when the power on reset pulse is applied to the microprocessor 50 reset input and can be enabled or disabled at any time by either of two instructions read by microprocessor 50 from ROM 52. Both interrupt exception subroutines are initialized so that the "low priority interrupt" or the display update interrupt service starts at physical address 0038H and the "high priority interrupt" or the input interrupt service starts at 0066H. RAM 54 which lies in the physical address space between 2000H and 27FFH is selected by decoder 53 The stack pointer is used for storing the microprocessor 50 internal registers when the external interrupts request service. The locations in the RAM 54 that reside between 27F0H and 27FFH are reserved for flag registers for indicating the status of the apparatus at different points in the operation of the program stored in ROM 52.

Once the stack pointer has been initialized all the apparatus status registers located in RAM 54 are written with default values by microprocessor 50 that indicate the apparatus initialization is in progress and is preparing to accept input 68. Some of these registers function as status indicators of the fundamental acquisition process while other status registers indicate intermediate values and status information for both the automatic and manual modes of operation for processing data when determining pitch values and display output. After all the register default values have been initialized by microprocessor 50, microprocessor 50 will enable the display interrupts so that the display will indicate the apparatus is ready to accept input 69. The microprocessor 50 also has control over output devices that control the operation of the apparatus which must be written default values. Microprocessor driven components comprise the "microprocessor write" latch 8 that controls the digital resistors 3,5, the "microprocessor write" latch 10 which holds the count for the digitally controlled variable oscillator 9,10,11,12, the "microprocessor controlled" flipflop 41 which controls whether the "high priority" input interrupts are enabled or disabled, the "microprocessor write" latch 60 which controls which of the octave display LEDs will be active, and the display driver 64, which must all have default values written into them by microprocessor 50 before the initialization is completed.

The last part of the initialization phase involves setting up the apparatus to accept input and determining the mode of operation. The digital resistors 3,5 may be set in any random manner at power up. The digital resistors 3,5 must be decremented 100 steps each so that both of the digital resistors 3,5 are at step zero. Each of the digital resistors 3,5 have 99 steps or increments inside the total resistance of the device which makes each step worth 1/99 of the total resistance value of the device. The digital resistors 3,5 can be incremented 99 times or decremented 99 times but will never exceed the top or bottom limits of the device even though it may be instructed to do so. At the initialization of the digital resistors 3,5, decrementing each device 100 times will ensure that both of the devices are at the same step value which is equal to zero steps. Once the digital resistors 3,5 are known to be at step zero, each of the digital resistors 3,5 are incremented a certain number of steps required by each of the "microphone input" operational amplifier 2 and the "instrument input" operational amplifier 7 for the predetermined gain required to detect an input tone or signal 70. The number of steps that each of the digital resistors 3,5 are incremented is kept track of in two buffers; POTCNT1 for the digital resistor 3 that determines the gain of the "microphone input" operational amplifier 2 and POTCNT2 for the digital resistor 5 that determines the gain of the "instrument input" operational amplifier 7. Now that the apparatus is set for input detection of the applied tone or signal, the microprocessor 50 will read the logic level of the AUTO/MANUAL switch 35 that determines the mode of operation 71 for fundamental acquisition and will send microprocessor 50 to one of two loops in either the automatic mode or the manual mode section of the program that reads through "microprocessor read buffer" 25 to determine whether there is an input applied so that fundamental processing can begin.

The following is an explanation of the register functions:

DFLAG—The display update flag register. In the initialization process the default value placed in this register is 00H. If a display update interrupt request is issued by the display update timer 43 while the default value is present, microprocessor 50 is informed that there is not a note or cent value in the display buffer (ABUF−ABUF+15). The display driver 64 is sent data to blink the "READY" indication on the display 65 (step 147) until microprocessor 50 detects display data in the display buffer. Upon processing octave, note, and cent value that are within the predetermined correlation boundaries of valid pitch detection, data is placed in the display buffer. As soon as data is placed in the display buffer, the DFLAG register is written with the value of 01H which indicates that, upon the receipt of a display update interrupt request, the octave, note, and cent values are ready to be processed for indication on the display 65. If a correlation is detected that is out cf tolerance, the value 02H is written into the DFLAG register which, upon a display update interrupt request, will cause the display 65 to indicate "−" (steps 149,150,151). An additional consecutive out of tolerance correlation will cause the DFLAG register to be incremented to 03H which will cause the apparatus to be restarted.

ABUF-ABUF+15—The display buffers—in the initialization process these buffers are written with 00H. The Buffer ABUF+1 will hold the note value while ABUF, ABUF+3, ABUF+6, ABUF+9, ABUF+12, and ABUF+15 hold the cent values between display update interrupts. Up to six cent values can be stored and averaged for each display interrupt exception. After the display update interrupt averages the cents values in the buffers, the buffers are cleared by writing with the default value 00H into each register. ABUF+1 which holds the note value is also used as a status register for the display update exception along with the DFLAG register. A note value in ABUF+1 will cause the DFLAG register to be written with 01H so that the data in the display buffer can be averaged and processed to be indicated on the display 65 (step 152).

CENTCNT—This register is initialized to 00H and is used to keep track of the number of valid correlations in the display buffer between display update interrupts. This register is cleared to 00H after display update exception.

BBUF—In the initialization process this register is written with 00H indicating that the apparatus is waiting for an applied tone or signal. When the apparatus is actively processing an input tone or signal, this register is written with 01H after the fundamental acquisition. When a display update interrupt exception is being processed if this register contains the value 00H and the DFLAG register contains 00H indicating that the display buffer has no data, then the display update exception is aborted and the display 65 will remain unchanged (steps 144,145,146).

CBUF—In the initialization of the apparatus this register is written with the value 00H. CBUF is used to cause a blinking effect of the "READY" indication on the display 65 while the apparatus is waiting for input. When a display update interrupt exception is received and BBUF is equal to 00H and CBUF is equal to 00H the entire display 65 is blanked. At the end of the blanking routine CBUF is written with 01H so when the next display update interrupt exception is received and BBUF is equal to 00H and CBUF is equal to 01H the "READY" indication on the display 65 147 is turned on and CBUF is returned to 00H to produce a "READY" blinking effect as long a BBUF is equal to 00H (steps 144,147,148).

LBUF—In the initialization process this register is written with 00H. This register is used to keep track of the past history of the cent value for the purpose of smoothing the cent value while the tuning mechanism of an instrument is being adjusted. The last cent value displayed is stored in this register and compared with the current cent value in the display update routine. If the current cent value is more than plus or minus two cents of the last displayed value, the current value is averaged with the previous cent value and the resulting cent value is stored in LBUF and indicated on the display 65. If the current cent value is less than plus or minus two cents, LBUF is updated with the current value and that cent value is displayed.

BLKDIS—This register is for use in the manual mode. It is initialized to 01H. In the manual mode this register is written with the value 00H which will cause only the alphanumeric portion of the display to indicate on the display the note indication that is held in the NOTEINC register while the note is chosen by depressing momentary switch 36 and to indicate the chosen note to be processed while the apparatus is waiting for input (steps, 171, 172, 173, 175). When the apparatus is actively processing a note, the value of this register is written with 01H so that the cents portion of the display will not be bypassed. In the automatic mode this register is left unchanged with the value of 01H.

NOTEINC—This register holds the note value of the last pitch that was processed. In the initialization this register is written with 01H indicating the "C" note. This register is used mainly in the manual mode for indicating the current note to be processed. In the manual mode the content of this register can be changed by depressing the note switch 36 while the apparatus is waiting for input (steps 171,172,173,175). The automatic mode can modify this register with the last note processed. After processing a pitch in the automatic mode, the last note processed in the automatic mode can be processed in the manual mode by setting switch 35 in the manual mode position.

POTCNT1-POTCNT2—These registers are used to keep track of the number of steps that the digital resistors 3,5 are incremented or decremented that directly relates to the resistance value currently presented by the devices. POTCNT1 holds the count of steps that digital resistor 3 is currently at, which relates directly to the gain of "microphone input" operational amplifier 2. POTCNT2 holds the count of steps that digital resistor 5 is currently at, which relates directly to the gain of "instrument input" operational amplifier 7.

POTDATA—This register is initialized to 33H. POTDATA is the storage register used to write to the digital resistor control latch 8. The 33H value indicates that the digital resistors are ready to be incremented upwardly to increase the resistance of the device.

BIGEST—This register is used in the fundamental acquisition loop as a register that holds intermediate data while each center frequency of the switched capacitor bandpass filter 13 is under test to determine the greatest amplitude output at that particular portion of the frequency domain. This register is always updated to indicate the highest amplitude that was detected at each center frequency of the bandpass output. This register is also used during the fundamental detection because the value contained in this register is compared against the predetermined amplitude values for fundamental detection. This register is initialized to 00H and is written again to 00H upon completion of each center frequency test.

BIGBUF—This register is used during the fundamental acquisition. Once the amplitude of the center frequency of the switched capacitor bandpass filter 13 is within the predetermined limits for fundamental detection, the register BIGEST will modify the contents of BIGBUF when the current center frequency test of the value of BIGEST is greater than the current content of BIGBUF. This is so there is a record of the highest amplitude when the bandpass center frequency is directly over the fundamental.

CLKCNT—This register is initialized with the value 00H and is used to keep track of the number of center frequency tests that the switched capacitor bandpass filter 13 has currently completed which is directly related to the location of the center frequency of the bandpass filter 13 in terms of the frequency domain.

LITE1-LITE6—These are buffer registers used to store the value of the "automatic mode center frequency" table count (CLKCNT) when the amplitude of the switched capacitor bandpass filter 13 center frequency is within the predetermined limits of fundamental detection and is approaching the fundamental. In the initialization of the apparatus, each of the LITE buffers is written with a default value of FFH. Each LITE buffer is directly related to the center frequency amplitude found within the limits of fundamental detection. In other words, there is a LITE buffer for each of the six possible amplitude values that can be detected by the analog-to-digital conversion circuitry 30,31,32,33. When the switched capacitor bandpass filter 13 bandpass output amplitude approaches the fundamental, the bandpass output amplitude will become greater and the current table count (CLKCNT) will be written into the LITE buffer that corresponds to the current bandpass output amplitude until a LITE buffer that corresponds to a lesser amplitude is written with a table count (CLKCNT) that has a higher count than a LITE buffer that corresponds to a greater amplitude. At this point the fundamental has been passed over and the fundamental acquisition is completed.

NOTESW—This register is used to indicate that eighteen pulse cycle periods have been collected and the last sixteen pulse cycle periods have been added together when FFH is written into this register so that the octave, note and cent values can be determined. This register is initialized to 00H and is written again to 00H once pitch processing is underway and input interrupts are enabled to gather eighteen more pulse cycle periods.

MATCHB1-MATCHB3—These registers are initialized to 00H and are used to hold the note and cent values from the predetermined number of acquisitions of sixteen pulse cycle periods for correlation processing. The registers are cleared to 00H after correlation processing is finished to be ready for the next predetermined number of acquisitions of sixteen pulse cycle periods.

After setting up all the default values in the registers, buffers, and latches, microprocessor 50 enables the display interrupts 69 and sets the gain of both the input amplifiers 2,7 to the optimum gain 70 used to determine if a tone or signal is applied to the apparatus. The gain is adjusted through the digital resistors 3,5 by decrementing the digital resistors 3,5 100 times to ensure that each of the digital resistors 3,5 is at the minimum resistance value and then incrementing each of the digital resistors 3,5 by a predetermined number of steps to increase the gain of each of the input operational amplifiers 2,7 to the optimum gain for detecting an applied input tone or signal. The number of steps that each of the digital resistors 3,5 is incremented is stored in two registers, one for each of the digital resistors 3,5. These registers (POTBUF1 and POTBUF2) are used to hold the exact step number of each digital resistor which is directly proportional to the resistance value of each digital resistor and the gain of each of the input amplifiers 2,7. This enables microprocessor 50 to have complete control over the input gain of each input amplifier 2,7, by writing control signals to the digital resistors 3,5 through "microprocessor write" latch 8 and reading the logic states of of voltage comparators 28,29 through "micrprocessor read" buffer 26.

Microprocessor 50 then loads the latch 10 with the first "automatic mode" center frequency table value causing the digital variable oscillator 9,11,12 to output a 50 percent duty cycle square wave to the switched capacitor bandpass filter 13 clock input. The frequency output of the digital variable oscillator 9,11,12 sets the center frequency of the bandpass of the filter at its lowest value in the frequency domain within the limits of the apparatus to give the "filter output rectifier" 25 time to settle in case the automatic mode fundamental acquisition is chosen.

At this point of the initialization, the logic level of switch 35 is read through "microprocessor read" buffer 34 by microprocessor 50 to determine the mode of fundamental processing to take place (steps 71,72). If the automatic mode of fundamental processing is selected, microprocessor 50 will jump to a loop which reads the digitized value proportional to the input signal amplitude through "microprocessor read" buffer 26 until a value is read that indicates an applied input tone to the apparatus (steps 73,74).

If switch 35 is read through "microprocessor read" buffer 34 and the logic level that indicates the apparatus is to be used for manual mode fundamental acquisition processing (steps 71,72), microprocessor 50 will jump to the loop for input acquisition in the manual mode section of the program (steps 159,160,161,162,171,172, 173,175,176,177,174). First, microprocessor 50 will read the default value in the NOTEINC register and set the BLKDIS register to 00H to bypass the plus, minus, and the two seven segment portions of the display 65 (step 160). Microprocessor 50 will then send the display driver the segments to be displayed on the alphanumeric portion of the display 65 to indicate the note "C" (step 161). Microprocessor 50 will then read "microprocessor read" buffer 26 for a digitized value proportional to the input amplitude 162 and be put into a delay loop for the purpose of causing a blinking effect of the displayed note if the predetermined amplitude for input acquisition is not detected (step 171). The blinking effect for denoting the apparatus is waiting for input is started when the note indication on the display is cleared (step 172) by microprocessor 50 sending the data to the display driver 64 to blank the display 65. If momentary switch 36 is depressed (step 173), microprocessor 50 will increment the NOTEINC register that holds the note value for the display 65 (step 175) and again verify the logic level of switch 35 (step 177) to enable the user to switch back to automatic fundamental acquisition while in the manual mode fundamental acquisition input process. Microprocessor 50 is then put in another delay loop (step 174) to make the blinking effect on the display to appear uniform. Momentary switch 36 can be depressed for any length of time causing the display 65 to indicate all twelve notes at a rate of about one second per note because switch 36 is depressed. When the desired note to be processed in indicated on the display 65, releasing momentary switch 36 will cause the note indicated on the display 65 to remain displayed in a blinking manner indicating that there is currently no applied input to the apparatus.

FUNDAMENTAL ACQUISITION

Referring to FIGS. 1A-1C and 2A-2G, the automatic mode of fundamental acquisition begins when microprocessor 50 reads the digitized value proportional to the input amplitude through "microprocessor read" buffer 26 that indicates the predetermined input amplitude value for detection of an applied note or signal to the apparatus 74. Once the input is detected, the switch 37 (step 75) is read by microprocessor 50 through "microprocessor read" buffer 34 to determine which of the input amplifiers 2,7 requires gain adjustment through control of the digital resistors 3,5 to the optimum input gain for fundamental detection (step 76). The gain of the active input amplifier 2,7 is then adjusted by microprocessor 50 controlling the gain of the amplifier 2,7 by writing control signals to "microprocessor write" latch 8 and then reading the rectified D.C. voltage output by rectifier 15 proportional to the input amplitude presented to the analog-to-digital conversion circuitry 28,29 read through "microprocessor read" buffer 26 until the optimum amplitude is obtained for presentation to the switch capacitor bandpass filter 13 (step 76).

The automatic mode fundamental acquisition table pointer has been previously initialized in the initialization of the apparatus. The rest of the automatic mode acquisition consists of a loop (steps 76,77,78,79,80,81,82)

in which consecutive table entries are loaded into the digital variable oscillator 9,10,11,12 to sweep the center frequency of the switched capacitor bandpass filter 13 in two percent increments of the frequency domain from the lowest center frequency in the table (A0–50) to consecutively upper center frequencies until it is determined that the fundamental has been passed over as described in the register definition section on the registers LITE1–LITE6. Once it has been determined that the center frequency has been passed over, the digital variable oscillator is loaded with center frequency table values in descending order until the amplitude of current center frequency under test is equal to the value stored in register BIGBUF which holds the value of the greatest amplitude of the center frequency tests (steps 83,84,85). At this point the switched capacitor bandpass filter 13 center frequency is placed directly over the fundamental of the input tone or signal.

The manual mode fundamental acquisition process begins with the detection of an applied input signal or tone by microprocessor 50 reading the digitized value proportional to the input amplitude indicating an applied input through "microprocessor read" buffer 26 (step 162). Microprocessor is then instructed to read the switch 37 which indicates the active input and adjusts the gain of the chosen input amplifier 2,7 through control of the digital resistor 3,5 to the optimum gain required by the switched capacitor bandpass filter 13 (step 163). Microprocessor 50 then reads the value of the NOTEINC register which holds the note value to be processed and determines the start of the manual mode fundamental acquisition table by incrementing a table pointer until the table pointer is at the start of the octave table which corresponds to the note value in NOTEINC 164. There are three table values for each of the nine octaves that are tested for each note value which provides for the testing of six percent of the frequency domain around the octave for the chosen note value. This relates to about two percent on either side of the chosen note value and the two percent of the frequency domain located directly over the octave.

Before each table value is loaded into the digital variable oscillator 9,10,11,12 the input amplitude gain is adjusted by microprocessor 50 so that the optimum amplitude for fundamental detection is always presented to the switched capacitor bandpass filter 13 so that each measurement is relative to the optimum input amplitude (step 165). The manual mode fundamental acquisition table is constructed so that the lowest center frequency values in the lowest octave are tested first and consecutive table entries are tested in a manner from lower to higher adjacent center frequencies in terms of the frequency domain. Fundamental detection is set up as a loop that tests the amplitude of a center frequency (step 167) and compares the detected value against the predetermined value for fundamental detection (step 169) and if the tested value is not within the limits of fundamental detection, the table pointer is incremented to the next higher center frequency table value (step 170) which, after the adjustment of the input gain 165, loads the next value into the digital variable oscillator 9,10,11,12. Once a center frequency of the switched capacitor bandpass filter 13 is determined to have sufficient amplitude for fundamental detection, the manual mode acquisition table value remains in the digital variable oscillator and octave, note and cent processing begins. When the table pointer indicates that it has reached the end of the table and none of the bandpass center frequencies possessed the amplitude required for fundamental detection, then the apparatus is restarted (step 168).

SYNCHRONIZATION OF THE INPUT PULSE CYCLES TO THE DIGITAL LOGIC

Referring to FIGS. 1A–1C and 4, the digitalized square wave output from voltage comparator 23 has no timing relationship to the twenty megahertz time base 39 that clocks the shift register 40 which is the synchronization mechanism between the two asynchronous sections of the apparatus. Besides being the synchronization mechanism between the time base oscillator 39 and the input pulse cycle, shift register 40 is used to guarantee the timing of the counting 57,59 and latching 56,58 circuitry. Since the twenty megahertz time base oscillator 39 has no timing relationship to the input pulse cycle, a method of synchronization is needed to reduce any possible timing errors between the two asynchronous timing periods and guarantee the digital counting and latching logic 56,57,58,59 in terms of the collected periods that the apparatus uses to determine pitch relative to perfect concert pitch as the standard for the basis of the accuracy presented to the user/operator of the apparatus.

The first problem to circumvent is the problem of metastability in the flipflop stages of the shift register 40. When the rising or falling edge of the input pulse cycle presented to the shift register 40 serial input is sufficiently close to the rising edge of the twenty megahertz time base oscillator 39 presented to the clock input of shift register 40, a condition arises in the first flipflop stage of the shift register where the flipflop output stage can be indeterminate or oscillating. This condition is known as metastability and requires that two serial flipflop stages be used to guarantee synchronization between two asynchronous pulse cycles because, upon the second rising edge of the time base oscillator 39, the setup time of the shift register 40 serial input is guaranteed and both flipflop stages will be stable. This requires that to develop guaranteed timing for the control signals presented to the digital clocking 45,46, counting 57,59, and latching 56,58 circuitry, the first two stages of the serial shift register 40 be unused.

Figure 5:
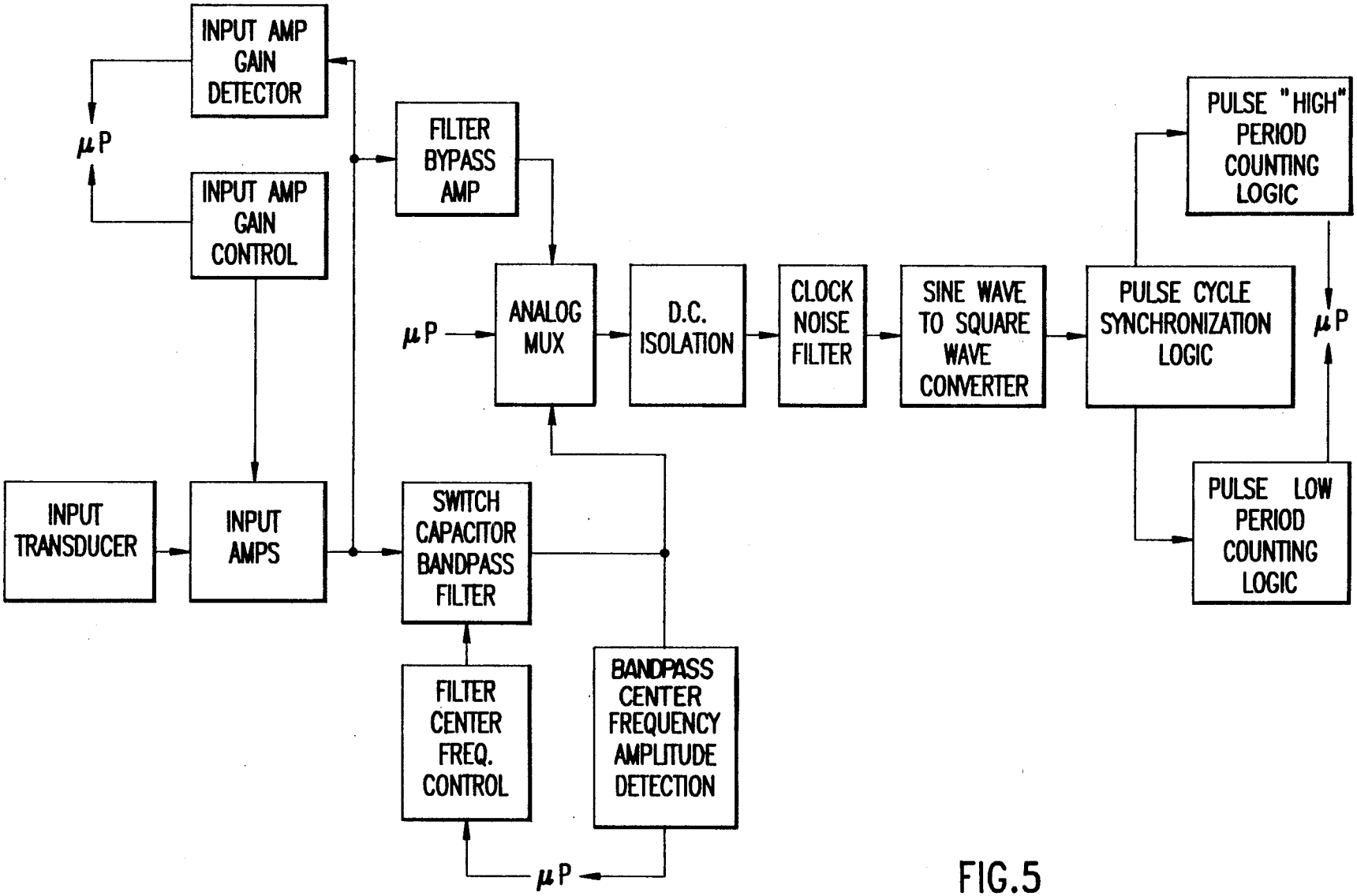
FIG. 5 is a block diagram illustrating the operation of the system according to the invention.

To properly control the counting and latching circuitry 56,57,58,59 and to meet the guaranteed setup timing for the counters 57,59 and latching via latches 56,58 requires that all timing related to enabling the counters and latching the outputs of the counters be done relative to the falling edge of the gated ten megahertz clock produced from flipflops 45,46 and that a predetermined chain of events takes place upon the rising and falling edge of the input pulse cycle. To accomplish this there are delays associated with starting each section of the counting logic 57,59 and latching (via latches 56,58) of the count of each half cycle period. In addition to the delays there are synchronization errors associated with the setup time of the serial input of the shift register 40 to the rising edge of the time base clock 39 and the phase of the ten megahertz gated clock 45,46 when one input pulse half cycle periods is ending. Referring to FIG. 5 the different delays and error sources are depicted. Since these delays and errors are random in nature, the best and worst case scenarios need to be calculated so that an average value of the delays and errors can be used to reconstruct the correct total of the accumulated periods. Because of the random nature of the errors and delays and because of the relatively large sample of 32 input pulse half cycle periods used to calculate the pitch values, the average of the delays and errors can be added to the added sum of the sixteen pulse cycle periods that are used to calculate the pitch value.

PITCH VALUE PROCESSING

Referring to FIGS. 1A-1C and 2A-2G, in either mode of fundamental acquisition the process of the determination of the pitch value is the same. When the fundamental of the input tone or signal has been found and the bandpass of the switched capacitor bandpass filter 13 center frequency is placed over the fundamental frequency, determination of the octave, note and cent value can begin.

Microprocessor 50 is instructed to initialize the input pulse buffer pointer to the beginning of the pulse input buffer located in RAM 54, and the "high priority" input interrupts are enabled by microprocessor 50 writing 00H to the "input interrupt enable/disable" flipflop 42. Microprocessor 50 is then put in a one and one-half second timing loop which constantly checks the value of buffer register NOTESW which indicates that sixteen pulse cycle periods have been collected and added together along with the average synchronization delay and errors and put into a buffer from which the pitch of the note can be determined (steps 86,87,88,89,90). If the timing loop times out after one and one half seconds, then the apparatus will be restarted (step 91).

Once the input pulse buffer pointer has been initialized and the input interrupts enabled, the rising edge of the input pulse cycle will cause the interrupt flipflop 42 to be clocked "low" causing an interrupt exception to occur. Processing the "high priority" input pulse cycle exception will begin at location 0066H in ROM 52. Once inside the pulse cycle input exception the program counter, the accumulator, flag and index registers are pushed on to the stack in RAM 54 (steps 123,124). The "high priority" interrupt flipflop 42 is returned to the "high" state by microprocessor 50 writing a byte of 01H to disable the "high priority enable/disable" flipflop 41 (step 125). Then the latches 56,68 are read by microprocessor 50 and stored in RAM 54 at the locations pointed to by the pulse buffer pointer which is incremented each time a latch is read and stored in memory (steps 126-131). After reading the latches and storing the data in RAM 54, the pulse buffer pointer is compared against the predetermined value that indicates that eighteen pulse cycle periods have been collected (step 132). If eighteen pulse cycle periods have not been collected, then the index, flag, accumulator registers and the program counter are popped back from the stack and "high priority interrupt enable/disable" flipflop 41 is enabled so that the next pulse cycle can be stored in RAM 54 and normal processing will resume (steps 140, 141). If the count contained in the pulse buffer pointer indicates that eighteen pulse cycle periods have been collected, then the last sixteen pulse cycles will be added together along with the synchronization delays and errors and loaded into the register used to determine the pitch value of the sixteen pulse cycle periods (steps 133,134,135). Then the pulse buffer pointer is initialized to the beginning of the the pulse buffer and the register NOTESW is written with FFH to indicate that a pitch value is ready for processing and the input amplitude is adjusted though the digital resistor 3,5 to the optimum value used in note processing. All the registers stored on the stack are popped back into microprocessor 50 but the "high priority" input pulse cycle interrupts are left disabled until pitch processing begins at which time the "high priority" input pulse cycle interrupts are enabled so that while during the calculation of the octave, note and cent values and while during display update exceptions, pulse cycle periods can be collected (steps 136,137,138,139).

At the beginning of pitch processing the input pulse buffer might not be full so included at the start of pitch processing is a one and one-half second timing loop (steps 88,89,90,91) which reads the pitch value ready register NOTESW every ten milliseconds (step 89). If the value in the pitch value ready register NOTESW is equal to FFH, the timing loop is aborted and pitch processing begins. First, the "high priority" pulse cycle input interrupt is enabled (step 93) so that input pulse cycles can be collected while pitch value processing and display update exceptions are in progress and the pitch value ready register NOTESW is reset to 00H (step 92). This is the reason for the pulse input interrupts having the higher priority in the active processing of the apparatus, and time is saved in processing pitch if the pitch values can be collected while the apparatus is processing non-time-critical routines.

After enabling the input pulse cycle interrupts, the octave count register is initialized to a count of seven and the input value is compared to the last value in the pitch table consisting of 1200 entries (steps 94,95). If the input pitch value is less than the last entry in the pitch table, the pitch is higher than "B8+50" which is the highest tone or signal that the apparatus can process and the apparatus is restarted 96. Then the input pitch value is compared to the first entry in the pitch table 100. If the input pitch value is greater than the first entry in the pitch table, the input pitch value is divided by two and the octave value register decremented by one, the divided pitch value is presented to the first value in the pitch table again (steps 101,102,103,104). The pitch value is divided by two (step 103) and the octave value register is decremented by one (step 102) until the pitch value is less than or equal to the first table entry at which time the octave value has been determined and is stored (step 101).

The note value is found by initializing the pitch table pointer with the beginning address of the pitch table and adding 100 cents or pitch table entry locations to the pitch table pointer (step 105) and comparing the pitch table value 100 cents or entry locations to the input pitch value and incrementing the note value register from one by one and adding 100 cents or table entries to the pitch table pointer each time the input pitch value is greater than the pitch table value until a pitch value is found to be less than or equal to the input pitch value at which time the value in the note value register contains the note value of the input pitch value (steps 106,107,108,109,110).

The cent value is found by subtracting 100 cents or pitch table entries from the pitch table pointer 111 and incrementing the cent value register each time that the input pitch value is greater than the pitch table entry and then incrementing the pitch table pointer by one and comparing the input pitch value to each consecutive pitch table entry until a pitch table entry is found to be less than or equal to the input pitch value at which time the cent value register will hold the cent value of the input pitch value (steps 112,113,114,115,116).

Once the octave, note and cent values have been determined, they are stored in the correlation buffers MATCHB1-MATCHB3 until three input pitch values have been collected (step 117). Upon storing the third acquisition of input pitch values, the buffers are compared against each other to determine if the three input pitch values are within the predetermined tolerance (step 118). If the input pitch values are within the predetermined tolerance, then the cent values are averaged (steps 119,120) and placed along with the note value in the display buffers ABUF-ABUF+15 (steps 121,122). The DFLAG register is then written with 01H denoting that valid data is ready for display. If correlations between the three input pitch values are found to be out of tolerance, the input pitch values are discarded (step 118) and the DFLAG register is written with 02H. If the next acquisition of three input pitch values is determined again to be outside the predetermined tolerance, the DFLAG register is written with 03H and the apparatus will be restarted.

DISPLAY UPDATE PROCESSING

Referring to FIGS. 1A-1C and 2A-2G and the DFLAG, ABUF, BBUF, CBUF register descriptions, a 250 millisecond timer 43 is provided to present a "low" pulse to microprocessor 50 low priority interrupt input to initiate display update processing so that the displayed data can be easily visualized by the user/operator. In the manual mode the display update interrupts are disabled in the initialization process (step 59) so that the note values can be selected by momentary switch 36 and the timing loop can display that the apparatus is awaiting input as previously described. Once active input pitch value processing has begun the display update interrupts are enabled (step 86) so that the pitch values can be displayed as normal. In the automatic mode, display interrupts are enabled during the initialization process and only disabled during the averaging subroutine and again enabled immediately upon completion of the averaging subroutine.

When active pitch processing is underway and the DFLAG is equal to 01H, the register CENTCNT holds the number of valid pitch correlations stored in the display buffer ABUF-ABUF+15. When a display update interrupt request is presented to the microprocessor 50 (step 142) low priority interrupt input, microprocessor 50 pushes all the internal registers onto the stack 143 and reads the value of the CENTCNT register. Microprocessor 50 then averages all the display buffers with display data contained in them (step 152). Then, the averaged value is compared to the value of the LBUF register to determine if the current display data is within tolerance of the last displayed value as described in the description of the past history processing in the register definition of the register LBUF.

In order to display the octave, note and cent values, some additional processing is required to determine the segments on the display 65 that are sent to the display driver 64 to indicate the data correctly. First, the octave data can be sent without further processing from the octave value register to "microprocessor write" latch 60 and decoded by decoder 61 which will illuminate the correct LED indicating the octave value (step 158). The note value register is compared against the twelve possible note values, and the segments of the alphanumeric portion of the display 65 are sent to the display driver 64. Processing the cent value to be displayed requires additional processing to convert the cents value in hexadecimal to a positive or negative decimal value 156.

The first step in determining whether the hexadecimal cents value is positive or sharp, or negative or flat in relation to perfect concert pitch is to subtract 33H or 51 decimal from the hexadecimal cent value. The flag register in microprocessor 50 is tested and if the carry bit is set, the cent value will be negative or flat with respect to perfect concert pitch and the segments that drive the minus sign are written into the display driver 64. If the zero bit is set in the flag register of microprocessor 50, the apparatus detects that perfect concert pitch is applied and the segment data is sent to the display driver 64 to inhibit both the plus and minus indications. If the carry bit in the flag register of microprocessor 50 is not set, the cent value is positive or sharp with respect to perfect concert pitch and the segment data is sent to the display driver to drive the plus indication.

At this point the polarity of the pitch has been determined. The hexadecimal cent value must be converted to a decimal number indicating a positive value for sharp pitches that indicate the degree of sharpness of the pitch value in a positive ascending order from +1 to +50 and a decimal number indicating a negative value for flat pitches that indicate the degree of flatness of the input pitch value in a negative descending order from −1 to −49. The hexadecimal conversion of the cents value to a two digit decimal value is accomplished by first subtracting 33H or 51 decimal from the cent value and testing the carry bit in the flag register. If a carry bit is set in the flag register of microprocessor 50, a hexadecimal conversion to decimal numbering is required to indicate pitch in the negative direction. The result of the subtraction that caused the carry bit to be set also causes the accumulator to contain a value less than zero which causes the accumulator to roll over. If the carry bit is reset and the 2's complement is performed on the contents of the accumulator, a value results that provides a hexadecimal value in the negative direction of a positive value from 1 to 50 in the accumulator of microprocessor 50. Since the minus sign has already been sent to the display driver 64, the positive value is easily converted to a two digit decimal number. If the subtraction of 33H or 51 decimal from the hexadecimal cent value had not caused the carry bit or the zero bit to be set in the flag register of microprocessor 50, the number would be positive or sharp in relation to the zero cent value of 33H or 51 decimal. A positive or zero number resulting from the subtraction of the zero point or 33H or 51 decimal from the hexadecimal cent value can be directly converted to two decimal digits.

The hexadecimal conversion routine first finds the decimal equivalent of the most significant hexadecimal digit. This is accomplished by first storing the hexadecimal cent value in a register for later use and then storing the most significant hexadecimal digit in the least significant bits of a register and shifting the hexadecimal bits in the accumulator four times to the right which will now hold the most significant hexadecimal digit in the least significant bit locations of the accumulator. The accumulator and the register holding the most significant hexadecimal digit in the four least significant bit positions are then added together. A decimal adjust accumulator instruction is performed after each addition. This process is done fifteen times consecutively resulting in the decimal equivalent of the hexadecimal most significant digit. The original hexadecimal cent value that was stored for later use is then recalled from storage and the most significant digit is masked. The resulting decimal value from conversion of the most significant digit of the hexadecimal cent value is then added to the hexadecimal cent value of the least significant digit. The results of this addition are then decimal adjusted in the accumulator and a two digit decimal value results in the accumulator of microprocessor 50 which can be used to drive the display 65.

The two seven segment displays indicating the positive or negative decimal cent value are driven by first comparing the most significant decimal value in the accumulator of microprocessor 50 to the values one through five which, upon finding the correct comparison, will send the segment data to the display driver 64. A zero in the most significant digit position is suppressed so that the segment data sent to the display driver 64 for the most significant digit position will blank that portion of the display 65. After sending the most significant decimal digit segments to the display driver 64, the least significant decimal cent value in the accumulator of microprocessor 50 is compared against the values zero through nine which upon finding the correct comparison will send the segment data to the display driver 64 for the least significant decimal value to be displayed (step 157). After the indication of the cent value on the display 65, the update exception routine is terminated and normal active pitch processing resumes (step 158).

The following is a table of the values used to calculate the octave, note, and cent values from the sixteen added pulse cycle periods from the digital logic.

APPENDIX I

```
                    169E R                ORG     169EH
0000169E A299                ROMTMIN WORD    39330
000016A0 8B99                        WORD    39307
000016A2 7599                        WORD    39285
000016A4 5E99                        WORD    39262
000016A6 4799                        WORD    39239
000016A8 3199                        WORD    39217
000016AA 1A99                        WORD    39194
000016AC 0399                        WORD    39171
000016AE ED98                        WORD    39149
000016B0 D698                        WORD    39126
000016B2 BF98                        WORD    39103
000016B4 A998                        WORD    39081
000016B6 9298                        WORD    39058
000016B8 7C98                        WORD    39036
000016BA 6598                        WORD    39013
000016BC 4F98                        WORD    38991
000016BE 3898                        WORD    38968
000016C0 2298                        WORD    38946
000016C2 0B98                        WORD    38923
000016C4 F597                        WORD    38901
000016C6 DE97                        WORD    38878
000016C8 C897                        WORD    38856
000016CA B197                        WORD    38833
000016CC 9B97                        WORD    38811
000016CE 8497                        WORD    38788
000016D0 6E97                        WORD    38766
000016D2 5897                        WORD    38744
000016D4 4197                        WORD    38721
000016D6 2B97                        WORD    38699
000016D8 1597                        WORD    38677
000016DA FE96                        WORD    38654
000016DC E896                        WORD    38632
000016DE D196                        WORD    38609
000016E0 BA96                        WORD    38586
000016E2 A496                        WORD    38564
000016E4 8E96                        WORD    38542
000016E6 7796                        WORD    38519
000016E8 6196                        WORD    38497
000016EA 4B96                        WORD    38475
000016EC 3596                        WORD    38453
```

| | | | | |
|---|---|---|---|---|
| 42 | 000016EE | 1E96 | WORD | 38430 |
| 43 | 000016F0 | 0896 | WORD | 38408 |
| 44 | 000016F2 | F295 | WORD | 38386 |
| 45 | 000016F4 | DD95 | WORD | 38365 |
| 46 | 000016F6 | C795 | WORD | 38343 |
| 47 | 000016F8 | B195 | WORD | 38321 |
| 48 | 000016FA | 9A95 | WORD | 38298 |
| 49 | 000016FC | 8495 | WORD | 38276 |
| 50 | 000016FE | 6E95 | WORD | 38254 |
| 51 | 00001700 | 5895 | WORD | 38232 |
| 52 | 00001702 | 4295 | WORD | 38210 |
| 53 | 00001704 | 2C95 | WORD | 38188 |
| 54 | 00001706 | 1695 | WORD | 38166 |
| 55 | 00001708 | 0095 | WORD | 38144 |
| 56 | 0000170A | EA94 | WORD | 38122 |
| 57 | 0000170C | D494 | WORD | 38100 |
| 58 | 0000170E | BE94 | WORD | 38078 |
| 59 | 00001710 | A894 | WORD | 38056 |
| 60 | 00001712 | 9294 | WORD | 38034 |
| 61 | 00001714 | 7C94 | WORD | 38012 |
| 62 | 00001716 | 6694 | WORD | 37990 |
| 63 | 00001718 | 5094 | WORD | 37968 |
| 64 | 0000171A | 3A94 | WORD | 37946 |
| 65 | 0000171C | 2494 | WORD | 37924 |
| 66 | 0000171E | 0E94 | WORD | 37902 |
| 67 | 00001720 | F893 | WORD | 37880 |
| 68 | 00001722 | E293 | WORD | 37858 |
| 69 | 00001724 | CD93 | WORD | 37837 |
| 70 | 00001726 | B793 | WORD | 37815 |
| 71 | 00001728 | A193 | WORD | 37793 |
| 72 | 0000172A | 8B93 | WORD | 37771 |
| 73 | 0000172C | 7593 | WORD | 37749 |
| 74 | 0000172E | 5F93 | WORD | 37727 |
| 75 | 00001730 | 4A93 | WORD | 37706 |
| 76 | 00001732 | 3493 | WORD | 37684 |
| 77 | 00001734 | 1E93 | WORD | 37662 |
| 78 | 00001736 | 0893 | WORD | 37640 |
| 79 | 00001738 | F392 | WORD | 37619 |
| 80 | 0000173A | DD92 | WORD | 37597 |
| 81 | 0000173C | C792 | WORD | 37575 |
| 82 | 0000173E | B192 | WORD | 37553 |
| 83 | 00001740 | 9C92 | WORD | 37532 |
| 84 | 00001742 | 8692 | WORD | 37510 |
| 85 | 00001744 | 7092 | WORD | 37488 |
| 86 | 00001746 | 5B92 | WORD | 37467 |
| 87 | 00001748 | 4592 | WORD | 37445 |
| 88 | 0000174A | 2F92 | WORD | 37423 |
| 89 | 0000174C | 1A92 | WORD | 37402 |
| 90 | 0000174E | 0492 | WORD | 37380 |
| 91 | 00001750 | EF91 | WORD | 37359 |
| 92 | 00001752 | D991 | WORD | 37337 |
| 93 | 00001754 | C391 | WORD | 37315 |
| 94 | 00001756 | AE91 | WORD | 37294 |
| 95 | 00001758 | 9891 | WORD | 37272 |
| 96 | 0000175A | 8391 | WORD | 37251 |
| 97 | 0000175C | 6D91 | WORD | 37229 |

| | | | | | |
|---|---|---|---|---|---|
| 98 | 0000175E | 5891 | ORD | 37208 | |
| 99 | 00001760 | 4291 | WORD | 37186 | |
| 100 | 00001762 | 2D91 | WORD | 37165 | |
| 101 | 00001764 | 1791 | WORD | 37143 | |
| 102 | 00001766 | 0291 | WORD | 37122 | +100 |
| 103 | 00001768 | EC90 | WORD | 37100 | |
| 104 | 0000176A | D790 | WORD | 37079 | |
| 105 | 0000176C | C290 | WORD | 37058 | |
| 106 | 0000176E | AC90 | WORD | 37036 | |
| 107 | 00001770 | 9790 | WORD | 37015 | |
| 108 | 00001772 | 8190 | WORD | 36993 | |
| 109 | 00001774 | 6C90 | WORD | 36972 | |
| 110 | 00001776 | 5790 | WORD | 36951 | |
| 111 | 00001778 | 4190 | WORD | 36929 | |
| 112 | 0000177A | 2C90 | WORD | 36908 | |
| 113 | 0000177C | 1790 | WORD | 36887 | |
| 114 | 0000177E | 0190 | WORD | 36865 | |
| 115 | 00001780 | EC8F | WORD | 36844 | |
| 116 | 00001782 | D78F | WORD | 36823 | |
| 117 | 00001784 | C28F | WORD | 36802 | |
| 118 | 00001786 | AC8F | WORD | 36780 | |
| 119 | 00001788 | 978F | WORD | 36759 | |
| 120 | 0000178A | 828F | WORD | 36738 | |
| 121 | 0000178C | 6D8F | WORD | 36717 | |
| 122 | 0000178E | 578F | WORD | 36695 | |
| 123 | 00001790 | 428F | WORD | 36674 | |
| 124 | 00001792 | 2D8F | WORD | 36653 | |
| 125 | 00001794 | 0E8F | WORD | 36622 | |
| 126 | 00001796 | 038F | WORD | 36611 | |
| 127 | 00001798 | EE8E | WORD | 36590 | |
| 128 | 0000179A | D88E | WORD | 36568 | |
| 129 | 0000179C | C38E | WORD | 36547 | |
| 130 | 0000179E | AE8E | WORD | 36526 | |
| 131 | 000017A0 | 998E | WORD | 36505 | |
| 132 | 000017A2 | 848E | WORD | 36484 | |
| 133 | 000017A4 | 6F8E | WORD | 36463 | |
| 134 | 000017A6 | 5A8E | WORD | 36442 | |
| 135 | 000017A8 | 458E | WORD | 36421 | |
| 136 | 000017AA | 308E | WORD | 36400 | |
| 137 | 000017AC | 1C8E | WORD | 36380 | |
| 138 | 000017AE | 078E | WORD | 36359 | |
| 139 | 000017B0 | F28D | WORD | 36338 | |
| 140 | 000017B2 | DD8D | WORD | 36317 | |
| 141 | 000017B4 | C88D | WORD | 36296 | |
| 142 | 000017B6 | B38D | WORD | 36275 | |
| 143 | 000017B8 | 9E8D | WORD | 36254 | |
| 144 | 000017BA | 898D | WORD | 36233 | |
| 145 | 000017BC | 748D | WORD | 36212 | |
| 146 | 000017BE | 5F8D | WORD | 36191 | |
| 147 | 000017C0 | 4A8D | WORD | 36170 | |
| 148 | 000017C2 | 358D | WORD | 36149 | |
| 149 | 000017C4 | 208D | WORD | 36128 | |
| 150 | 000017C6 | 0B8D | WORD | 36107 | |
| 151 | 000017C8 | F78C | WORD | 36087 | |
| 152 | 000017CA | E28C | WORD | 36066 | |
| 153 | 000017CC | CD8C | WORD | 36045 | |

| | | | | | |
|---|---|---|---|---|---|
| 154 | 000017CE | B88C | WORD | 36024 | |
| 155 | 000017D0 | A38C | WORD | 36003 | |
| 156 | 000017D2 | 8F8C | WORD | 35983 | |
| 157 | 000017D4 | 7A8C | WORD | 35962 | |
| 158 | 000017D6 | 658C | WORD | 35941 | |
| 159 | 000017D8 | 508C | WORD | 35920 | |
| 160 | 000017DA | 3B8C | WORD | 35899 | |
| 161 | 000017DC | 278C | WORD | 35879 | |
| 162 | 000017DE | 128C | WORD | 35858 | |
| 163 | 000017E0 | FD8B | WORD | 35837 | |
| 164 | 000017E2 | E98B | WORD | 35817 | |
| 165 | 000017E4 | D48B | WORD | 35796 | |
| 166 | 000017E6 | BF8B | WORD | 35775 | |
| 167 | 000017E8 | AB8B | WORD | 35755 | |
| 168 | 000017EA | 968B | WORD | 35734 | |
| 169 | 000017EC | 818B | WORD | 35713 | |
| 170 | 000017EE | 6D8B | WORD | 35693 | |
| 171 | 000017F0 | 588B | WORD | 35672 | |
| 172 | 000017F2 | 438B | WORD | 35651 | |
| 173 | 000017F4 | 2F8B | WORD | 35631 | |
| 174 | 000017F6 | 1A8B | WORD | 35610 | |
| 175 | 000017F8 | 068B | WORD | 35590 | |
| 176 | 000017FA | F18A | WORD | 35569 | |
| 177 | 000017FC | DD8A | WORD | 35549 | |
| 178 | 000017FE | C88A | WORD | 35528 | |
| 179 | 00001800 | B48A | WORD | 35508 | |
| 180 | 00001802 | 9F8A | WORD | 35487 | |
| 181 | 00001804 | 8A8A | WORD | 35466 | |
| 182 | 00001806 | 768A | WORD | 35446 | |
| 183 | 00001808 | 638A | WORD | 35427 | |
| 184 | 0000180A | 4E8A | WORD | 35406 | |
| 185 | 0000180C | 3A8A | WORD | 35386 | |
| 186 | 0000180E | 258A | WORD | 35365 | |
| 187 | 00001810 | 118A | WORD | 35345 | |
| 188 | 00001812 | FC89 | WORD | 35324 | |
| 189 | 00001814 | E889 | WORD | 35304 | |
| 190 | 00001816 | D489 | WORD | 35284 | |
| 191 | 00001818 | BF89 | WORD | 35263 | |
| 192 | 0000181A | AB89 | WORD | 35243 | |
| 193 | 0000181C | 9689 | WORD | 35222 | |
| 194 | 0000181E | 8289 | WORD | 35202 | |
| 195 | 00001820 | 6E89 | WORD | 35182 | |
| 196 | 00001822 | 5989 | WORD | 35161 | |
| 197 | 00001824 | 4589 | WORD | 35141 | |
| 198 | 00001826 | 3189 | WORD | 35121 | |
| 199 | 00001828 | 1D89 | WORD | 35101 | |
| 200 | 0000182A | 0889 | WORD | 35080 | |
| 201 | 0000182C | F488 | WORD | 35060 | |
| 202 | 0000182E | E088 | WORD | 35040 | +200 |
| 203 | 00001830 | CC88 | WORD | 35020 | |
| 204 | 00001832 | B788 | WORD | 34999 | |
| 205 | 00001834 | A388 | WORD | 34979 | |
| 206 | 00001836 | 8F88 | WORD | 34959 | |
| 207 | 00001838 | 7B88 | WORD | 34939 | |
| 208 | 0000183A | 6688 | WORD | 34918 | |

| | | | | |
|---|---|---|---|---|
| 209 | 0000183C | 5288 | WORD | 34898 |
| 210 | 0000183E | 3E88 | WORD | 34878 |
| 211 | 00001840 | 2A88 | WORD | 34858 |
| 212 | 00001842 | 1688 | WORD | 34838 |
| 213 | 00001844 | 0288 | WORD | 34818 |
| 214 | 00001846 | EE87 | WORD | 34798 |
| 215 | 00001848 | DA87 | WORD | 34778 |
| 216 | 0000184A | C587 | WORD | 34757 |
| 217 | 0000184C | B187 | WORD | 34737 |
| 218 | 0000184E | 9D87 | WORD | 34717 |
| 219 | 00001850 | 8987 | WORD | 34697 |
| 220 | 00001852 | 7587 | WORD | 34677 |
| 221 | 00001854 | 6187 | WORD | 34657 |
| 222 | 00001856 | 4D87 | WORD | 34637 |
| 223 | 00001858 | 3987 | WORD | 34617 |
| 224 | 0000185A | 2587 | WORD | 34597 |
| 225 | 0000185C | 1187 | WORD | 34577 |
| 226 | 0000185E | FD86 | WORD | 34557 |
| 227 | 00001860 | E986 | WORD | 34537 |
| 228 | 00001862 | D586 | WORD | 34517 |
| 229 | 00001864 | C186 | WORD | 34497 |
| 230 | 00001866 | AD86 | WORD | 34477 |
| 231 | 00001868 | 9A86 | WORD | 34458 |
| 232 | 0000186A | 8686 | WORD | 34438 |
| 233 | 0000186C | 7286 | WORD | 34418 |
| 234 | 0000186E | 5E86 | WORD | 34398 |
| 235 | 00001870 | 4A86 | WORD | 34378 |
| 236 | 00001872 | 3686 | WORD | 34358 |
| 237 | 00001874 | 2286 | WORD | 34338 |
| 238 | 00001876 | 0E86 | WORD | 34318 |
| 239 | 00001878 | FB85 | WORD | 34299 |
| 240 | 0000187A | E785 | WORD | 34279 |
| 241 | 0000187C | D385 | WORD | 34259 |
| 242 | 0000187E | BF85 | WORD | 34239 |
| 243 | 00001880 | AB85 | WORD | 34219 |
| 244 | 00001882 | 9885 | WORD | 34200 |
| 245 | 00001884 | 8485 | WORD | 34180 |
| 246 | 00001886 | 7085 | WORD | 34160 |
| 247 | 00001888 | 5C85 | WORD | 34140 |
| 248 | 0000188A | 4985 | WORD | 34121 |
| 249 | 0000188C | 3585 | WORD | 34101 |
| 250 | 0000188E | 2185 | WORD | 34081 |
| 251 | 00001890 | 0E85 | WORD | 34062 |
| 252 | 00001892 | FA84 | WORD | 34042 |
| 253 | 00001894 | E684 | WORD | 34022 |
| 254 | 00001896 | D384 | WORD | 34003 |
| 255 | 00001898 | BF84 | WORD | 33983 |
| 256 | 0000189A | AB84 | WORD | 33963 |
| 257 | 0000189C | 9884 | WORD | 33944 |
| 258 | 0000189E | 8484 | WORD | 33924 |
| 259 | 000018A0 | 7184 | WORD | 33905 |
| 260 | 000018A2 | 5D84 | WORD | 33885 |
| 261 | 000018A4 | 4984 | WORD | 33865 |
| 262 | 000018A6 | 3684 | WORD | 33846 |
| 263 | 000018A8 | 2284 | WORD | 33826 |
| 264 | 000018AA | 0F84 | WORD | 33807 |

| | | | | | |
|---|---|---|---|---|---|
| 265 | 000018AC | FB83 | WORD | 33787 | |
| 266 | 000018AE | E883 | WORD | 33768 | |
| 267 | 000018B0 | D483 | WORD | 33748 | |
| 268 | 000018B2 | C183 | WORD | 33729 | |
| 269 | 000018B4 | AD83 | WORD | 33709 | |
| 270 | 000018B6 | 9A83 | WORD | 33690 | |
| 271 | 000018B8 | 8683 | WORD | 33670 | |
| 272 | 000018BA | 7383 | WORD | 33651 | |
| 273 | 000018BC | 5F83 | WORD | 33631 | |
| 274 | 000018BE | 4C83 | WORD | 33612 | |
| 275 | 000018C0 | 3983 | WORD | 33593 | |
| 276 | 000018C2 | 2583 | WORD | 33573 | |
| 277 | 000018C4 | 1283 | WORD | 33554 | |
| 278 | 000018C6 | FE82 | WORD | 33534 | |
| 279 | 000018C8 | EB82 | WORD | 33515 | |
| 280 | 000018CA | D882 | WORD | 33496 | |
| 281 | 000018CC | C482 | WORD | 33476 | |
| 282 | 000018CE | B182 | WORD | 33457 | |
| 283 | 000018D0 | 9E82 | WORD | 33438 | |
| 284 | 000018D2 | 8A82 | WORD | 33418 | |
| 285 | 000018D4 | 7782 | WORD | 33399 | |
| 286 | 000018D6 | 6482 | WORD | 33380 | |
| 287 | 000018D8 | 5082 | WORD | 33360 | |
| 288 | 000018DA | 3E82 | WORD | 33342 | |
| 289 | 000018DC | 2B82 | WORD | 33323 | |
| 290 | 000018DE | 1882 | WORD | 33304 | |
| 291 | 000018E0 | 0482 | WORD | 33284 | |
| 292 | 000018E2 | F181 | WORD | 33265 | |
| 293 | 000018E4 | DE81 | WORD | 33246 | |
| 294 | 000018E6 | CB81 | WORD | 33227 | |
| 295 | 000018E8 | B881 | WORD | 33208 | |
| 296 | 000018EA | A481 | WORD | 33188 | |
| 297 | 000018EC | 9181 | WORD | 33169 | |
| 298 | 000018EE | 7E81 | WORD | 33150 | |
| 299 | 000018F0 | 6B81 | WORD | 33131 | |
| 300 | 000018F2 | 5881 | WORD | 33112 | |
| 301 | 000018F4 | 4581 | WORD | 33093 | |
| 302 | 000018F6 | 3281 | WORD | 33074 | + 300 |
| 303 | 000018F8 | 1E81 | WORD | 33054 | |
| 304 | 000018FA | 0B81 | WORD | 33035 | |
| 305 | 000018FC | F880 | WORD | 33016 | |
| 306 | 000018FE | E580 | WORD | 32997 | |
| 307 | 00001900 | D280 | WORD | 32978 | |
| 308 | 00001902 | BF80 | WORD | 32959 | |
| 309 | 00001904 | AC80 | WORD | 32940 | |
| 310 | 00001906 | 9980 | WORD | 32921 | |
| 311 | 00001908 | 8680 | WORD | 32902 | |
| 312 | 0000190A | 7380 | WORD | 32883 | |
| 313 | 0000190C | 6080 | WORD | 32864 | |
| 314 | 0000190E | 4D80 | WORD | 32845 | |
| 315 | 00001910 | 3A80 | WORD | 32826 | |
| 316 | 00001912 | 2780 | WORD | 32807 | |
| 317 | 00001914 | 1480 | WORD | 32788 | |
| 318 | 00001916 | 0180 | WORD | 32769 | |
| 319 | 00001918 | EE7F | WORD | 32750 | |
| 320 | 0000191A | DB7F | WORD | 32731 | |

| | | | | |
|---|---|---|---|---|
| 321 | 0000191C | C87F | WORD | 32712 |
| 322 | 0000191E | B67F | WORD | 32694 |
| 323 | 00001920 | A37F | WORD | 32675 |
| 324 | 00001922 | 907F | WORD | 32656 |
| 325 | 00001924 | 7D7F | WORD | 32637 |
| 326 | 00001926 | 6A7F | WORD | 32618 |
| 327 | 00001928 | 577F | WORD | 32599 |
| 328 | 0000192A | 447F | WORD | 32580 |
| 329 | 0000192C | 327F | WORD | 32562 |
| 330 | 0000192E | 1F7F | WORD | 32543 |
| 331 | 00001930 | 0C7F | WORD | 32524 |
| 332 | 00001932 | F97E | WORD | 32505 |
| 333 | 00001934 | E67E | WORD | 32486 |
| 334 | 00001936 | D47E | WORD | 32468 |
| 335 | 00001938 | C17E | WORD | 32449 |
| 336 | 0000193A | AE7E | WORD | 32430 |
| 337 | 0000193C | 9B7E | WORD | 32411 |
| 338 | 0000193E | 897E | WORD | 32393 |
| 339 | 00001940 | 767E | WORD | 32374 |
| 340 | 00001942 | 637E | WORD | 32355 |
| 341 | 00001944 | 517E | WORD | 32337 |
| 342 | 00001946 | 3E7E | WORD | 32318 |
| 343 | 00001948 | 2B7E | WORD | 32299 |
| 344 | 0000194A | 197E | WORD | 32281 |
| 345 | 0000194C | 067E | WORD | 32262 |
| 346 | 0000194E | F37D | WORD | 32243 |
| 347 | 00001950 | E17D | WORD | 32225 |
| 348 | 00001952 | CE7D | WORD | 32206 |
| 349 | 00001954 | BB7D | WORD | 32187 |
| 350 | 00001956 | A97D | WORD | 32169 |
| 351 | 00001958 | 967D | WORD | 32150 |
| 352 | 0000195A | 847D | WORD | 32132 |
| 353 | 0000195C | 717D | WORD | 32113 |
| 354 | 0000195E | 5F7D | WORD | 32095 |
| 355 | 00001960 | 4C7D | WORD | 32076 |
| 356 | 00001962 | 3A7D | WORD | 32058 |
| 357 | 00001964 | 277D | WORD | 32039 |
| 358 | 00001966 | 157D | WORD | 32021 |
| 359 | 00001968 | 027D | WORD | 32002 |
| 360 | 0000196A | F07C | WORD | 31984 |
| 361 | 0000196C | DD7C | WORD | 31965 |
| 362 | 0000196E | CC7C | WORD | 31948 |
| 363 | 00001970 | B97C | WORD | 31929 |
| 364 | 00001972 | A77C | WORD | 31911 |
| 365 | 00001974 | 947C | WORD | 31892 |
| 366 | 00001976 | 827C | WORD | 31874 |
| 367 | 00001978 | 6F7C | WORD | 31855 |
| 368 | 0000197A | 5D7C | WORD | 31837 |
| 369 | 0000197C | 4B7C | WORD | 31819 |
| 370 | 0000197E | 387C | WORD | 31800 |
| 371 | 00001980 | 267C | WORD | 31782 |
| 372 | 00001982 | 147C | WORD | 31764 |
| 373 | 00001984 | 017C | WORD | 31745 |
| 374 | 00001986 | EF7B | WORD | 31727 |
| 375 | 00001988 | DD7B | WORD | 31709 |
| 376 | 0000198A | CA7B | WORD | 31690 |

| | | | | |
|---|---|---|---|---|
| 377 | 0000198C | B87B | WORD | 31672 |
| 378 | 0000198E | A67B | WORD | 31654 |
| 379 | 00001990 | 937B | WORD | 31635 |
| 380 | 00001992 | 817B | WORD | 31617 |
| 381 | 00001994 | 6F7B | WORD | 31599 |
| 382 | 00001996 | 5D7B | WORD | 31581 |
| 383 | 00001998 | 4A7B | WORD | 31562 |
| 384 | 0000199A | 387B | WORD | 31544 |
| 385 | 0000199C | 267B | WORD | 31526 |
| 386 | 0000199E | 147B | WORD | 31508 |
| 387 | 000019A0 | 017B | WORD | 31489 |
| 388 | 000019A2 | EF7A | WORD | 31471 |
| 389 | 000019A4 | DD7A | WORD | 31453 |
| 390 | 000019A6 | CB7A | WORD | 31435 |
| 391 | 000019A8 | B97A | WORD | 31417 |
| 392 | 000019AA | A77A | WORD | 31399 |
| 393 | 000019AC | 947A | WORD | 31380 |
| 394 | 000019AE | 827A | WORD | 31362 |
| 395 | 000019B0 | 707A | WORD | 31344 |
| 396 | 000019B2 | 5E7A | WORD | 31326 |
| 397 | 000019B4 | 4C7A | WORD | 31308 |
| 398 | 000019B6 | 3A7A | WORD | 31290 |
| 399 | 000019B8 | 287A | WORD | 31272 |
| 400 | 000019BA | 167A | WORD | 31254 |
| 401 | 000019BC | 047A | WORD | 31236 |
| 402 | 000019BE | F279 | WORD | 31218 + 400 |
| 403 | 000019C0 | E079 | WORD | 31200 |
| 404 | 000019C2 | CE79 | WORD | 31182 |
| 405 | 000019C4 | BC79 | WORD | 31164 |
| 406 | 000019C6 | AA79 | WORD | 31146 |
| 407 | 000019C8 | 9879 | WORD | 31128 |
| 408 | 000019CA | 8679 | WORD | 31110 |
| 409 | 000019CC | 7479 | WORD | 31092 |
| 410 | 000019CE | 6279 | WORD | 31074 |
| 411 | 000019D0 | 5079 | WORD | 31056 |
| 412 | 000019D2 | 3E79 | WORD | 31038 |
| 413 | 000019D4 | 2C79 | WORD | 31020 |
| 414 | 000019D6 | 1A79 | WORD | 31002 |
| 415 | 000019D8 | 0879 | WORD | 30984 |
| 416 | 000019DA | F678 | WORD | 30966 |
| 417 | 000019DC | E478 | WORD | 30948 |
| 418 | 000019DE | D278 | WORD | 30930 |
| 419 | 000019E0 | C178 | WORD | 30913 |
| 420 | 000019E2 | AF78 | WORD | 30895 |
| 421 | 000019E4 | 9D78 | WORD | 30877 |
| 422 | 000019E6 | 8B78 | WORD | 30859 |
| 423 | 000019E8 | 7978 | WORD | 30841 |
| 424 | 000019EA | 6778 | WORD | 30823 |
| 425 | 000019EC | 5678 | WORD | 30806 |
| 426 | 000019EE | 4478 | WORD | 30788 |
| 427 | 000019F0 | 3278 | WORD | 30770 |
| 428 | 000019F2 | 2078 | WORD | 30752 |
| 429 | 000019F4 | 0E78 | WORD | 30734 |
| 430 | 000019F6 | FD77 | WORD | 30717 |
| 431 | 000019F8 | EB77 | WORD | 30699 |
| 432 | 000019FA | D977 | WORD | 30681 |

| | | | | |
|---|---|---|---|---|
| 433 | 000019FC | C877 | WORD | 30664 |
| 434 | 000019FE | B677 | WORD | 30646 |
| 435 | 00001A00 | A477 | WORD | 30628 |
| 436 | 00001A02 | 9277 | WORD | 30610 |
| 437 | 00001A04 | 8177 | WORD | 30593 |
| 438 | 00001A06 | 6F77 | WORD | 30575 |
| 439 | 00001A08 | 5D77 | WORD | 30557 |
| 440 | 00001A0A | 4C77 | WORD | 30540 |
| 441 | 00001A0C | 3A77 | WORD | 30522 |
| 442 | 00001A0E | 2977 | WORD | 30505 |
| 443 | 00001A10 | 1777 | WORD | 30487 |
| 444 | 00001A12 | 0577 | WORD | 30469 |
| 445 | 00001A14 | F476 | WORD | 30452 |
| 446 | 00001A16 | E276 | WORD | 30434 |
| 447 | 00001A18 | D176 | WORD | 30417 |
| 448 | 00001A1A | BF76 | WORD | 30399 |
| 449 | 00001A1C | AD76 | WORD | 30381 |
| 450 | 00001A1E | 9C76 | WORD | 30364 |
| 451 | 00001A20 | 8A76 | WORD | 30346 |
| 452 | 00001A22 | 7976 | WORD | 30329 |
| 453 | 00001A24 | 6476 | WORD | 30308 |
| 454 | 00001A26 | 5676 | WORD | 30294 |
| 455 | 00001A28 | 4476 | WORD | 30276 |
| 456 | 00001A2A | 3376 | WORD | 30259 |
| 457 | 00001A2C | 2176 | WORD | 30241 |
| 458 | 00001A2E | 1076 | WORD | 30224 |
| 459 | 00001A30 | FE75 | WORD | 30206 |
| 460 | 00001A32 | ED75 | WORD | 30189 |
| 461 | 00001A34 | DB75 | WORD | 30171 |
| 462 | 00001A36 | CA75 | WORD | 30154 |
| 463 | 00001A38 | B975 | WORD | 30137 |
| 464 | 00001A3A | A775 | WORD | 30119 |
| 465 | 00001A3C | 9675 | WORD | 30102 |
| 466 | 00001A3E | 8475 | WORD | 30084 |
| 467 | 00001A40 | 7375 | WORD | 30067 |
| 468 | 00001A42 | 6275 | WORD | 30050 |
| 469 | 00001A44 | 5075 | WORD | 30032 |
| 470 | 00001A46 | 3F75 | WORD | 30015 |
| 471 | 00001A48 | 2E75 | WORD | 29998 |
| 472 | 00001A4A | 1C75 | WORD | 29980 |
| 473 | 00001A4C | 0B75 | WORD | 29963 |
| 474 | 00001A4E | F774 | WORD | 29943 |
| 475 | 00001A50 | E874 | WORD | 29928 |
| 476 | 00001A52 | D774 | WORD | 29911 |
| 477 | 00001A54 | C674 | WORD | 29894 |
| 478 | 00001A56 | B574 | WORD | 29877 |
| 479 | 00001A58 | A374 | WORD | 29859 |
| 480 | 00001A5A | 9274 | WORD | 29842 |
| 481 | 00001A5C | 8174 | WORD | 29825 |
| 482 | 00001A5E | 7074 | WORD | 29808 |
| 483 | 00001A60 | 5E74 | WORD | 29790 |
| 484 | 00001A62 | 4D74 | WORD | 29773 |
| 485 | 00001A64 | 3C74 | WORD | 29756 |
| 486 | 00001A66 | 2B74 | WORD | 29739 |
| 487 | 00001A68 | 1A74 | WORD | 29722 |
| 488 | 00001A6A | 0874 | WORD | 29704 |

| | | | | |
|---|---|---|---|---|
| 489 | 00001A6C | F773 | WORD | 29687 |
| 490 | 00001A6E | E673 | WORD | 29670 |
| 491 | 00001A70 | D573 | WORD | 29653 |
| 492 | 00001A72 | C473 | WORD | 29636 |
| 493 | 00001A74 | B373 | WORD | 29619 |
| 494 | 00001A76 | A273 | WORD | 29602 |
| 495 | 00001A78 | 9173 | WORD | 29585 |
| 496 | 00001A7A | 7F73 | WORD | 29567 |
| 497 | 00001A7C | 6E73 | WORD | 29550 |
| 498 | 00001A7E | 5D73 | WORD | 29533 |
| 499 | 00001A80 | 4C73 | WORD | 29516 |
| 500 | 00001A82 | 3B73 | WORD | 29499 |
| 501 | 00001A84 | 2A73 | WORD | 29482 |
| 502 | 00001A86 | 1A73 | WORD | 29466 + 500 |
| 503 | 00001A88 | 0873 | WORD | 29448 |
| 504 | 00001A8A | F772 | WORD | 29431 |
| 505 | 00001A8C | E672 | WORD | 29414 |
| 506 | 00001A8E | D572 | WORD | 29397 |
| 507 | 00001A90 | C472 | WORD | 29380 |
| 508 | 00001A92 | B372 | WORD | 29363 |
| 509 | 00001A94 | A272 | WORD | 29346 |
| 510 | 00001A96 | 9172 | WORD | 29329 |
| 511 | 00001A98 | 8072 | WORD | 29312 |
| 512 | 00001A9A | 6F72 | WORD | 29295 |
| 513 | 00001A9C | 5E72 | WORD | 29278 |
| 514 | 00001A9E | 4E72 | WORD | 29262 |
| 515 | 00001AA0 | 3D72 | WORD | 29245 |
| 516 | 00001AA2 | 2C72 | WORD | 29228 |
| 517 | 00001AA4 | 1B72 | WORD | 29211 |
| 518 | 00001AA6 | 0A72 | WORD | 29194 |
| 519 | 00001AA8 | F971 | WORD | 29177 |
| 520 | 00001AAA | E871 | WORD | 29160 |
| 521 | 00001AAC | D771 | WORD | 29143 |
| 522 | 00001AAE | C771 | WORD | 29127 |
| 523 | 00001AB0 | B671 | WORD | 29110 |
| 524 | 00001AB2 | A571 | WORD | 29093 |
| 525 | 00001AB4 | 9471 | WORD | 29076 |
| 526 | 00001AB6 | 8371 | WORD | 29059 |
| 527 | 00001AB8 | 7371 | WORD | 29043 |
| 528 | 00001ABA | 6271 | WORD | 29026 |
| 529 | 00001ABC | 5171 | WORD | 29009 |
| 530 | 00001ABE | 4071 | WORD | 28992 |
| 531 | 00001AC0 | 3071 | WORD | 28976 |
| 532 | 00001AC2 | 2071 | WORD | 28960 |
| 533 | 00001AC4 | 0E71 | WORD | 28942 |
| 534 | 00001AC6 | FD70 | WORD | 28925 |
| 535 | 00001AC8 | ED70 | WORD | 28909 |
| 536 | 00001ACA | DC70 | WORD | 28892 |
| 537 | 00001ACC | CB70 | WORD | 28875 |
| 538 | 00001ACE | BB70 | WORD | 28859 |
| 539 | 00001AD0 | AA70 | WORD | 28842 |
| 540 | 00001AD2 | 9970 | WORD | 28825 |
| 541 | 00001AD4 | 8970 | WORD | 28809 |
| 542 | 00001AD6 | 7870 | WORD | 28792 |
| 543 | 00001AD8 | 6770 | WORD | 28775 |
| 544 | 00001ADA | 5770 | WORD | 28759 |

| | | | | |
|---|---|---|---|---|
| 545 | 00001ADC | 4670 | WORD | 28742 |
| 546 | 00001ADE | 3570 | WORD | 28725 |
| 547 | 00001AE0 | 2570 | WORD | 28709 |
| 548 | 00001AE2 | 1470 | WORD | 28692 |
| 549 | 00001AE4 | 0470 | WORD | 28676 |
| 550 | 00001AE6 | F36F | WORD | 28659 |
| 551 | 00001AE8 | E36F | WORD | 28643 |
| 552 | 00001AEA | D26F | WORD | 28626 |
| 553 | 00001AEC | C26F | WORD | 28610 |
| 554 | 00001AEE | B16F | WORD | 28593 |
| 555 | 00001AF0 | A06F | WORD | 28576 |
| 556 | 00001AF2 | 906F | WORD | 28560 |
| 557 | 00001AF4 | 7F6F | WORD | 28543 |
| 558 | 00001AF6 | 6F6F | WORD | 28527 |
| 559 | 00001AF8 | 5F6F | WORD | 28511 |
| 560 | 00001AFA | 4E6F | WORD | 28494 |
| 561 | 00001AFC | 3E6F | WORD | 28478 |
| 562 | 00001AFE | 2D6F | WORD | 28461 |
| 563 | 00001B00 | 1D6F | WORD | 28445 |
| 564 | 00001B02 | 0C6F | WORD | 28428 |
| 565 | 00001B04 | FC6E | WORD | 28412 |
| 566 | 00001B06 | EB6E | WORD | 28395 |
| 567 | 00001B08 | DB6E | WORD | 28379 |
| 568 | 00001B0A | CB6E | WORD | 28363 |
| 569 | 00001B0C | BA6E | WORD | 28346 |
| 570 | 00001B0E | AA6E | WORD | 28330 |
| 571 | 00001B10 | 9A6E | WORD | 28314 |
| 572 | 00001B12 | 896E | WORD | 28297 |
| 573 | 00001B14 | 796E | WORD | 28281 |
| 574 | 00001B16 | 686E | WORD | 28264 |
| 575 | 00001B18 | 586E | WORD | 28248 |
| 576 | 00001B1A | 486E | WORD | 28232 |
| 577 | 00001B1C | 386E | WORD | 28216 |
| 578 | 00001B1E | 276E | WORD | 28199 |
| 579 | 00001B20 | 176E | WORD | 28183 |
| 580 | 00001B22 | 076E | WORD | 28167 |
| 581 | 00001B24 | F56D | WORD | 28149 |
| 582 | 00001B26 | E66D | WORD | 28134 |
| 583 | 00001B28 | D66D | WORD | 28118 |
| 584 | 00001B2A | C66D | WORD | 28102 |
| 585 | 00001B2C | B56D | WORD | 28085 |
| 586 | 00001B2E | A56D | WORD | 28069 |
| 587 | 00001B30 | 956D | WORD | 28053 |
| 588 | 00001B32 | 856D | WORD | 28037 |
| 589 | 00001B34 | 756D | WORD | 28021 |
| 590 | 00001B36 | 646D | WORD | 28004 |
| 591 | 00001B38 | 546D | WORD | 27988 |
| 592 | 00001B3A | 446D | WORD | 27972 |
| 593 | 00001B3C | 346D | WORD | 27956 |
| 594 | 00001B3E | 246D | WORD | 27940 |
| 595 | 00001B40 | 146D | WORD | 27924 |
| 596 | 00001B42 | 036D | WORD | 27907 |
| 597 | 00001B44 | F36C | WORD | 27891 |
| 598 | 00001B46 | E36C | WORD | 27875 |
| 599 | 00001B48 | D36C | WORD | 27859 |
| 600 | 00001B4A | C36C | WORD | 27843 |

| | | | | | |
|---|---|---|---|---|---|
| 601 | 00001B4C | B36C | WORD | 27827 | |
| 602 | 00001B4E | A36C | WORD | 27811 | + 600 |
| 603 | 00001B50 | 936C | WORD | 27795 | |
| 604 | 00001B52 | 836C | WORD | 27779 | |
| 605 | 00001B54 | 736C | WORD | 27763 | |
| 606 | 00001B56 | 636C | WORD | 27747 | |
| 607 | 00001B58 | 536C | WORD | 27731 | |
| 608 | 00001B5A | 436C | WORD | 27715 | |
| 609 | 00001B5C | 336C | WORD | 27699 | |
| 610 | 00001B5E | 236C | WORD | 27683 | |
| 611 | 00001B60 | 136C | WORD | 27667 | |
| 612 | 00001B62 | 036C | WORD | 27651 | |
| 613 | 00001B64 | F36B | WORD | 27635 | |
| 614 | 00001B66 | E36B | WORD | 27619 | |
| 615 | 00001B68 | D36B | WORD | 27603 | |
| 616 | 00001B6A | C36B | WORD | 27587 | |
| 617 | 00001B6C | B36B | WORD | 27571 | |
| 618 | 00001B6E | A36B | WORD | 27555 | |
| 619 | 00001B70 | 936B | WORD | 27539 | |
| 620 | 00001B72 | 836B | WORD | 27523 | |
| 621 | 00001B74 | 736B | WORD | 27507 | |
| 622 | 00001B76 | 636B | WORD | 27491 | |
| 623 | 00001B78 | 536B | WORD | 27475 | |
| 624 | 00001B7A | 446B | WORD | 27460 | |
| 625 | 00001B7C | 346B | WORD | 27444 | |
| 626 | 00001B7E | 246B | WORD | 27428 | |
| 627 | 00001B80 | 146B | WORD | 27412 | |
| 628 | 00001B82 | 046B | WORD | 27396 | |
| 629 | 00001B84 | F46A | WORD | 27380 | |
| 630 | 00001B86 | E56A | WORD | 27365 | |
| 631 | 00001B88 | D56A | WORD | 27349 | |
| 632 | 00001B8A | C56A | WORD | 27333 | |
| 633 | 00001B8C | B56A | WORD | 27317 | |
| 634 | 00001B8E | A56A | WORD | 27301 | |
| 635 | 00001B90 | 966A | WORD | 27286 | |
| 636 | 00001B92 | 866A | WORD | 27270 | |
| 637 | 00001B94 | 766A | WORD | 27254 | |
| 638 | 00001B96 | 666A | WORD | 27238 | |
| 639 | 00001B98 | 576A | WORD | 27223 | |
| 640 | 00001B9A | 476A | WORD | 27207 | |
| 641 | 00001B9C | 376A | WORD | 27191 | |
| 642 | 00001B9E | 286A | WORD | 27176 | |
| 643 | 00001BA0 | 186A | WORD | 27160 | |
| 644 | 00001BA2 | 086A | WORD | 27144 | |
| 645 | 00001BA4 | F869 | WORD | 27128 | |
| 646 | 00001BA6 | E969 | WORD | 27113 | |
| 647 | 00001BA8 | D969 | WORD | 27097 | |
| 648 | 00001BAA | CA69 | WORD | 27082 | |
| 649 | 00001BAC | BB69 | WORD | 27067 | |
| 650 | 00001BAE | AB69 | WORD | 27051 | |
| 651 | 00001BB0 | 9C69 | WORD | 27036 | |
| 652 | 00001BB2 | 8C69 | WORD | 27020 | |
| 653 | 00001BB4 | 7C69 | WORD | 27004 | |
| 654 | 00001BB6 | 6D69 | WORD | 26989 | |
| 655 | 00001BB8 | 5D69 | WORD | 26973 | |
| 656 | 00001BBA | 4E69 | WORD | 26958 | |

| | | | | |
|---|---|---|---|---|
| 657 | 00001BBC | 3E69 | WORD | 26942 |
| 658 | 00001BBE | 2E69 | WORD | 26926 |
| 659 | 00001BC0 | 1F69 | WORD | 26911 |
| 660 | 00001BC2 | 0F69 | WORD | 26895 |
| 661 | 00001BC4 | 0069 | WORD | 26880 |
| 662 | 00001BC6 | F068 | WORD | 26864 |
| 663 | 00001BC8 | E168 | WORD | 26849 |
| 664 | 00001BCA | D168 | WORD | 26833 |
| 665 | 00001BCC | C268 | WORD | 26818 |
| 666 | 00001BCE | B268 | WORD | 26802 |
| 667 | 00001BD0 | A368 | WORD | 26787 |
| 668 | 00001BD2 | 9368 | WORD | 26771 |
| 669 | 00001BD4 | 8468 | WORD | 26756 |
| 670 | 00001BD6 | 7468 | WORD | 26740 |
| 671 | 00001BD8 | 6568 | WORD | 26725 |
| 672 | 00001BDA | 5568 | WORD | 26709 |
| 673 | 00001BDC | 4668 | WORD | 26694 |
| 674 | 00001BDE | 3668 | WORD | 26678 |
| 675 | 00001BE0 | 2668 | WORD | 26662 |
| 676 | 00001BE2 | 1768 | WORD | 26647 |
| 677 | 00001BE4 | 0768 | WORD | 26631 |
| 678 | 00001BE6 | F867 | WORD | 26616 |
| 679 | 00001BE8 | E967 | WORD | 26601 |
| 680 | 00001BEA | D967 | WORD | 26585 |
| 681 | 00001BEC | CA67 | WORD | 26570 |
| 682 | 00001BEE | BB67 | WORD | 26555 |
| 683 | 00001BF0 | AB67 | WORD | 26539 |
| 684 | 00001BF2 | 9C67 | WORD | 26524 |
| 685 | 00001BF4 | 8D67 | WORD | 26509 |
| 686 | 00001BF6 | 7D67 | WORD | 26493 |
| 687 | 00001BF8 | 6E67 | WORD | 26478 |
| 688 | 00001BFA | 5F67 | WORD | 26463 |
| 689 | 00001BFC | 4F67 | WORD | 26447 |
| 690 | 00001BFE | 4067 | WORD | 26432 |
| 691 | 00001C00 | 3167 | WORD | 26417 |
| 692 | 00001C02 | 2267 | WORD | 26402 |
| 693 | 00001C04 | 1267 | WORD | 26386 |
| 694 | 00001C06 | 0367 | WORD | 26371 |
| 695 | 00001C08 | F466 | WORD | 26356 |
| 696 | 00001C0A | E566 | WORD | 26341 |
| 697 | 00001C0C | D566 | WORD | 26325 |
| 698 | 00001C0E | C666 | WORD | 26310 |
| 699 | 00001C10 | B766 | WORD | 26295 |
| 700 | 00001C12 | A866 | WORD | 26280 |
| 701 | 00001C14 | 9966 | WORD | 26265 |
| 702 | 00001C16 | 8A66 | WORD | 26250 + 700 |
| 703 | 00001C18 | 7A66 | WORD | 26234 |
| 704 | 00001C1A | 6B66 | WORD | 26219 |
| 705 | 00001C1C | 5C66 | WORD | 26204 |
| 706 | 00001C1E | 4C66 | WORD | 26188 |
| 707 | 00001C20 | 3E66 | WORD | 26174 |
| 708 | 00001C22 | 2F66 | WORD | 26159 |
| 709 | 00001C24 | 2066 | WORD | 26144 |
| 710 | 00001C26 | 1066 | WORD | 26128 |
| 711 | 00001C28 | 0166 | WORD | 26113 |
| 712 | 00001C2A | F265 | WORD | 26098 |

| | | | | |
|---|---|---|---|---|
| 713 | 00001C2C | E365 | WORD | 26083 |
| 714 | 00001C2E | D465 | WORD | 26068 |
| 715 | 00001C30 | C565 | WORD | 26053 |
| 716 | 00001C32 | B665 | WORD | 26038 |
| 717 | 00001C34 | A765 | WORD | 26023 |
| 718 | 00001C36 | 9865 | WORD | 26008 |
| 719 | 00001C38 | 8965 | WORD | 25993 |
| 720 | 00001C3A | 7A65 | WORD | 25978 |
| 721 | 00001C3C | 6B65 | WORD | 25963 |
| 722 | 00001C3E | 5C65 | WORD | 25948 |
| 723 | 00001C40 | 4D65 | WORD | 25933 |
| 724 | 00001C42 | 3E65 | WORD | 25918 |
| 725 | 00001C44 | 2F65 | WORD | 25903 |
| 726 | 00001C46 | 2165 | WORD | 25889 |
| 727 | 00001C48 | 1265 | WORD | 25874 |
| 728 | 00001C4A | 0365 | WORD | 25859 |
| 729 | 00001C4C | F464 | WORD | 25844 |
| 730 | 00001C4E | E564 | WORD | 25829 |
| 731 | 00001C50 | D664 | WORD | 25814 |
| 732 | 00001C52 | C764 | WORD | 25799 |
| 733 | 00001C54 | B964 | WORD | 25785 |
| 734 | 00001C56 | AA64 | WORD | 25770 |
| 735 | 00001C58 | 9B64 | WORD | 25755 |
| 736 | 00001C5A | 8C64 | WORD | 25740 |
| 737 | 00001C5C | 7D64 | WORD | 25725 |
| 738 | 00001C5E | 6E64 | WORD | 25710 |
| 739 | 00001C60 | 5F64 | WORD | 25695 |
| 740 | 00001C62 | 5064 | WORD | 25680 |
| 741 | 00001C64 | 4264 | WORD | 25666 |
| 742 | 00001C66 | 3364 | WORD | 25651 |
| 743 | 00001C68 | 2464 | WORD | 25636 |
| 744 | 00001C6A | 1564 | WORD | 25621 |
| 745 | 00001C6C | 0664 | WORD | 25606 |
| 746 | 00001C6E | F863 | WORD | 25592 |
| 747 | 00001C70 | E963 | WORD | 25577 |
| 748 | 00001C72 | DA63 | WORD | 25562 |
| 749 | 00001C74 | CB63 | WORD | 25547 |
| 750 | 00001C76 | BC63 | WORD | 25532 |
| 751 | 00001C78 | AE63 | WORD | 25518 |
| 752 | 00001C7A | 9E63 | WORD | 25502 |
| 753 | 00001C7C | 9063 | WORD | 25488 |
| 754 | 00001C7E | 8263 | WORD | 25474 |
| 755 | 00001C80 | 7363 | WORD | 25459 |
| 756 | 00001C82 | 6463 | WORD | 25444 |
| 757 | 00001C84 | 5563 | WORD | 25429 |
| 758 | 00001C86 | 4763 | WORD | 25415 |
| 759 | 00001C88 | 3863 | WORD | 25400 |
| 760 | 00001C8A | 2963 | WORD | 25385 |
| 761 | 00001C8C | 1B63 | WORD | 25371 |
| 762 | 00001C8E | 0C63 | WORD | 25356 |
| 763 | 00001C90 | FD62 | WORD | 25341 |
| 764 | 00001C92 | EF62 | WORD | 25327 |
| 765 | 00001C94 | E062 | WORD | 25312 |
| 766 | 00001C96 | D262 | WORD | 25298 |
| 767 | 00001C98 | C362 | WORD | 25283 |
| 768 | 00001C9A | B462 | WORD | 25268 |

| | | | | |
|---|---|---|---|---|
| 769 | 00001C9C | A662 | WORD | 25254 |
| 770 | 00001C9E | 9762 | WORD | 25239 |
| 771 | 00001CA0 | 8962 | WORD | 25225 |
| 772 | 00001CA2 | 7A62 | WORD | 25210 |
| 773 | 00001CA4 | 6B62 | WORD | 25195 |
| 774 | 00001CA6 | 5D62 | WORD | 25181 |
| 775 | 00001CA8 | 4E62 | WORD | 25166 |
| 776 | 00001CAA | 4062 | WORD | 25152 |
| 777 | 00001CAC | 3162 | WORD | 25137 |
| 778 | 00001CAE | 2362 | WORD | 25123 |
| 779 | 00001CB0 | 1462 | WORD | 25108 |
| 780 | 00001CB2 | 0662 | WORD | 25094 |
| 781 | 00001CB4 | F761 | WORD | 25079 |
| 782 | 00001CB6 | E961 | WORD | 25065 |
| 783 | 00001CB8 | DA61 | WORD | 25050 |
| 784 | 00001CBA | CC61 | WORD | 25036 |
| 785 | 00001CBC | BD61 | WORD | 25021 |
| 786 | 00001CBE | AF61 | WORD | 25007 |
| 787 | 00001CC0 | A061 | WORD | 24992 |
| 788 | 00001CC2 | 9261 | WORD | 24978 |
| 789 | 00001CC4 | 8461 | WORD | 24964 |
| 790 | 00001CC6 | 7561 | WORD | 24949 |
| 791 | 00001CC8 | 6761 | WORD | 24935 |
| 792 | 00001CCA | 5861 | WORD | 24920 |
| 793 | 00001CCC | 4A61 | WORD | 24906 |
| 794 | 00001CCE | 3C61 | WORD | 24892 |
| 795 | 00001CD0 | 2D61 | WORD | 24877 |
| 796 | 00001CD2 | 1F61 | WORD | 24863 |
| 797 | 00001CD4 | 1061 | WORD | 24848 |
| 798 | 00001CD6 | 0261 | WORD | 24834 |
| 799 | 00001CD8 | F460 | WORD | 24820 |
| 800 | 00001CDA | E560 | WORD | 24805 |
| 801 | 00001CDC | D760 | WORD | 24791 |
| 802 | 00001CDE | C960 | WORD | 24777 + 800 |
| 803 | 00001CE0 | BA60 | WORD | 24762 |
| 804 | 00001CE2 | AC60 | WORD | 24748 |
| 805 | 00001CE4 | 9E60 | WORD | 24734 |
| 806 | 00001CE6 | 9060 | WORD | 24720 |
| 807 | 00001CE8 | 8160 | WORD | 24705 |
| 808 | 00001CEA | 7360 | WORD | 24691 |
| 809 | 00001CEC | 6560 | WORD | 24677 |
| 810 | 00001CEE | 5760 | WORD | 24663 |
| 811 | 00001CF0 | 4860 | WORD | 24648 |
| 812 | 00001CF2 | 3A60 | WORD | 24634 |
| 813 | 00001CF4 | 2C60 | WORD | 24620 |
| 814 | 00001CF6 | 1E60 | WORD | 24606 |
| 815 | 00001CF8 | 0F60 | WORD | 24591 |
| 816 | 00001CFA | 0160 | WORD | 24577 |
| 817 | 00001CFC | F35F | WORD | 24563 |
| 818 | 00001CFE | E55F | WORD | 24549 |
| 819 | 00001D00 | D75F | WORD | 24535 |
| 820 | 00001D02 | C85F | WORD | 24520 |
| 821 | 00001D04 | BA5F | WORD | 24506 |
| 822 | 00001D06 | AC5F | WORD | 24492 |
| 823 | 00001D08 | 9E5F | WORD | 24478 |
| 824 | 00001D0A | 905F | WORD | 24464 |

```
825  00001D0C 825F
826  00001D0E 745F
827  00001D10 655F
828  00001D12 575F
829  00001D14 495F
830  00001D16 3B5F
831  00001D18 2D5F
832  00001D1A 1F5F
```

```
WORD   24450
WORD   24436
WORD   24421
WORD   24407
WORD   24393
WORD   24379
WORD   24365
WORD   24351
WORD   24337
WORD   24323
WORD   24309
WORD   24295
WORD   24281
WORD   24267
WORD   24253
WORD   24239
WORD   24225
WORD   24211
WORD   24197
WORD   24183
WORD   24169
WORD   24155
WORD   24141
WORD   24127
WORD   24113
WORD   24099
WORD   24085
WORD   24071
WORD   24057
WORD   24043
WORD   24030
WORD   24016
WORD   24002
WORD   23988
WORD   23974
WORD   23960
WORD   23946
WORD   23933
WORD   23919
WORD   23905
WORD   23891
WORD   23877
WORD   23863
WORD   23850
WORD   23836
WORD   23822
WORD   23808
WORD   23795
WORD   23781
WORD   23767
WORD   23753
WORD   23740
WORD   23727
WORD   23712
WORD   23699
WORD   23685
```

| | | | | |
|---|---|---|---|---|
| | | | WORD | 23671 |
| | | | WORD | 23658 |
| | | | WORD | 23644 |
| | | | WORD | 23630 |
| 885 | 00001D84 | 415C | WORD | 23617 |
| 886 | 00001D86 | 335C | WORD | 23603 |
| 887 | 00001D88 | 255C | WORD | 23589 |
| 888 | 00001D8A | 185C | WORD | 23576 |
| 889 | 00001D8C | 0B5C | WORD | 23563 |
| 890 | 00001D8E | FC5B | WORD | 23548 |
| 891 | 00001D90 | EF5B | WORD | 23535 |
| 892 | 00001D92 | E15B | WORD | 23521 |
| 893 | 00001D94 | D45B | WORD | 23508 |
| 894 | 00001D96 | C65B | WORD | 23494 |
| 895 | 00001D98 | B95B | WORD | 23481 |
| 896 | 00001D9A | AB5B | WORD | 23467 |
| 897 | 00001D9C | 9D5B | WORD | 23453 |
| 898 | 00001D9E | 905B | WORD | 23440 |
| 899 | 00001DA0 | 835B | WORD | 23427 |
| 900 | 00001DA2 | 755B | WORD | 23413 |
| 901 | 00001DA4 | 675B | WORD | 23399 |
| 902 | 00001DA6 | 5B5B | WORD | 23387 + 900 |
| 903 | 00001DA8 | 4C5B | WORD | 23372 |
| 904 | 00001DAA | 3F5B | WORD | 23359 |
| 905 | 00001DAC | 315B | WORD | 23345 |
| 906 | 00001DAE | 245B | WORD | 23332 |
| 907 | 00001DB0 | 165B | WORD | 23318 |
| 908 | 00001DB2 | 095B | WORD | 23305 |
| 909 | 00001DB4 | FB5A | WORD | 23291 |
| 910 | 00001DB6 | EE5A | WORD | 23278 |
| 911 | 00001DB8 | E05A | WORD | 23264 |
| 912 | 00001DBA | D35A | WORD | 23251 |
| 913 | 00001DBC | C65A | WORD | 23238 |
| 914 | 00001DBE | B85A | WORD | 23224 |
| 915 | 00001DC0 | AB5A | WORD | 23211 |
| 916 | 00001DC2 | 9D5A | WORD | 23197 |
| 917 | 00001DC4 | 905A | WORD | 23184 |
| 918 | 00001DC6 | 835A | WORD | 23171 |
| 919 | 00001DC8 | 755A | WORD | 23157 |
| 920 | 00001DCA | 685A | WORD | 23144 |
| 921 | 00001DCC | 5A5A | WORD | 23130 |
| 922 | 00001DCE | 4D5A | WORD | 23117 |
| 923 | 00001DD0 | 405A | WORD | 23104 |
| 924 | 00001DD2 | 325A | WORD | 23090 |
| 925 | 00001DD4 | 255A | WORD | 23077 |
| 926 | 00001DD6 | 185A | WORD | 23064 |
| 927 | 00001DD8 | 0A5A | WORD | 23050 |
| 928 | 00001DDA | FD59 | WORD | 23037 |
| 929 | 00001DDC | F059 | WORD | 23024 |
| 930 | 00001DDE | E259 | WORD | 23010 |
| 931 | 00001DE0 | D559 | WORD | 22997 |
| 932 | 00001DE2 | C859 | WORD | 22984 |
| 933 | 00001DE4 | BB59 | WORD | 22971 |
| 934 | 00001DE6 | AD59 | WORD | 22957 |
| 935 | 00001DE8 | A059 | WORD | 22944 |
| 936 | 00001DEA | 9359 | WORD | 22931 |

| | | | |
|---|---|---|---|
| 937 | 00001DEC 8659 | WORD | 22918 |
| 938 | 00001DEE 7859 | WORD | 22904 |
| 939 | 00001DF0 6B59 | WORD | 22891 |
| 940 | 00001DF2 5E59 | WORD | 22878 |
| 941 | 00001DF4 5159 | WORD | 22865 |
| 942 | 00001DF6 4359 | WORD | 22851 |
| 943 | 00001DF8 3659 | WORD | 22838 |
| 944 | 00001DFA 2959 | WORD | 22825 |
| 945 | 00001DFC 1C59 | WORD | 22812 |
| 946 | 00001DFE 0F59 | WORD | 22799 |
| 947 | 00001E00 0259 | WORD | 22786 |
| 948 | 00001E02 F458 | WORD | 22772 |
| 949 | 00001E04 E758 | WORD | 22759 |
| 950 | 00001E06 DA58 | WORD | 22746 |
| 951 | 00001E08 CD58 | WORD | 22733 |
| 952 | 00001E0A C058 | WORD | 22720 |
| 953 | 00001E0C B358 | WORD | 22707 |
| 954 | 00001E0E A658 | WORD | 22694 |
| 955 | 00001E10 9858 | WORD | 22680 |
| 956 | 00001E12 8B58 | WORD | 22667 |
| 957 | 00001E14 7E58 | WORD | 22654 |
| 958 | 00001E16 7158 | WORD | 22641 |
| 959 | 00001E18 6458 | WORD | 22628 |
| 960 | 00001E1A 5758 | WORD | 22615 |
| 961 | 00001E1C 4A58 | WORD | 22602 |
| 962 | 00001E1E 3D58 | WORD | 22589 |
| 963 | 00001E20 3058 | WORD | 22576 |
| 964 | 00001E22 2358 | WORD | 22563 |
| 965 | 00001E24 1658 | WORD | 22550 |
| 966 | 00001E26 0958 | WORD | 22537 |
| 967 | 00001E28 FC57 | WORD | 22524 |
| 968 | 00001E2A F057 | WORD | 22512 |
| 969 | 00001E2C E357 | WORD | 22499 |
| 970 | 00001E2E D657 | WORD | 22486 |
| 971 | 00001E30 C957 | WORD | 22473 |
| 972 | 00001E32 BC57 | WORD | 22460 |
| 973 | 00001E34 7F5F | WORD | 24447 |
| 974 | 00001E36 A257 | WORD | 22434 |
| 975 | 00001E38 9557 | WORD | 22421 |
| 976 | 00001E3A 8857 | WORD | 22408 |
| 977 | 00001E3C 7B57 | WORD | 22395 |
| 978 | 00001E3E 6E57 | WORD | 22382 |
| 979 | 00001E40 6157 | WORD | 22369 |
| 980 | 00001E42 5457 | WORD | 22356 |
| 981 | 00001E44 4757 | WORD | 22343 |
| 982 | 00001E46 3A57 | WORD | 22330 |
| 983 | 00001E48 2D57 | WORD | 22317 |
| 984 | 00001E4A 2157 | WORD | 22305 |
| 985 | 00001E4C 1457 | WORD | 22292 |
| 986 | 00001E4E 0757 | WORD | 22279 |
| 987 | 00001E50 FA56 | WORD | 22266 |
| 988 | 00001E52 ED56 | WORD | 22253 |
| 989 | 00001E54 E056 | WORD | 22240 |
| 990 | 00001E56 D356 | WORD | 22227 |
| 991 | 00001E58 C756 | WORD | 22215 |
| 992 | 00001E5A BA56 | WORD | 22202 |

| | | | | |
|---|---|---|---|---|
| 993 | 00001E5C | AD56 | WORD | 22189 |
| 994 | 00001E5E | A056 | WORD | 22176 |
| 995 | 00001E60 | 9356 | WORD | 22163 |
| 996 | 00001E62 | 8656 | WORD | 22150 |
| 997 | 00001E64 | 7A56 | WORD | 22138 |
| 998 | 00001E66 | 6D56 | WORD | 22125 |
| 999 | 00001E68 | 6056 | WORD | 22112 |
| 1000 | 00001E6A | 5356 | WORD | 22099 |
| 1001 | 00001E6C | 4756 | WORD | 22087 |
| 1002 | 00001E6E | 3A56 | WORD | 22074 +1000 |
| 1003 | 00001E70 | 2D56 | WORD | 22061 |
| 1004 | 00001E72 | 2056 | WORD | 22048 |
| 1005 | 00001E74 | 1456 | WORD | 22036 |
| 1006 | 00001E76 | 0756 | WORD | 22023 |
| 1007 | 00001E78 | FA55 | WORD | 22010 |
| 1008 | 00001E7A | ED55 | WORD | 21997 |
| 1009 | 00001E7C | E155 | WORD | 21985 |
| 1010 | 00001E7E | D455 | WORD | 21972 |
| 1011 | 00001E80 | C755 | WORD | 21959 |
| 1012 | 00001E82 | BB55 | WORD | 21947 |
| 1013 | 00001E84 | AE55 | WORD | 21934 |
| 1014 | 00001E86 | A155 | WORD | 21921 |
| 1015 | 00001E88 | 9555 | WORD | 21909 |
| 1016 | 00001E8A | 8855 | WORD | 21896 |
| 1017 | 00001E8C | 7B55 | WORD | 21883 |
| 1018 | 00001E8E | 6F55 | WORD | 21871 |
| 1019 | 00001E90 | 6255 | WORD | 21858 |
| 1020 | 00001E92 | 5555 | WORD | 21845 |
| 1021 | 00001E94 | 4955 | WORD | 21833 |
| 1022 | 00001E96 | 3C55 | WORD | 21820 |
| 1023 | 00001E98 | 3055 | WORD | 21808 |
| 1024 | 00001E9A | 2355 | WORD | 21795 |
| 1025 | 00001E9C | 1655 | WORD | 21782 |
| 1026 | 00001E9E | 0A55 | WORD | 21770 |
| 1027 | 00001EA0 | FD54 | WORD | 21757 |
| 1028 | 00001EA2 | F154 | WORD | 21745 |
| 1029 | 00001EA4 | E454 | WORD | 21732 |
| 1030 | 00001EA6 | D854 | WORD | 21720 |
| 1031 | 00001EA8 | CB54 | WORD | 21707 |
| 1032 | 00001EAA | BE54 | WORD | 21694 |
| 1033 | 00001EAC | B254 | WORD | 21682 |
| 1034 | 00001EAE | A554 | WORD | 21669 |
| 1035 | 00001EB0 | 9954 | WORD | 21657 |
| 1036 | 00001EB2 | 8C54 | WORD | 21644 |
| 1037 | 00001EB4 | 8054 | WORD | 21632 |
| 1038 | 00001EB6 | 7354 | WORD | 21619 |
| 1039 | 00001EB8 | 6754 | WORD | 21607 |
| 1040 | 00001EBA | 5A54 | WORD | 21594 |
| 1041 | 00001EBC | 4E54 | WORD | 21582 |
| 1042 | 00001EBE | 4154 | WORD | 21569 |
| 1043 | 00001EC0 | 3554 | WORD | 21557 |
| 1044 | 00001EC2 | 2954 | WORD | 21545 |
| 1045 | 00001EC4 | 1C54 | WORD | 21532 |
| 1046 | 00001EC6 | 1054 | WORD | 21520 |
| 1047 | 00001EC8 | 0354 | WORD | 21507 |
| 1048 | 00001ECA | F753 | WORD | 21495 |

| | | | | |
|---|---|---|---|---|
| 1049 | 00001ECC | EA53 | WORD | 21482 |
| 1050 | 00001ECE | DE53 | WORD | 21470 |
| 1051 | 00001ED0 | D253 | WORD | 21458 |
| 1052 | 00001ED2 | C553 | WORD | 21445 |
| 1053 | 00001ED4 | B953 | WORD | 21433 |
| 1054 | 00001ED6 | AC53 | WORD | 21420 |
| 1055 | 00001ED8 | A053 | WORD | 21408 |
| 1056 | 00001EDA | 9453 | WORD | 21396 |
| 1057 | 00001EDC | 8753 | WORD | 21383 |
| 1058 | 00001EDE | 7B53 | WORD | 21371 |
| 1059 | 00001EE0 | 6F53 | WORD | 21359 |
| 1060 | 00001EE2 | 6253 | WORD | 21346 |
| 1061 | 00001EE4 | 5653 | WORD | 21334 |
| 1062 | 00001EE6 | 4A53 | WORD | 21322 |
| 1063 | 00001EE8 | 3D53 | WORD | 21309 |
| 1064 | 00001EEA | 3153 | WORD | 21297 |
| 1065 | 00001EEC | 2553 | WORD | 21285 |
| 1066 | 00001EEE | 1853 | WORD | 21272 |
| 1067 | 00001EF0 | 0C53 | WORD | 21260 |
| 1068 | 00001EF2 | 0053 | WORD | 21248 |
| 1069 | 00001EF4 | F452 | WORD | 21236 |
| 1070 | 00001EF6 | E752 | WORD | 21223 |
| 1071 | 00001EF8 | DB52 | WORD | 21211 |
| 1072 | 00001EFA | CF52 | WORD | 21199 |
| 1073 | 00001EFC | C352 | WORD | 21187 |
| 1074 | 00001EFE | B652 | WORD | 21174 |
| 1075 | 00001F00 | AA52 | WORD | 21162 |
| 1076 | 00001F02 | 9E52 | WORD | 21150 |
| 1077 | 00001F04 | 9252 | WORD | 21138 |
| 1078 | 00001F06 | 8552 | WORD | 21125 |
| 1079 | 00001F08 | 7952 | WORD | 21113 |
| 1080 | 00001F0A | 6D52 | WORD | 21101 |
| 1081 | 00001F0C | 6152 | WORD | 21089 |
| 1082 | 00001F0E | 5552 | WORD | 21077 |
| 1083 | 00001F10 | 4852 | WORD | 21064 |
| 1084 | 00001F12 | 3C52 | WORD | 21052 |
| 1085 | 00001F14 | 3052 | WORD | 21040 |
| 1086 | 00001F16 | 2452 | WORD | 21028 |
| 1087 | 00001F18 | 1852 | WORD | 21016 |
| 1088 | 00001F1A | 0C52 | WORD | 21004 |
| 1089 | 00001F1C | 0052 | WORD | 20992 |
| 1090 | 00001F1E | F351 | WORD | 20979 |
| 1091 | 00001F20 | E751 | WORD | 20967 |
| 1092 | 00001F22 | DB51 | WORD | 20955 |
| 1093 | 00001F24 | CF51 | WORD | 20943 |
| 1094 | 00001F26 | C351 | WORD | 20931 |
| 1095 | 00001F28 | B751 | WORD | 20919 |
| 1096 | 00001F2A | AB51 | WORD | 20907 |
| 1097 | 00001F2C | 9F51 | WORD | 20895 |
| 1098 | 00001F2E | 9251 | WORD | 20882 |
| 1099 | 00001F30 | 8751 | WORD | 20871 |
| 1100 | 00001F32 | 7B51 | WORD | 20859 |
| 1101 | 00001F34 | 6F51 | WORD | 20847 |
| 1102 | 00001F36 | 6351 | WORD | 20835 + 1100 |
| 1103 | 00001F38 | 5651 | WORD | 20822 |
| 1104 | 00001F3A | 4A51 | WORD | 20810 |
| 1105 | 00001F3C | 3E51 | WORD | 20798 |

| | | | | |
|---|---|---|---|---|
| 1106 | 00001F3E | 3251 | WORD | 20786 |
| 1107 | 00001F40 | 2651 | WORD | 20774 |
| 1108 | 00001F42 | 1A51 | WORD | 20762 |
| 1109 | 00001F44 | 0E51 | WORD | 20750 |
| 1110 | 00001F46 | 0251 | WORD | 20738 |
| 1111 | 00001F48 | F650 | WORD | 20726 |
| 1112 | 00001F4A | EA50 | WORD | 20714 |
| 1113 | 00001F4C | DE50 | WORD | 20702 |
| 1114 | 00001F4E | D350 | WORD | 20691 |
| 1115 | 00001F50 | C750 | WORD | 20679 |
| 1116 | 00001F52 | BB50 | WORD | 20667 |
| 1117 | 00001F54 | AF50 | WORD | 20655 |
| 1118 | 00001F56 | A350 | WORD | 20643 |
| 1119 | 00001F58 | 9750 | WORD | 20631 |
| 1120 | 00001F5A | 8B50 | WORD | 20619 |
| 1121 | 00001F5C | 7F50 | WORD | 20607 |
| 1122 | 00001F5E | 7350 | WORD | 20595 |
| 1123 | 00001F60 | 6750 | WORD | 20583 |
| 1124 | 00001F62 | 5B50 | WORD | 20571 |
| 1125 | 00001F64 | 4F50 | WORD | 20559 |
| 1126 | 00001F66 | 4450 | WORD | 20548 |
| 1127 | 00001F68 | 3850 | WORD | 20536 |
| 1128 | 00001F6A | 2C50 | WORD | 20524 |
| 1129 | 00001F6C | 2050 | WORD | 20512 |
| 1130 | 00001F6E | 1450 | WORD | 20500 |
| 1131 | 00001F70 | 0850 | WORD | 20488 |
| 1132 | 00001F72 | FC4F | WORD | 20476 |
| 1133 | 00001F74 | F14F | WORD | 20465 |
| 1134 | 00001F76 | E54F | WORD | 20453 |
| 1135 | 00001F78 | D94F | WORD | 20441 |
| 1136 | 00001F7A | CD4F | WORD | 20429 |
| 1137 | 00001F7C | C14F | WORD | 20417 |
| 1138 | 00001F7E | B64F | WORD | 20406 |
| 1139 | 00001F80 | AA4F | WORD | 20394 |
| 1140 | 00001F82 | 9E4F | WORD | 20382 |
| 1141 | 00001F84 | 924F | WORD | 20370 |
| 1142 | 00001F86 | 864F | WORD | 20358 |
| 1143 | 00001F88 | 7B4F | WORD | 20347 |
| 1144 | 00001F8A | 6F4F | WORD | 20335 |
| 1145 | 00001F8C | 634F | WORD | 20323 |
| 1146 | 00001F8E | 574F | WORD | 20311 |
| 1147 | 00001F90 | 4C4F | WORD | 20300 |
| 1148 | 00001F92 | 404F | WORD | 20288 |
| 1149 | 00001F94 | 344F | WORD | 20276 |
| 1150 | 00001F96 | 294F | WORD | 20265 |
| 1151 | 00001F98 | 1D4F | WORD | 20253 |
| 1152 | 00001F9A | 114F | WORD | 20241 |
| 1153 | 00001F9C | 064F | WORD | 20230 |
| 1154 | 00001F9E | FA4E | WORD | 20218 |
| 1155 | 00001FA0 | EE4E | WORD | 20206 |
| 1156 | 00001FA2 | E24E | WORD | 20194 |
| 1157 | 00001FA4 | D74E | WORD | 20183 |
| 1158 | 00001FA6 | CB4E | WORD | 20171 |
| 1159 | 00001FA8 | BF4E | WORD | 20159 |
| 1160 | 00001FAA | B44E | WORD | 20148 |
| 1161 | 00001FAC | A84E | WORD | 20136 |

| | | | | |
|---|---|---|---|---|
| 1162 | 00001FAE 9D4E | | WORD | 20125 |
| 1163 | 00001FB0 914E | | WORD | 20113 |
| 1164 | 00001FB2 854E | | WORD | 20101 |
| 1165 | 00001FB4 7A4E | | WORD | 20090 |
| 1166 | 00001FB6 6E4E | | WORD | 20078 |
| 1167 | 00001FB8 634E | | WORD | 20067 |
| 1168 | 00001FBA 574E | | WORD | 20055 |
| 1169 | 00001FBC 4B4E | | WORD | 20043 |
| 1170 | 00001FBE 404E | | WORD | 20032 |
| 1171 | 00001FC0 344E | | WORD | 20020 |
| 1172 | 00001FC2 294E | | WORD | 20009 |
| 1173 | 00001FC4 1D4E | | WORD | 19997 |
| 1174 | 00001FC6 124E | | WORD | 19986 |
| 1175 | 00001FC8 064E | | WORD | 19974 |
| 1176 | 00001FCA FA4D | | WORD | 19962 |
| 1177 | 00001FCC EF4D | | WORD | 19951 |
| 1178 | 00001FCE E34D | | WORD | 19939 |
| 1179 | 00001FD0 D94D | | WORD | 19929 |
| 1180 | 00001FD2 CC4D | | WORD | 19916 |
| 1181 | 00001FD4 C14D | | WORD | 19905 |
| 1182 | 00001FD6 B54D | | WORD | 19893 |
| 1183 | 00001FD8 AA4D | | WORD | 19882 |
| 1184 | 00001FDA 9E4D | | WORD | 19870 |
| 1185 | 00001FDC 934D | | WORD | 19859 |
| 1186 | 00001FDE 874D | | WORD | 19847 |
| 1187 | 00001FE0 7C4D | | WORD | 19836 |
| 1188 | 00001FE2 714D | | WORD | 19825 |
| 1189 | 00001FE4 654D | | WORD | 19813 |
| 1190 | 00001FE6 5A4D | | WORD | 19802 |
| 1191 | 00001FE8 4E4D | | WORD | 19790 |
| 1192 | 00001FEA 434D | | WORD | 19779 |
| 1193 | 00001FEC 374D | | WORD | 19767 |
| 1194 | 00001FEE 2C4D | | WORD | 19756 |
| 1195 | 00001FF0 204D | | WORD | 19744 |
| 1196 | 00001FF2 154D | | WORD | 19733 |
| 1197 | 00001FF4 0A4D | | WORD | 19722 |
| 1198 | 00001FF6 FE4C | | WORD | 19710 |
| 1199 | 00001FF8 F34C | | WORD | 19699 |
| 1200 | 00001FFA E84C | | WORD | 19688 |
| 1201 | 00001FFC DC4C | | WORD | 19676 |
| 1202 | 00001FFE D14C | ROMTMAX | WORD | 19665 + 1200 |

The above description and the accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

I claim:

1. An apparatus for identifying the octave, note and degree of sharpness or flatness of a musical sound, comprising:

(a) a transducer means for converting said sound into an electrical signal;

(b) a filter means, responsive to said electrical signal provided by said transducer means, for sweeping a plurality of frequencies to pass a filter output signal having a frequency corresponding to a frequency of said electrical signal;

(c) a microprocessor means;

(d) a fundamental detection means, cooperating with said microprocessor means, for analyzing said filter output signal to identify when said frequency of said filter output signal corresponds to the fundamental frequency of said electrical signal and for providing a fundamental detection signal indicating such correspondence, (e) means for maintaining said filter means, responsive to said fundamental detection signal, at a particular scanning frequency at which said frequency of said filter output signal corresponds to said fundamental frequency;

(f) a square wave generator means, responsive to said frequency of said filter output signal corresponding to said fundamental frequency, for providing a square wave output signal having a same period as said filter output signal;

(g) a logic circuit means, responsive to said square wave output signal, for providing an output indicating a period of said square wave output signal;

(h) said microprocessor means comprising means for comparing said output from said logic means with a look-up table including a plurality of previously calculated periods to provide an output indicating the octave, note and degree of sharpness or flatness of said musical sound;

(i) a display means, responsive to said output of said microprocessor means, for displaying said octave, note and degree of sharpness or flatness of said musical sound, said note being displayed as an alphanumeric character and said degree of sharpness or flatness being displayed as a positive or negative number on a scale including a zero value representing perfect concert pitch and a plurality of positive and negative values on each side of zero; and a gain control means, cooperating with said microprocessor means and comprising a discretely variable resistor means, for maintaining a predetermined amplitude of said electrical signal applied to said filter means so that the output signal from the filter means has an amplitude which the fundamentaal detection means and the microprocessor means recognize as indicating detection of the fundamental frequency of said electrical signal.

2. The apparatus as in claim 1, wherein said transducer means comprises a microphone and a phone jack, said apparatus further comprising an operational amplifier means comprising a first operational amplifier connected to an output of said microphone and a second operational amplifier connected to an output of said phone jack, said discretely variable resistor means comprising a first discretely variable resistor connected in parallel with said first operational amplifier and a second discretely variable resistor connected in parallel with said second operational amplifier, said apparatus further comprising a switching means for selectively connecting said filter means to receive alternately an output of said first operational amplifier and said second operational amplifier, whereby said microphone and said phone jack selectively provide said electrical signal to said filter means through said first and said second operational amplifier respectively.

3. The apparatus as in claim 2, wherein said gain control means, maintains a gain of said first operational amplifier and said second operational amplifier at a predetermined minimum gain to maintain a stable, predetermined amplitude of said electrical signal received by said filter means such that said filter output signal has an amplitude within a predetermined range which indicates to said fundamental detection means and said microprocessor means that said frequency of said filter output signal corresponds to said fundamental frequency of said electrical signal.

4. An apparatus for identifying the octave, note and degree of sharpness or flatness of a musical sound, comprising:

(a) a transducer means comprising a microphone and a phone jack for converting said sound into an electrical signal;

(b) a filter means, responsive to said electrical signal provided by said transducer means, for sweeping a plurality of frequencies to pass a filter output signal having a frequency corresponding to a frequency of said electrical signal;

(c) a microprocessor means;

(d) a fundamental detection means, cooperating with said microprocessor means, for analyzing said filter output signal to identify when said frequency of said filter output signal corresponds to the fundamental frequency of said electrical signal and for providing a fundamental detection signal indicating such correspondence, (e) means for maintaining said filer means, responsive to said fundamental detection signal, at a particular scanning frequency at which said frequency of said filter output signal corresponds to said fundamental frequency;

(f) a square wave generator means, responsive to said frequency of said filter output signal corresponding to said fundamental frequency, for providing a square wave output signal having a same period as said filter output signal;

(g) a logic circuit means, responsive to said square wave output signal, for providing an output indicating a period of said square wave output signal;

(h) said microprocessor means comprising means for comparing said output from said logic means with a look-up table including a plurality of previously calculated periods to provide an output indicating the octave, note and degree of sharpness or flatness of said musical sound;

(i) a display means, responsive to said output of said microprocessor means, for displaying said octave, note and degree of sharpness or flatness of said musical sound, said note being displayed as an alphanumeric character and said degree of sharpness or flatness being displayed as a positive or negative number on a scale including a zero value representing perfect concert pitch and a plurality of positive and negative values on each side of zero;

(j) a switching means for selectively connecting said filter means to receive alternately an output of said microphone and said phone jack, whereby said microphone and said phone jack selectively provide said electrical signal to said filter means;

(k) a first operational amplifier connected to a output of said microphone;

(l) a second operational amplifier connected to an output of said phone jack, said first operational amplifier and said second operational amplifier each having an output connected to said switching means; and (m) a gain control means, cooperating with said microprocessor means, for maintaining a gain of said first operational amplifier and said second operational amplifier at a predetermined minimum gain to maintain a stable, predetermined amplitude of said electrical signal received by said filter means such that said output signal has an amplitude within a predetermined range which indicates to said fundamental detection means and said microprocessor means that said frequency of said filter output signal corresponds to said fundamental frequency of said electrical signal, wherein said gain control means comprises a third operational amplifier connected to an output of said switching means to receive alternately said output of said microphone and said phone jack, a first rectifier connected to an output of said third operational amplifier, a first analog-to-digital conversion means receiving an output of said first rectifier and comprising a first analog-to-digital conversion circuit for outputting a digital binary bit value proportional to the output of said first rectifier to indicate whether said output of the first rectifier is greater than a first minimum reference value and less than a second reference value, said microprocessor means comprising means for providing a control signal to alter said gain of said first operational amplifier and said second operational amplifier until said output of said first rectifier is greater than said first minimum reference value and less than said second reference value.

5. The apparatus as in claim 4, wherein said filter means is a switched capacitor band pass filter and said apparatus further comprises an oscillator means for providing an output signal to said filter to cause said filter to sweep said plurality of frequencies and wherein said plurality of frequencies comprises a plurality of octaves of fundamental frequencies and said filter means comprises first means, responsive to setting of said gain at said predetermined optimal gain, for sweeping said plurality of octaves of fundamental frequencies in consecutive order to output said filter output signal which comprises a staircase, sinusoidal waveform, said apparatus further comprising a second rectifier receiving and rectifying said staircase sinusoidal waveform to provide a rectified output to said fundamental detection means, said fundamental detection means comprising a second analog-to-digital conversion means for comparing said rectified output from said rectifier with a plurality of reference values to provide a digital binary output to said microprocessor means to indicate whether said frequency of said filter output signal corresponds to the fundamental frequency of said electrical signal.

6. The apparatus as in claim 5, further comprising:

(a) a buffer means for receiving said output of said switched capacitor pass filter means and providing a buffered output signal, (b) an isolation circuit means for receiving said buffered output signal and isolating it to provide a direct current isolated and alternating current coupled output, and (c) integration means for filtering said DC isolated and A/C coupled output to remove distortion therefrom, and wherein said square wave generator means comprises a comparison circuit connected to said integration circuit, said comparison circuit comprising a first noninverting operational amplifier and a second inverting operational amplifier and a voltage comparator having a first input connected to said first noninverting operational amplifier and a second input connected to said second inverting operational amplifier, said first noninverting operational amplifier and said second inverting operational amplifier providing outputs to said voltage comparator which are opposite and 180° out of phase to cause said voltage comparator to provide said square wave output which changes state once said output of said first noninverting operational amplifier and said second inverting operational amplifier logically intersect each other at 0° and 180° points thereof.

7. The apparatus as in claim 5, further comprising a multiplexer means for receiving said electrical signal and said filter output signal and for providing one of said electrical signal and said filter output signal to said square wave generator means, whereby the fundamental frequency of an unknown sound can be preliminarily quickly determined by bypassing said filter and analyzing the unfiltered electrical signal to provide an unfiltered output and thereafter said unfiltered output can be used to determine a starting point in the sweeping of said filter to increase the fundamental acquisition processing speed.

8. The apparatus as in claim 5, wherein said display means comprises means for selectively displaying alternately all twelve notes of a musical scale, and said apparatus further comprises (i) a manually operable momentary switch means operable in a manual fundamental acquisition mode for causing said display means to display consecutively said twelve notes whereby when a desired note to be tuned is displayed, an operator can cause said display means to maintain a display of said desired note, (ii) a memory means for storing data based on said output of said microprocessor means indicating said note of said musical sound, and (iii) means, responsive to one of (a) said display means being maintained at said desired note and (b) said data stored in said memory means indicating said note of said musical sound for causing said filter to sweep frequencies around each octave of one of (a) said desired note and (b) said note represented by said data stored in said memory means by scanning frequencies of said desired note in order in said plurality of octaves until said fundamental detection means and said microprocessor means detect the fundamental frequency of said electrical signal.

9. The apparatus as in claim 5, wherein said square wave generator means comprises a comparison circuit and said apparatus further comprises an isolation circuit means, interposed between said switched capacitor bypass filter means and said comparison circuit, for receiving an output from said switched capacitor bypass filter means to enable a direct current isolated and alternating current coupled output to be provided to said comparison means.

10. An apparatus for identifying the octave, note and degree of sharpness or flatness of a musical sound, comprising:

(a) a transducer means comprising a microphone and a phone jack for converting said sound into an electrical signal;

(b) a filter means, responsive to said electrical signal provided by said transducer means, for sweeping a plurality of frequencies to pass a filter output signal having a frequency corresponding to a frequency of said electrical signal;

(c) a microprocessor means;

(d) a fundamental detection means, cooperating with said microprocessor means, for analyzing said filter output signal to identify when said frequency of said filter output signal corresponds to the fundamental frequency of said electrical signal and for providing a fundamental detection signal indicating such correspondence, (e) means for maintaining said filter means, responsive to said fundamental detection signal, at a particular scanning frequency at which said frequency of said filter output signal corresponds to said fundamental frequency;

(f) a square wave generator means, responsive to said frequency of said filter output signal corresponding to said fundamental frequency, for providing a square wave output signal having a same period as said filter output signal;

(g) a logic circuit means, responsive to said square wave output signal, for providing an output indicating a period of said square wave output signal;

(h) said microprocessor means comprising means for comparing said output from said logic means with a look-up table including a plurality of previously calculated periods to provide an output indicating the octave, note and degree of sharpness or flatness of said musical sound;

(i) a display means, responsive to said output of said microprocessor means, for displaying said octave, note and degree of sharpness or flatness of said musical sound, said note being displayed as an alphanumeric character and said degree of sharpness or flatness being displayed as a positive or negative number on a scale including a zero value representing perfect concert pitch and a plurality of positive and negative values on each side of zero;

(j) a first circuit means, connected to said output of said filter means, for providing an AC coupled and DC isolated output signal; and (k) an integration circuit receiving said AC coupled and DC isolated output of said first circuit means for removing DC components therefrom; and wherein said square wave generator means comprises a comparison circuit connected to said integration circuit and comprising a first non-inverting operational amplifier and a second inverting operational amplifier and a voltage comparator having a positive input connected to said first non-inverting operational amplifier and a negative input connected to said second inverting operational amplifier, said first non-inverting operational amplifier and said second inverting operational amplifier providing outputs to said voltage comparator which are opposite and 180° out-of-phase to cause said voltage comparator to provide said square wave output which changes state when said outputs of said first non-inverting operational amplifier and said second inverting operational amplifier logically intersect each other at 0° and 180° points thereof.

11. The apparatus as in claim 10, wherein said logic means comprises a digital synchronization and counting means for counting the period of said square wave output, and said apparatus further comprises a synchronization means, receiving said square wave output from said voltage comparator, for synchronizing said square wave output to said digital synchronization and counting means.

12. The apparatus as in claim 11, wherein said synchronization means comprises a Schmitt trigger.

13. The apparatus as in claim 11, wherein said logic means further comprises a calculation means, responsive to said digital synchronization and counting means, for calculating and providing output data representing said period of said square wave output, a memory means for storing said output data for a plurality of consecutive periods of said square wave output, said plurality of periods being greater than or equal to sixteen, an addition means for adding said output data for sixteen periods of said plurality of periods, an averaging means for providing an output representing an average of said output data for said sixteen periods, and wherein said microprocessor means comprises a comparison means for comparing said output of said averaging circuit against said lookup table which comprises 1200 previously calculated values of periods relating to different frequencies to determine said octave, note and degree of sharpness or flatness of said musical sound.

14. The apparatus as in claim 13, wherein said logic means further comprises a calculation means, responsive to said digital synchronization and counting means, for calculating and providing output data representing said period of said square wave output and an arithmetic mean determination means for determining an arithmetic mean of a plurality of consecutive said periods of said square wave output, said arithmetic detection mean comprising:

(a) first, second, third, and fourth memory buffers;

(b) means for adding said output data for at least sixteen periods of said square wave output;

(c) an averaging circuit for providing a first boundary representing an average of said output data for said at least sixteen periods of said square wave output;

(d) means for determining a second boundary having a value which is a predetermined amount less than said first boundary and a third boundary having a value which is a predetermined amount greater than said first boundary;

(e) means for examining individual periods of said square wave output to determine whether a period correlates to said first, second, or third boundary for incrementing said first, second, or third memory buffer respectively when a correlation is found with said first, second or third boundary and if no such correlation is found, for incrementing said fourth buffer memory; and (f) means for determining whether said first, second or third buffer memory has been incremented to a count of sixteen prior to said fourth buffer memory being incremented to a predetermined threshold buffer limit.

* * * * *